US011898413B2

(12) United States Patent
Brown et al.

(10) Patent No.: US 11,898,413 B2
(45) Date of Patent: Feb. 13, 2024

(54) EXPANDING AND COLLAPSING APPARATUS AND METHODS OF USE

(71) Applicant: Schlumberger Technology Corporation, Sugar Land, TX (US)

(72) Inventors: Gareth Brown, Ellon (GB); Oliver Fry, Aberdeen (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 175 days.

(21) Appl. No.: 17/621,999

(22) PCT Filed: Jul. 2, 2020

(86) PCT No.: PCT/US2020/040732
§ 371 (c)(1),
(2) Date: Dec. 22, 2021

(87) PCT Pub. No.: WO2021/003412
PCT Pub. Date: Jan. 7, 2021

(65) Prior Publication Data

US 2022/0268116 A1 Aug. 25, 2022

Related U.S. Application Data

(60) Provisional application No. 62/908,157, filed on Sep. 30, 2019, provisional application No. 62/908,237,
(Continued)

(51) Int. Cl.
*E21B 33/1295* (2006.01)
*E21B 33/12* (2006.01)
(Continued)

(52) U.S. Cl.
CPC ..... *E21B 33/1295* (2013.01); *E21B 23/01* (2013.01); *E21B 33/1208* (2013.01);
(Continued)

(58) Field of Classification Search
CPC .. E21B 33/12; E21B 33/1208; E21B 33/1216; E21B 33/134; E21B 33/1291;
(Continued)

(56) References Cited

U.S. PATENT DOCUMENTS 2,701,615 A 2/1955 Riordan, Jr.
3,572,627 A 3/1971 Jones
(Continued)

FOREIGN PATENT DOCUMENTS

GB 2559109 A 8/2018
WO 2010032152 A1 3/2010
(Continued)

OTHER PUBLICATIONS

Extended Search Report issued in European Patent Application No. 20835559.4 dated Jan. 9, 2023, 10 pages.
(Continued)

*Primary Examiner* — David Carroll
(74) *Attorney, Agent, or Firm* — Jeffrey D. Frantz

(57) ABSTRACT

Embodiments described herein provide an expanding and collapsing apparatus and methods of use. The apparatus includes a plurality of elements assembled together to form a ring structure about a longitudinal axis. The ring structure is operable to be moved between an expanded condition and a collapsed condition by movement of the plurality of elements. At least one set of structural elements are operable to move between the expanded condition and the collapsed condition by movement of a first end in an axial direction, and by movement of a second end in a radial dimension. In certain embodiments, the plurality of elements includes at least one set of structural elements extending longitudinally on the apparatus and operable to slide with respect to one another. Applications of the embodiments described herein include oilfield devices, including anti-extrusion rings,
(Continued)

plugs, packers, locks, patching tools, connection systems, and variable diameter tools run in a wellbore.

20 Claims, 40 Drawing Sheets

Related U.S. Application Data filed on Sep. 30, 2019, provisional application No. 62/908,104, filed on Sep. 30, 2019, provisional application No. 62/908,213, filed on Sep. 30, 2019, provisional application No. 62/869,773, filed on Jul. 2, 2019.

(51) Int. Cl.

| | |
|---|---|
| ***E21B 33/129*** | (2006.01) |
| ***E21B 33/134*** | (2006.01) |
| ***E21B 23/01*** | (2006.01) |
| ***E21B 33/128*** | (2006.01) |
| ***E21B 34/06*** | (2006.01) |

(52) U.S. Cl.
CPC ..... *E21B 33/128* (2013.01); *E21B 33/1216* (2013.01); *E21B 33/1294* (2013.01); *E21B 33/134* (2013.01); *E21B 34/06* (2013.01)

(58) Field of Classification Search
CPC ..... E21B 33/1292; E21B 33/1293; E21B 33/1294; E21B 33/1295; E21B 33/1212
See application file for complete search history.

(56) References Cited

U.S. PATENT DOCUMENTS

| | | | | |
|---|---|---|---|---|
| 3,872,925 | A | 3/1975 | Owen et al. | |
| 3,915,424 | A | 10/1975 | LeRouax | |
| 4,892,144 | A | 1/1990 | Coone | |
| 5,277,253 | A | 1/1994 | Giroux et al. | |
| 5,279,370 | A | 1/1994 | Brandell et al. | |
| 6,598,672 | B2 | 7/2003 | Bell et al. | |
| 7,290,603 | B2 | 11/2007 | Hiorth et al. | |
| 7,921,921 | B2 | 4/2011 | Bishop et al. | |
| 8,083,001 | B2 | 12/2011 | Conner et al. | |
| 8,167,033 | B2 | 5/2012 | White | |
| 2002/0092654 | A1 | 7/2002 | Coronado et al. | |
| 2004/0194969 | A1* | 10/2004 | Hiorth | E21B 33/1293 166/387 |
| 2010/0071908 | A1 | 3/2010 | Bishop et al. | |
| 2013/0319654 | A1* | 12/2013 | Hiorth | E21B 33/128 166/179 |
| 2014/0144625 | A1 | 5/2014 | Corre et al. | |
| 2015/0152704 | A1* | 6/2015 | Tunget | E21B 33/1208 166/299 |
| 2015/0275618 | A1 | 10/2015 | Clemens et al. | |
| 2016/0298414 | A1 | 10/2016 | Staehr et al. | |
| 2017/0218710 | A1 | 8/2017 | Zhou | |
| 2018/0245423 | A1* | 8/2018 | Stormo | E21B 33/1293 |
| 2019/0323316 | A1 | 10/2019 | Brown et al. | |
| 2019/0352997 | A1 | 11/2019 | Brown | |
| 2021/0071496 | A1 | 3/2021 | Brown et al. | |

FOREIGN PATENT DOCUMENTS

| | | | |
|---|---|---|---|
| WO | 2013165255 | A1 | 11/2013 |
| WO | 2018087553 | A1 | 5/2018 |
| WO | 2018186869 | A1 | 10/2018 |
| WO | 2019002882 | A1 | 1/2019 |
| WO | 2019002883 | A1 | 1/2019 |
| WO | 2021003415 | A1 | 1/2021 |

OTHER PUBLICATIONS

International Preliminary Report on Patentability issued in the PCT Application No. PCT/US2021/057886 dated Jun. 1, 2023, 7 pp.
Extended Search Report issued in European Patent Application No. 20835558.6 dated Feb. 1, 2023, 8 pages.
International Search Report and Written Opinion issued in PCT Application PCT/US2020/040735, dated Oct. 20, 2020 (12 pages).
International Search Report and Written Opinion issued in PCT Application PCT/US2020/040732, dated Oct. 15, 2020 (15 pages).
Notice of Allowance issued in U.S. Appl. No. 17/101,283 dated Jan. 11, 2022, 15 pages.
International Preliminary Report on Patentability issued in PCT Application PCT/US2020/040732 dated Jan. 13, 2022, 11 pages.
International Preliminary Report on Patentability issued in PCT Application PCT/US2020/040735 dated Jan. 13, 2022, 10 pages.
International Search Report and Written Opinion issued in PCT Application PCT/US2021/057886, dated Feb. 23, 2022, 11 pages.

* cited by examiner

EXPANDING AND COLLAPSING APPARATUS AND METHODS OF USE

PRIORITY CLAIM/CROSS REFERENCE TO RELATED APPLICATIONS

This Patent Document is a National Stage Entry of International Application No. PCT/US2020/040732 filed Jul. 2, 2020, which claims the benefit of and priority under 35 U.S.C. § 120 U.S. Provisional Patent Application No. 62/869,773, titled "Expanding and Collapsing Apparatus and Methods of Use," filed Jul. 2, 2019; U.S. Provisional Patent Application No. 62/908,104, titled "Expanding and Collapsing Apparatus Having Interlocking Features," filed Sep. 30, 2019; U.S. Provisional Patent Application No. 62/908,157, titled "Expanding and Collapsing Apparatus Having Wedge Features," filed Sep. 30, 2019; U.S. Provisional Patent Application No. 62/908,213, titled "Expanding and Collapsing Apparatus with Seal Pressure Equalization," filed Sep. 30, 2019; and U.S. Provisional Patent Application No. 62/908,237, titled "Expanding and Collapsing Apparatus with Elastomer Sealing," filed Sep. 30, 2019. Each of the foregoing applications is incorporated by reference herein in its entirety for all purposes.

BACKGROUND

The present disclosure generally relates to an expanding and collapsing apparatus for use in oilfield devices including, but not limited to, anti-extrusion rings, plugs, packers, locks, patching tools, connection systems, and variable diameter tools run in a wellbore.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as an admission of any kind.

In many fields of mechanical engineering, and in the field of hydrocarbon exploration and production in particular, it is known to provide expansion mechanisms for the physical interaction of tubular components. Expansion mechanisms may expand outwardly to engage an external surface, or may collapse inwardly to engage an internal surface. Applications are many and varied, but in hydrocarbon exploration and production include the actuation and setting of flow barriers and seal elements such as plugs and packers, anchoring and positioning tools such as wellbore anchors, casing and liner hangers, and locking mechanisms for setting equipment downhole. Other applications include providing anti-extrusion, mechanical support or back up for elements such as elastomers or inflatable bladders. For example, a typical anti-extrusion ring is positioned between a packer or seal element and its actuating slip members, and is formed from a split or segmented metallic ring. During deployment of the packer or seal element, the segments move to a radially expanded condition. During expansion and at the radially expanded condition, spaces are formed between the segments, as they are required to occupy a larger annular volume. These spaces create extrusion gaps, which may result in failure of the packer or seal under working conditions.

Various configurations have been proposed to minimize the effect of spaces between anti-extrusion segments, including providing multi-layered rings, such that extrusion gaps are blocked by an offset arrangement of segments. For example, U.S. Pat. No. 6,598,672 describes an anti-extrusion ring for a packer assembly, which has first and second ring portions that are circumferentially offset to create gaps in circumferentially offset locations. U.S. Pat. No. 2,701,615 discloses a well packer comprising an arrangement of crowned spring metal elements, which are expanded by relative movement. Other proposals, for example those disclosed in U.S. Pat. Nos. 3,572,627, 7,921,921, U.S. Patent Application Publication No. 2013/0319654, U.S. Pat. Nos. 7,290,603, and 8,167,033 include arrangements of circumferentially lapped segments. U.S. Pat. No. 3,915,424 describes a similar arrangement in a drilling BOP configuration, in which overlapping anti-extrusion members are actuated by a radial force to move radially and circumferentially to a collapsed position, which supports annular sealing elements. Such arrangements avoid introducing extrusion gaps during expansion, but create a ring with uneven or stepped faces or flanks. These configurations do not provide an unbroken support wall for a sealing element, are spatially inefficient, and may be difficult to reliably move back to their collapsed configurations. U.S. Pat. No. 8,083,001 proposes an alternative configuration in which two sets of wedge-shaped segments are brought together by sliding axially with respect to one another to create an expanded gauge ring. Applications of existing expanding and collapsing apparatus are limited by the expansion ratios that can be achieved. In anchoring, positioning, setting, locking and connection applications, radially expanding and collapsing structures are typically circumferentially distributed at discrete locations when at their increased outer diameter. This reduces the surface area available to contact an auxiliary engagement surface and, therefore, limits the maximum force and pressure rating for a given size of device.

SUMMARY

A summary of certain embodiments described herein is set forth below. It should be understood that these aspects are presented merely to provide the reader with a brief summary of these certain embodiments and that these aspects are not intended to limit the scope of this disclosure.

The systems and methods provided herein provide an expanding and collapsing apparatus and methods of use that obviate or mitigate disadvantages of previously proposed expanding and collapsing apparatus. For example, the embodiments described herein provide an oilfield apparatus including, but not limited to, a downhole apparatus, a wellhead apparatus, or a drilling apparatus, incorporating an expanding and collapsing apparatus, which obviates or mitigates disadvantages of prior art oilfield apparatus. In the context of the present disclosure, the terms "ring" and "ring structure" are used to designate an arrangement of one or more components or elements engaging or joined to itself to surround an axis, but is not limited to arrangements that are rotationally symmetric or symmetric about a plane perpendicular to the axis.

Certain embodiments of the present disclosure include an expanding and collapsing apparatus, which includes a plurality of elements assembled together to form a ring structure about a longitudinal axis. The ring structure is configured to be moved between an expanded condition and a collapsed condition by movement of the plurality of elements. The plurality of elements includes a plurality of support elements, each support element having a first end and a second end, wherein the plurality of support elements are configured to move between the expanded condition and the collapsed condition by movement of the first end in an axial direction, and by movement of the second end in at least a radial dimension. The plurality of elements also includes a plurality of ring elements configured to be moved between the expanded and collapsed conditions by sliding with respect to one another in a direction tangential to a circle concentric with the ring structure. Each support element of the plurality of support elements includes a first hinge configured to mate with a second hinge of an adjacent ring element of the plurality of ring elements.

Other embodiments of the present disclosure include an expanding and collapsing apparatus, which includes a plurality of elements assembled together to form a ring structure around a longitudinal axis. The ring structure is configured to be moved between an expanded condition and a collapsed condition by movement of the plurality of elements. The plurality of elements includes a plurality of support elements, each support element having a first end and a second end, wherein the plurality of support elements are configured to move between the expanded condition and the collapsed condition by movement of the first end in an axial direction, and by movement of the second end in at least a radial dimension. The plurality of elements also includes a plurality of ring elements configured to be moved between the expanded and collapsed conditions by sliding with respect to one another in a direction tangential to a circle concentric with the ring structure. Each support element of the plurality of support elements includes one or more male interlocks extending from a first surface of the support element, and one or more female interlocks extending into a second surface of the support element. Each male interlock of the one or more male interlocks are configured to mate with a corresponding female interlock of the one or more female interlocks of an adjacent support element to guide movement of the support element relative to the adjacent support element.

Other embodiments of the present disclosure include an expanding and collapsing apparatus, which includes a plurality of elements assembled together to form a ring structure about a longitudinal axis. The ring structure is configured to be moved between an expanded condition and a collapsed condition by movement of the plurality of elements. The plurality of elements includes a plurality of support elements, each support element having a first end and a second end, wherein the plurality of support elements are configured to move between the expanded condition and the collapsed condition by movement of the first end in an axial direction, and by movement of the second end in at least a radial dimension. The plurality of elements also includes a plurality of ring elements configured to be moved between the expanded and collapsed conditions by sliding with respect to one another in a direction tangential to a circle concentric with the ring structure. Each ring element of the plurality of ring elements includes a ring cap forming a primary wedge, and a secondary wedge extending from a side of the ring cap.

Other embodiments of the present disclosure include an expanding and collapsing apparatus, which includes a plurality of elements assembled together to form a ring structure around a longitudinal axis. The ring structure is configured to be moved between an expanded condition and a collapsed condition by movement of the plurality of elements. The plurality of elements includes a plurality of support elements, each support element having a first end and a second end, wherein the plurality of support elements are configured to move between the expanded condition and the collapsed condition by movement of the first end in an axial direction, and by movement of the second end in at least a radial dimension. The plurality of elements also includes a plurality of ring elements configured to be moved between the expanded and collapsed conditions by sliding with respect to one another in a direction tangential to a circle concentric with the ring structure. The expanding and collapsing apparatus also includes an elastomer disposed about the plurality of elements and configured to generate a seal between the plurality of elements and a tubular within which the expanding and collapsing apparatus is disposed. The elastomer includes a cross-sectional profile having contoured curves configured to correspond with features of the plurality of ring elements Various refinements of the features noted above may be undertaken in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings, in which.

DETAILED DESCRIPTION

Figure 1A:
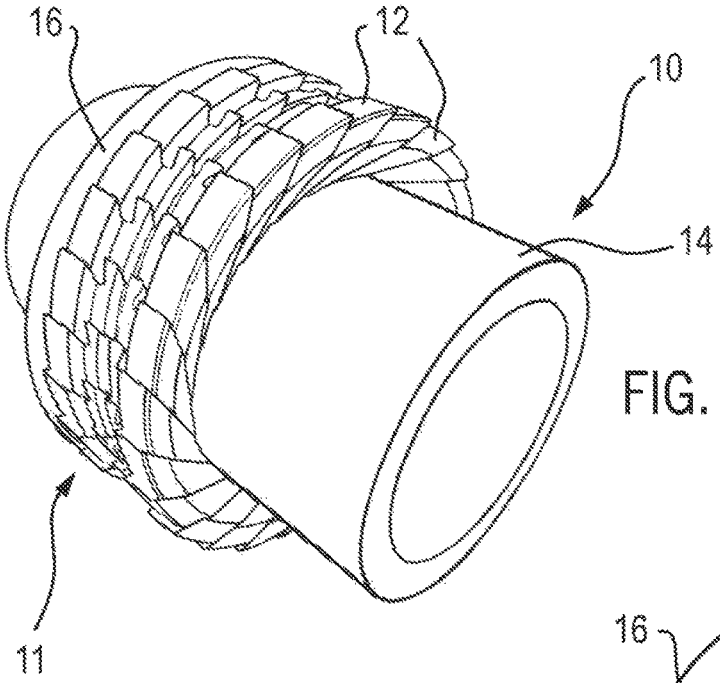
FIGS. 1A through 1D are respective perspective, first end, part sectional, and second end views of an apparatus shown in a collapsed condition, in accordance with embodiments of the present disclosure.

One or more specific embodiments of the present disclosure will be described below. These described embodiments are only examples of the presently disclosed techniques.

Additionally, to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As used herein, the terms "connect," "connection," "connected," "in connection with," and "connecting" are used to mean "in direct connection with" or "in connection with via one or more elements"; and the term "set" is used to mean "one element" or "more than one element." Further, the terms "couple," "coupling," "coupled," "coupled together," and "coupled with" are used to mean "directly coupled together" or "coupled together via one or more elements." As used herein, the terms "up" and "down," "uphole" and "downhole," "upper" and "lower," "top" and "bottom," and other like terms indicating relative positions to a given point or element are utilized to more clearly describe some elements. Commonly, these terms relate to a reference point as the surface from which drilling operations are initiated as being the top (e.g., uphole or upper) point and the total depth along the drilling axis being the lowest (e.g., downhole or lower) point, whether the well (e.g., wellbore, borehole) is vertical, horizontal or slanted relative to the surface.

The present disclosure generally relates to an expanding and collapsing apparatus for use in oilfield devices, including anti-extrusion rings, plugs, packers, locks, patching tools, connection systems, and variable diameter tools run in a wellbore. The embodiments described herein enable relatively high expansion applications. In addition, at an optimal expansion condition, the outer surfaces of the individual elements combine to form a complete circle with no gaps in between the individual elements and, therefore, the apparatus can be optimized for a specific diameter, to form a perfectly round expanded ring (within manufacturing tolerances) with no extrusion gaps on the inner or outer surfaces of the ring structure. The design of the expansion apparatus described herein also has the benefit that a degree of under expansion or over expansion (for example, to a slightly different radial position) does not introduce significantly large gaps. In addition, the elements described herein are mutually supported before, throughout, and after the expansion, and do not create gaps between the individual elements during expansion or at the fully expanded position. In addition, the arrangement of elements in a circumferential ring facilitates the provision of smooth side faces or flanks on the expanded ring structure. This enables use of the apparatus in close axial proximity to other functional elements, and/or as ramps or surfaces for deployment of other expanding structures. In addition, each of the ring structures described herein provides a smooth, unbroken circumferential surface, which may be used in engagement or anchoring applications, including in plugs, locks, and connectors. This may provide an increased anchoring force, or full abutment with upper and lower shoulders defined in a locking or latching profile, enabling tools or equipment be rated to a higher maximum working pressure.

Referring first to FIGS. TA through 4F, the principles of the embodiments of the present disclosure will be described with reference to an expanding apparatus 10 in the form of a simple ring. In this embodiment, the expanding apparatus 10 includes an expanding ring structure configured to be expanded from a first collapsed or unexpanded condition (shown in FIGS. TA through 1D) and a second expanded condition (shown in FIGS. 2A through 2D). The apparatus 10 illustrated in these figures may be referred to as an "expanding apparatus" for convenience, as they are operable to move to an expanded state from a normal collapsed state. However, the apparatus 10 may equally be referred to as a "collapsing apparatus," an "expanding and collapsing apparatus," or an "expanding and/or collapsing apparatus," as they are capable of being expanded or collapsed, depending on operational state.

As illustrated, in certain embodiments, the expanding apparatus 10 includes a plurality of elements 12 assembled together to form a ring structure 11, which defines an inner ring surface, which is supported by an outer surface of a cylinder 14. In certain embodiments, each element 12 includes an inner surface 20, an outer surface 21, and first and second contact surfaces 22, 23. In certain embodiments, the first and second contact surfaces 22, 23 may be oriented in non-parallel planes, which are tangential to a circle centered on a longitudinal axis of the apparatus 10. In certain embodiments, the non-parallel orientation planes of the first and second contact surfaces 22, 23 converge towards the inner surface 20 of the element 12. Therefore, in certain embodiments, each element 12 may be in the general form of a wedge, and the wedges may be assembled together in a circumferentially overlapping fashion to form the ring structure 11. In operation, the first and second contact surfaces 22, 23 of adjacent elements 12 are mutually supportive.

Figure 3:
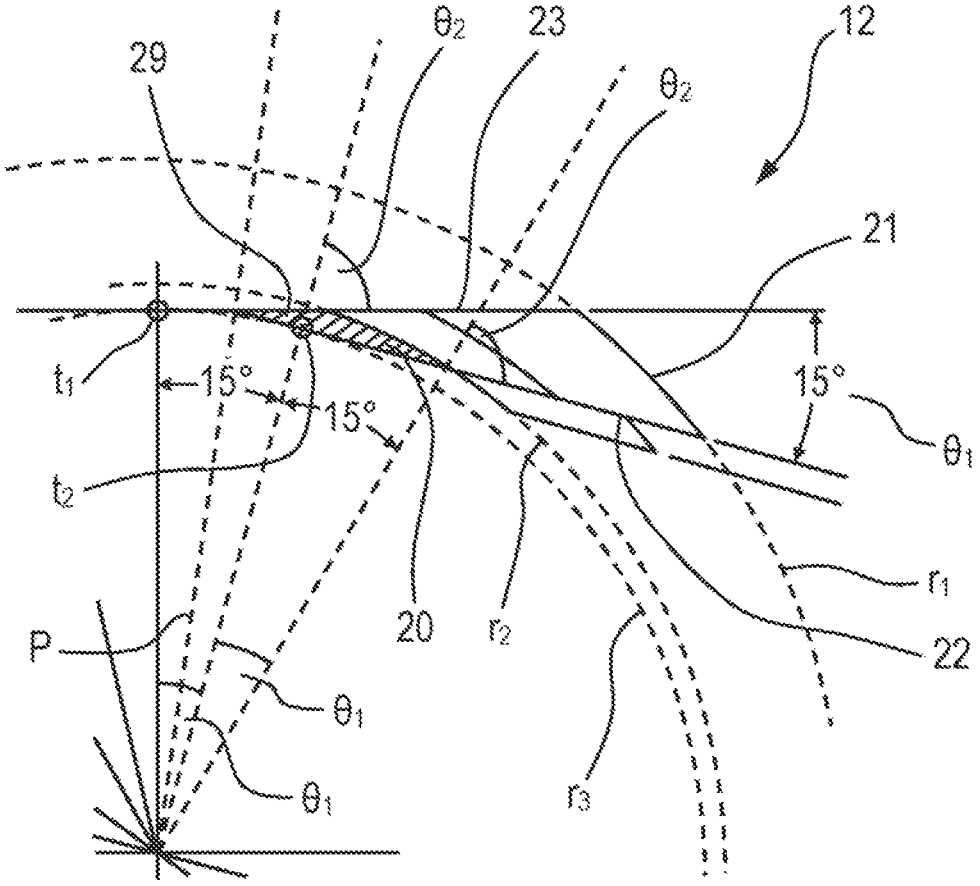
FIG. 3 is a geometric representation of an element of the apparatus of FIGS. 1A through 1D, shown from one side, in accordance with embodiments of the present disclosure.
Figure 4A:
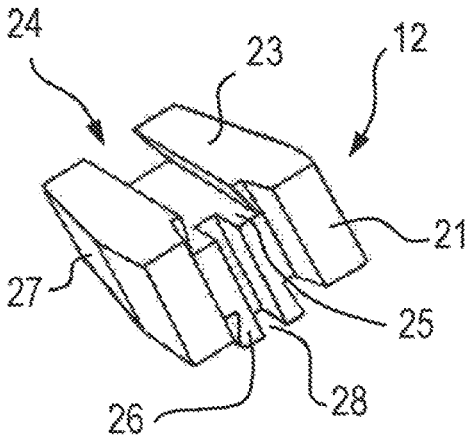
FIGS. 4A through 4F are respective first perspective, second perspective, plan, first end, lower, and second end views of an element of the apparatus of FIGS. 1A through 1D, in accordance with embodiments of the present disclosure.
Figure 4B:
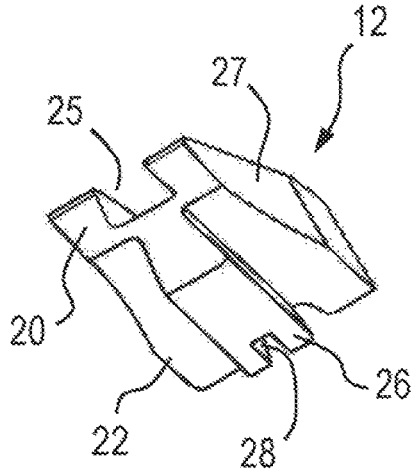
Figure 4C:
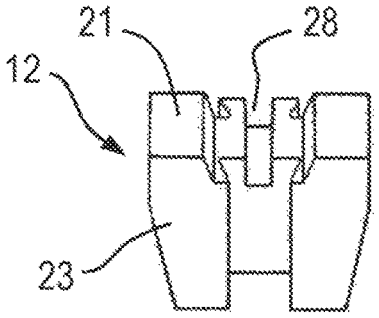
Figure 4D:
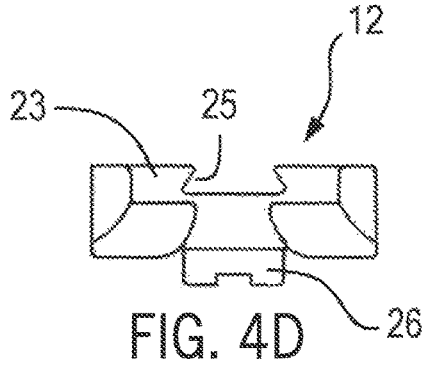
Figure 4E:
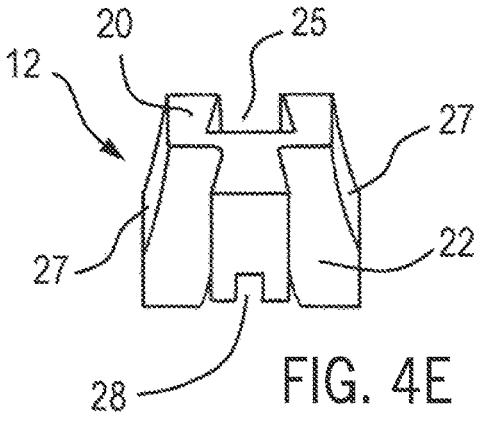
Figure 4F:
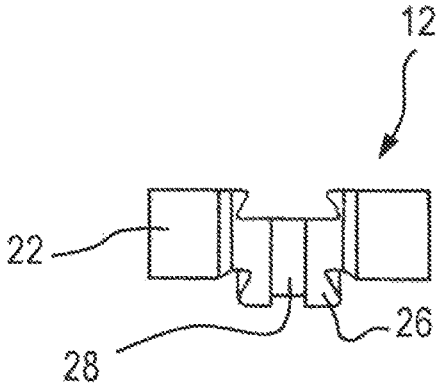

As illustrated in FIG. 3, when the ring structure 11 is expanded to its optimal outer diameter, the orientation planes of the first and second contact surfaces 22, 23 intersect an inner surface of the ring structure 11, and together with the longitudinal axis of the apparatus 10, the lines of intersection define a sector of a cylinder. In such embodiments, the ring structure 11 is formed from twenty-four identical elements 12, and the central angle $\theta_1$ is approximately 15 degrees. The angle described between the orientation planes of the first and second contact surface 22, 23 is the same as (e.g., within 2 degrees, within 1.5 degrees, within 1 degree, within 0.5 degree, or even closer, in certain embodiments) the central angle of the cylindrical sector, so that the elements 12 are arranged rotationally symmetrically in the structure 11.

As illustrated, in certain embodiments, each element 12 is based on a notional wedge-shaped segment of a ring centered on an axis, with each notional wedge-shaped segment being inclined with respect to the radial direction of the ring. In general, the nominal outer diameter of the segment is at the optimum expansion condition of the ring (with radius shown at $r_1$).

As illustrated, in certain embodiments, the orientation planes of the first and second contact surfaces 22, 23 of the element 12 are tangential to a circle with radius $r_3$ concentric with the ring at points $t_1$, $t_2$. The angle described between the tangent points is equal to the angle $\theta_1$ of the segment. The orientation planes of the first and second contact surfaces 22, 23 of each notional wedge-shaped segment intersect one another on a radial plane P, which bisects radial planes located at the tangent points (i.e., is at an angle of $\theta_1/2$ to both). This intersection plane P defines the expanding and collapsing path of the segment.

Figure 1B:
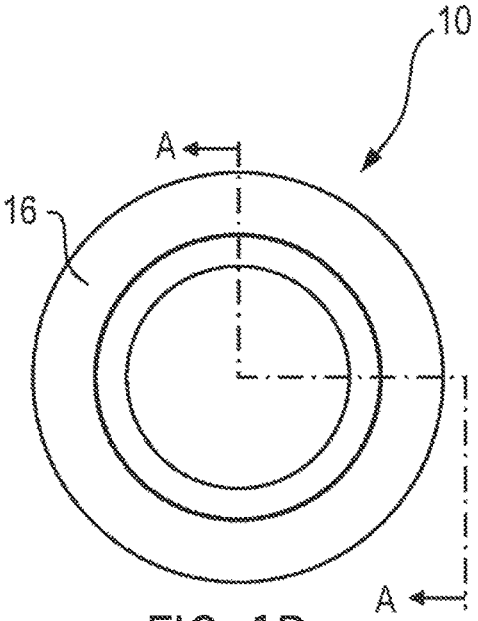
Figure 1D:
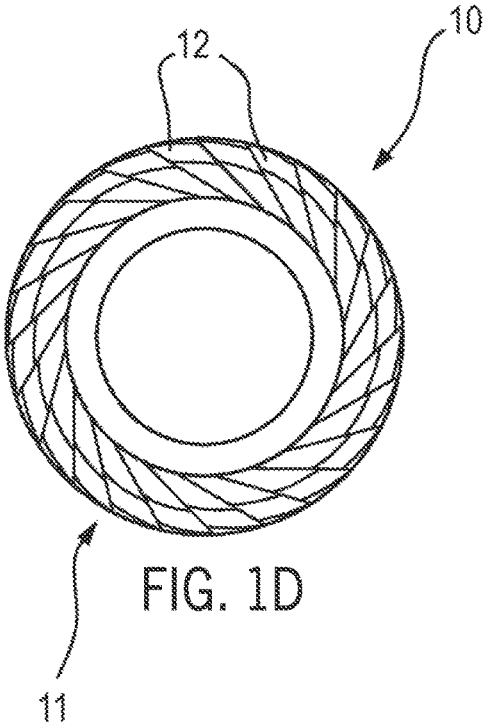
Figure 1C:
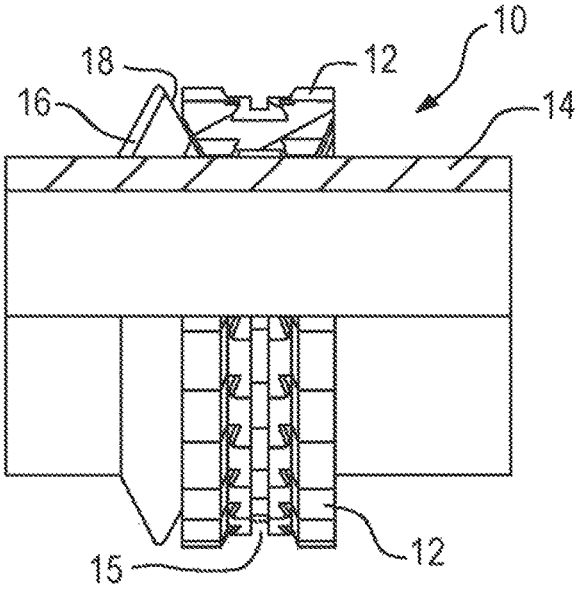
Figure 2A:
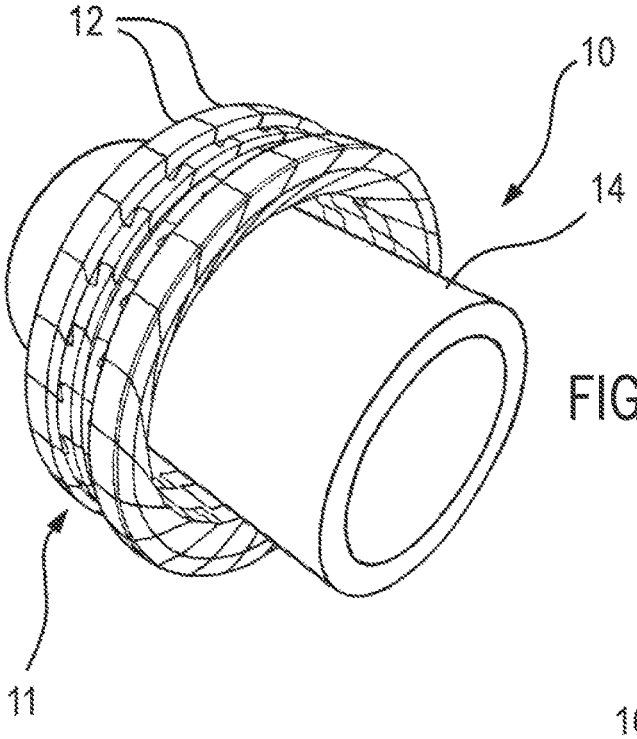
FIGS. 2A through 2D are respective perspective, first side, part sectional, and second side views of the apparatus of FIGS. 1A through 1D, shown in an expanded condition, in accordance with embodiments of the present disclosure.
Figure 2B:
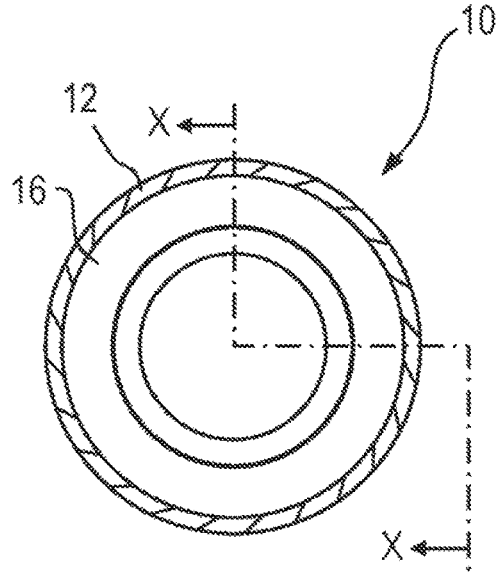
Figure 2D:
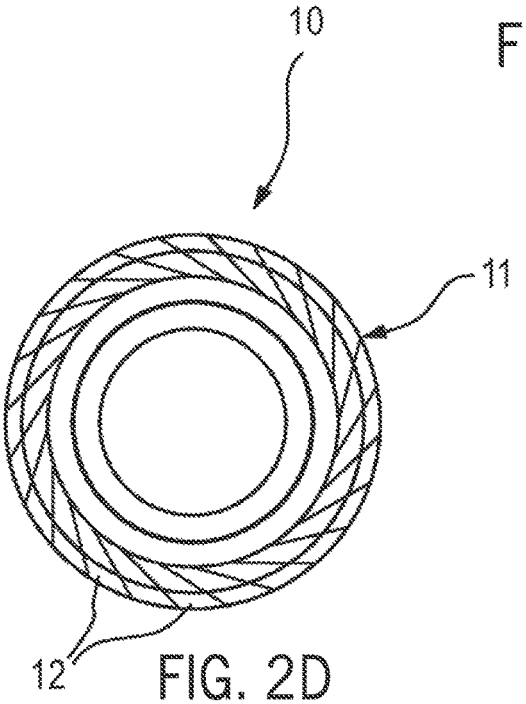
Figure 2C:
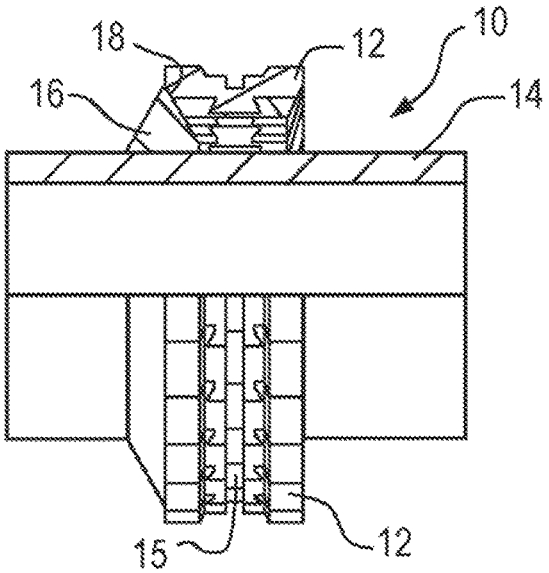

In the configuration shown in FIGS. 1A through 2D, notional wedge-shaped segments are modified by removal of tips 29 of the wedges, to provide a curved or arced inner surface 20 with radius ¾ when the ring is in its expanded condition, as illustrated in FIGS. 2A and 2D. The modification of the wedge-shaped elements 12 may be thought of as an increase in diameter of an internal bore through the ring structure by $2(r_2-r_3)$, or a truncation of the inner diameter. This change in the inner diameter from the notional inner diameter $r_3$ to which the contact surfaces 22, 23 are tangential to a truncated inner diameter has the effect of changing an angle between the contact surfaces 22, 23 and the radial plane from the center of the ring. Taking angle $\theta_2$ to be an angle described between the contact surface 22, 23 and a radial plane defined between the center point of the ring structure and the point at which the orientation surface 22, 23 meets or intersects a circle at the radial position of the inner surface 20, $\theta_2$ may be changed in dependence on the amount by which the segment has its inner diameter truncated. For the notional wedge shaped segment, the orientation planes of the contact surfaces 22, 23 are tangential to a circle at the inner diameter at (i.e., angle $\theta_2$ is approximately 90 degrees). For the modified elements 12, the orientation planes of the contact surfaces 22, 23, instead, intersect a circle at the (increased) inner diameter, and are inclined at a reduced angle $\theta_2$.

In certain embodiments, the angle $\theta_2$ at which the segment is inclined is related to the amount of material removed from the notional wedge-shaped segment, but is independent from the central angle $\theta_1$ of the wedge. Angle $\theta_2$ is selected to provide element dimensions suitable for manufacture, robustness, and fit within the desired annular volume and inner and outer diameters of the collapsed ring. As the angle $\theta_2$ approaches 90 degrees, a shallower, finer wedge profile is created by the element 12, which may enable optimization of the collapsed volume of the ring structure. Although a shallower, finer wedge profile may have the effect of reducing the size of the gaps created at the inner surface of the ring in the collapsed condition and/or enabling a more compact collapsed condition, there may be some consequences, including the introduction of flat sections at the inner surfaces 20 of the elements 12, which manifest as spaces at the inner diameter of the ring when in an expanded or partially expanded condition. When 02 is 90 degrees and the segments are purely tangential to inner diameter, the collapsed volume for a given outer diameter and inner diameter is most efficient, but the inner surface of the ring structure is polygonal with flat sections created by each segment. However, these flat sections may be undesirable. There may also be potential difficulties with manufacture of the elements 12, and robustness of the elements 12 as well as the assembled ring structure 11. However, in many applications, where the profile of the inner surface of the expanded ring may not be critical, for example, when the inner diameter of the ring structure is floating and/or the true inner diameter is defined by an actuation wedge profile rather than the inner surface of the ring, this compromise may not be detrimental to the operation of the apparatus 10, and the reduced collapse volume may justify an inclination angle $\theta_2$ of (or approximately) 90 degrees.

In the apparatus 10 illustrated in FIGS. TA through 4F, the angle $\theta_2$ is approximately 75 degrees. Relaxing $\theta_2$ to a reduced angle would provide a smooth outer diameter and inner diameter profile to the expanded ring, as a portion of the inner circular arc may be retained at the expense of a slightly increased collapsed volume. It should be noted that the angle $\theta_2$ is independent from the angle $\theta_1$. Where the ring structure 11 is desired to have a circular inner surface, certain embodiments may have an angle $\theta_2$ that is in the range of (90 degrees-2 $\theta_1$) to 90 degrees inclusive, and certain embodiments may have an angle $\theta_2$ in the range of approximately 70 degrees to approximately 90 degrees (e.g., in a range of approximately 73 degrees to approximately 90 degrees, in certain embodiments). In general, to provide sufficient truncation of the inner diameter to retain a useful portion of an inner arc, and to provide a smooth inner surface to the ring structure 11, a maximum value for $\theta_2$ of (90 degrees$-\theta_1/2$) may be used. This would be approximately 82.5 degrees in the described embodiments.

In other embodiments, the geometry of the notional wedge-shaped segments forming the elements 12 may be unmodified (save for the provision of functional formations such as for interlocking and/or retention of the elements 12), without the removal of material from the tip 29 of the notional wedge-shaped segments. Such embodiments may be desirable when there is no requirement for the ring structure 11 to have a circular inner surface.

As illustrated in FIGS. 4A through 4F, the first and second contact surfaces 22, 23 of the element 12 may have corresponding interlocking profiles 24 formed therein, such that adjacent elements 12 may interlock with one another. In such embodiments, the interlocking profiles include a dovetail groove 25 and a corresponding dovetail tongue 26. The interlocking profiles 24 resist circumferential and/or radial separation of the elements 12 in the ring structure 11, but permit relative sliding motion between adjacent elements 12. The interlocking profiles 24 also facilitate smooth and uniform expansion and contraction of the elements 12 during use. It will be appreciated that alternative forms of interlocking profiles 24, for example, including recesses and protrusions of other shapes and forms, may be used within the scope of the present disclosure.

In certain embodiments, the elements 23 may also include inclined side wall portions 27, which may facilitate deployment of the apparatus 10 in use. In certain embodiments, the side wall portions 27 are formed in an inverted cone shape, which corresponds to the shape and curvature of the actuating cone wedge profiles when the apparatus 10 is in its maximum load condition (e.g., typically at its optimum expansion condition).

In certain embodiments, each element 12 may also be provided with a groove 28, and in the assembled ring structure, the grooves are aligned to provide a circular groove, which extends around the ring. The groove accommodates a biasing element (not shown), for example a spiral retaining ring of the type marketed by Smalley Steel Ring Company under the Spirolox brand, or a garter spring. In such embodiments, the biasing means may be located around the outer surface of the elements 12, to bias the apparatus 10 towards the collapsed condition, as shown in FIGS. 1A through 1D. Although one groove for accommodating a biasing means is illustrated in the figures, in other embodiments, multiple grooves and biasing means may instead be provided.

In certain embodiments, the apparatus 10 includes a wedge member 16, which in this case is an annular ring having a conical surface 18 opposing one side of the ring structure 11. The wedge angle corresponds with the angle of the inclined conical side walls 27 of the elements 12. A corresponding wedge shaped profile (not shown) may optionally be provided on the opposing side of the ring structure 11 to facilitate expansion of the ring elements 12. In other embodiments, this optional additional wedge may instead be substituted with an abutment shoulder.

Operation of the expansion apparatus 10 will now be described in more detail. In the first, collapsed or unexpanded condition, as illustrated in FIG. 1C, the elements 12 are assembled in a ring structure 11, which extends to a first outer diameter. In this configuration, and as illustrated in FIGS. 1B and 1C, the wedge member 16 defines the maximum outer diameter of the apparatus 10 in the first condition. In certain embodiments, the elements 12 are biased towards the unexpanded condition by a spiral retaining ring (not shown), and are supported on the inner surface by the outer surface of the cylinder 14.

In use, an axial actuation force is imparted on the wedge member 16. Any of a number of suitable means known in the art may be used for application of the axial actuation force, for example, the application of a force from an outer sleeve positioned around the cylinder 14. The force causes the wedge member 16 to move axially with respect to the cylinder 14, and to transfer a component of the axial force onto the recessed side wall of the elements 12. The angle of the wedge transfers a radial force component to the elements 12, which causes them to slide with respect to one another along their respective contact surfaces 22, 23.

The movement of the expanding elements 12 is tangential to a circle defined about the longitudinal axis of the apparatus 10. The contact surfaces 22, 23 of the elements 12 mutually support one another before, during, and after expansion. The radial position of the elements 12 increases on continued application of the axial actuation force until the elements 12 are located at a desired outer radial position. This radial position may be defined by a controlled and limited axial displacement of the wedge member, or alternatively may be determined by an inner surface of a bore or tubular within which the apparatus 10 is disposed.

FIGS. 2A through 2D show the apparatus 10 in its expanded condition. At an optimal expansion condition, shown in FIGS. 2B and 2D, the outer surfaces of the individual elements 12 combine to form a complete circle with no gaps in between the individual elements 12. The outer surface of the expansion apparatus 10 may be optimized for a specific diameter, to form a perfectly round expanded ring (within manufacturing tolerances) with no extrusion gaps on the inner or outer surfaces of the ring structure 11. The design of the expansion apparatus 10 also has the benefit that a degree of under expansion or over expansion (for example, to a slightly different radial position) does not introduce significantly large gaps.

It is a feature of the described embodiments that the elements 12 are mutually supported before, throughout, and after the expansion, and do not create gaps between the individual elements 12 during expansion or at the fully expanded position. In addition, the arrangement of elements 12 in a circumferential ring, and their movement in a plane perpendicular to the longitudinal axis, facilitates the provision of smooth side faces or flanks on the expanded ring structure 11. Furthermore, with deployment of the elements 12 in the plane of the ring structure 11, the overall width of the ring structure 11 does not change. This enables use of the apparatus 10 in close axial proximity to other functional elements.

The apparatus 10 has a range of applications, some of which are illustrated in the following example embodiments. However, additional applications of the apparatus 10 are possible, which exploit its ability to effectively perform one or more of blocking or sealing an annular path; contacting an auxiliary surface; gripping or anchoring against an auxiliary surface; locating or engaging with radially spaced profiles; and/or supporting a radially spaced component. The embodiments presented herein extend the principles described above to expanding apparatus 10 that include combinations of structural elements, ring elements, and combinations thereof, which have particular applications and advantages to systems in which an increased expansion ratio is desirable.

Figure 5A:
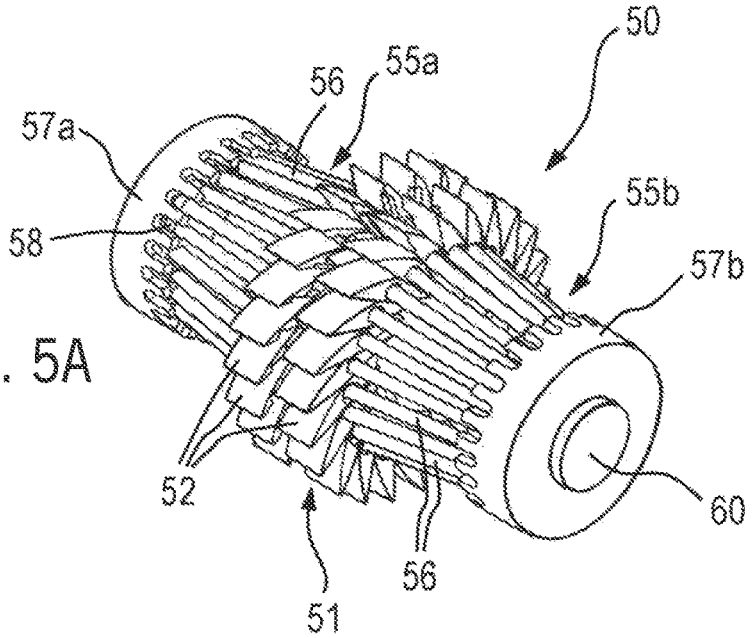
FIGS. 5A through 5C are respective isometric, side and end views of an apparatus in a collapsed condition, in accordance with embodiments of the present disclosure.
Figure 5B:
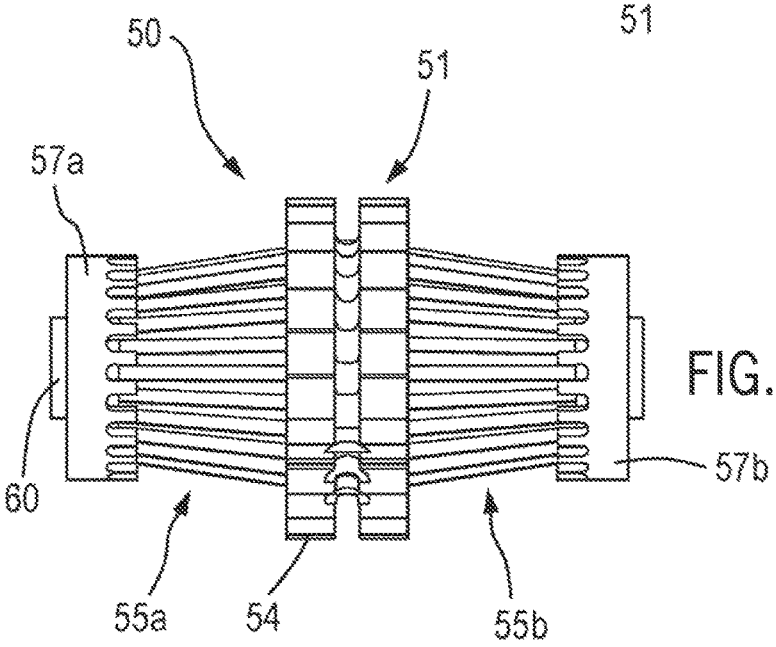
Figure 5C:
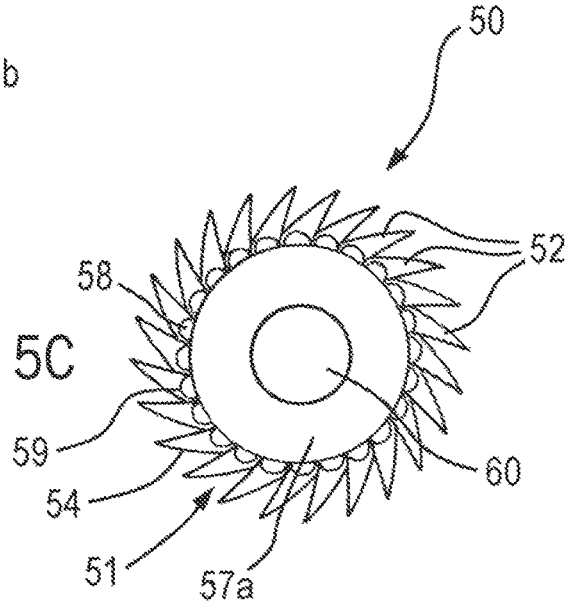
Figure 6A:
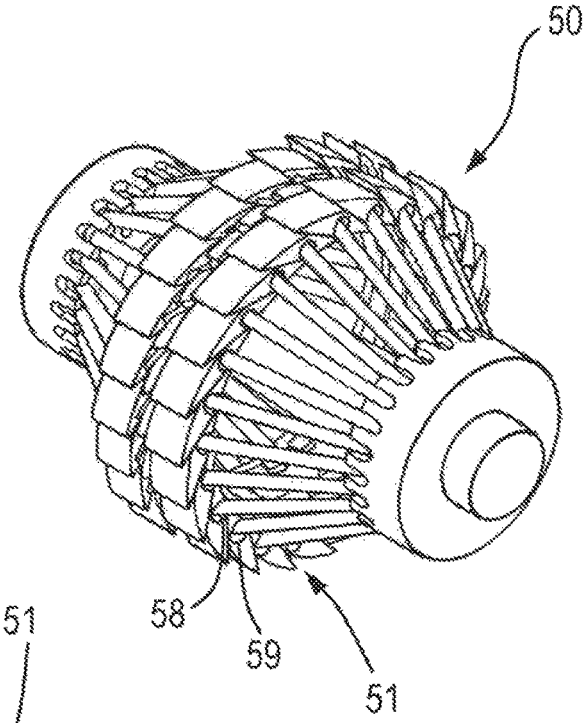
FIGS. 6A through 6C are respective isometric, side and end views of the apparatus of FIGS. 5A through 5C in a partially expanded condition, in accordance with embodiments of the present disclosure.
Figure 6B:
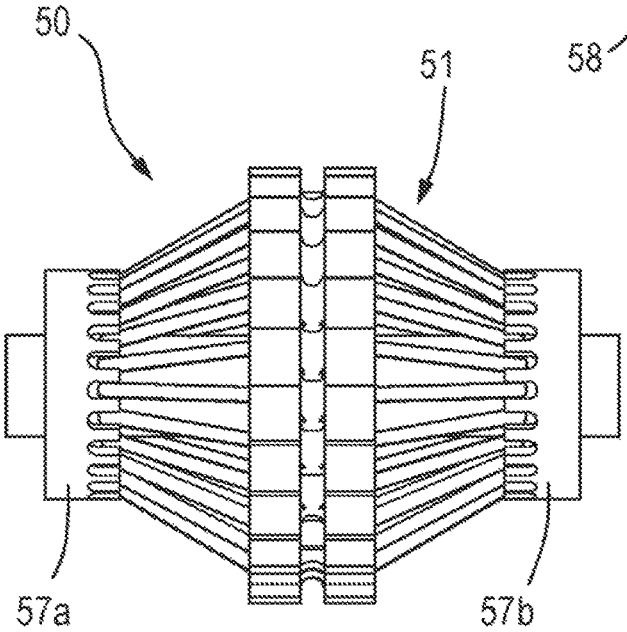
Figure 6C:
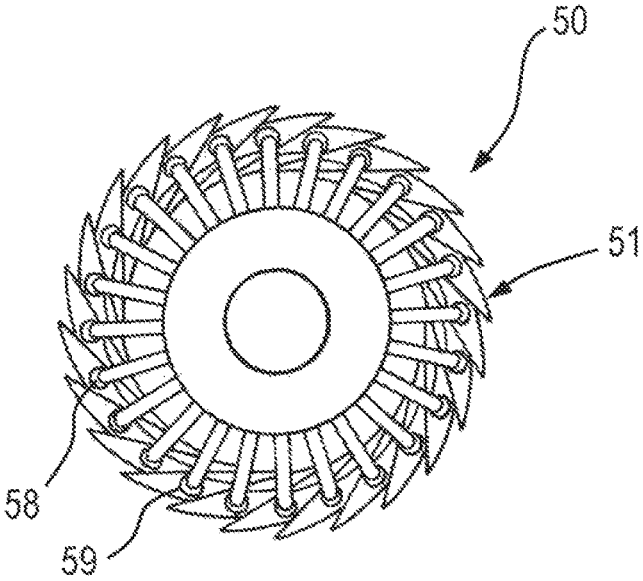
Figure 7A:
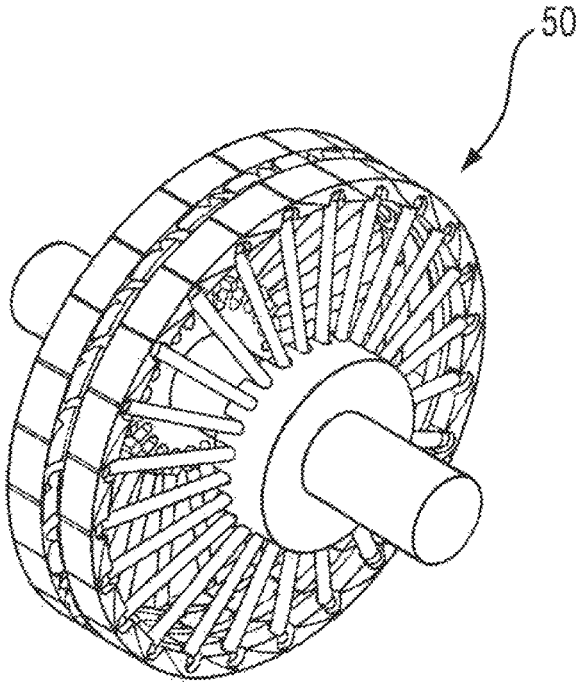
FIGS. 7A through 7C are respectively isometric side and end views of the apparatus of FIGS. 5A through 5C in a fully expanded condition, in accordance with embodiments of the present disclosure.
Figure 7B:
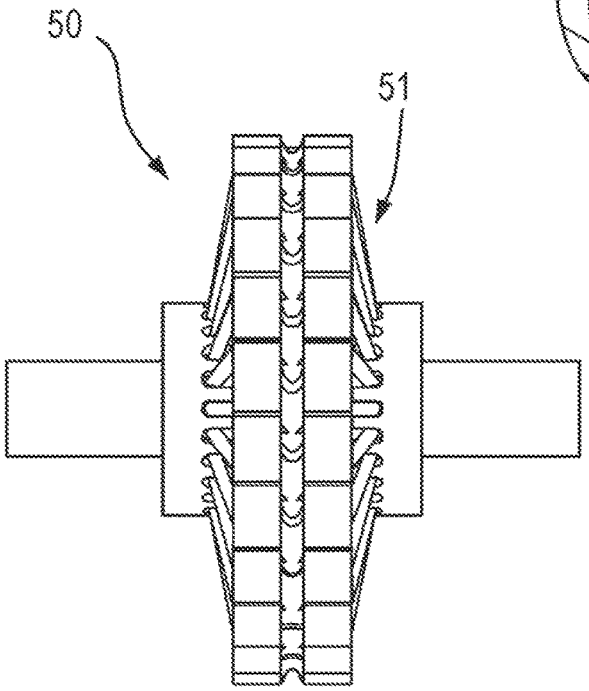
Figure 7C:
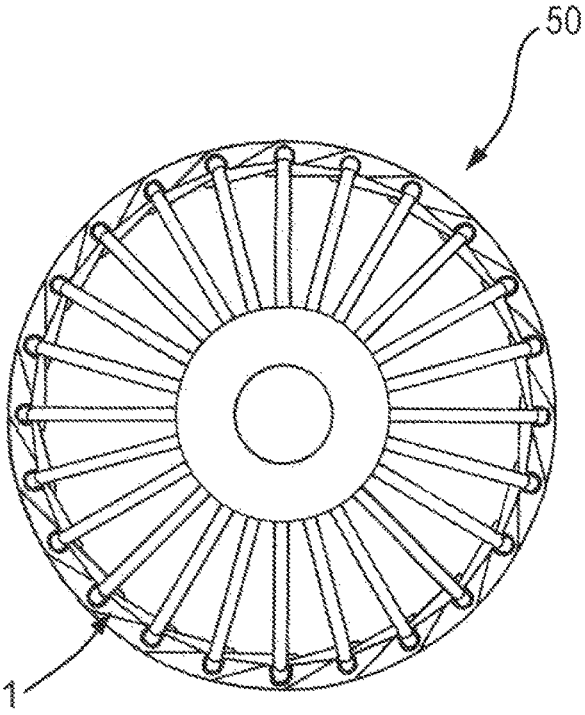
Figure 8:
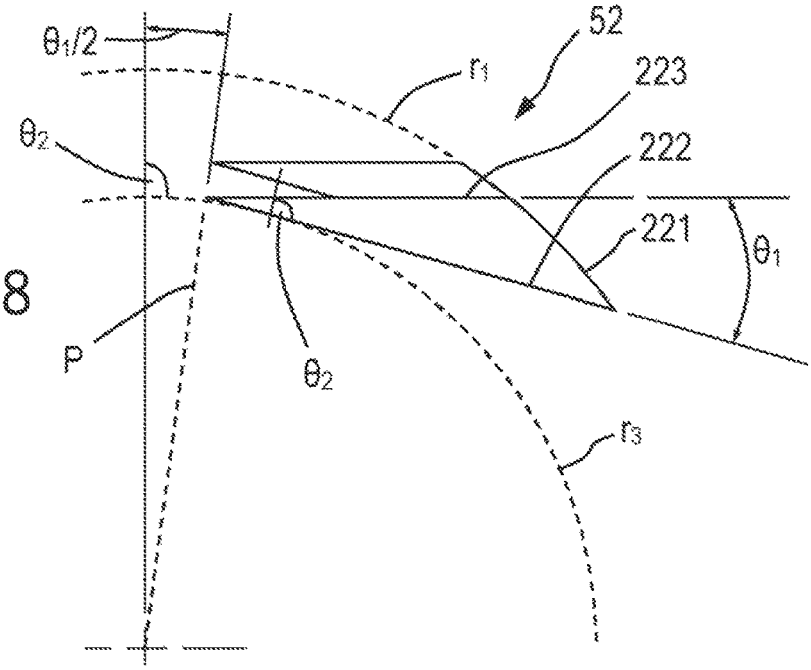
FIG. 8 is a geometric representation of an element of the apparatus of FIGS. 5A through 5C, shown from one side, in accordance with embodiments of the present disclosure.
Figure 9A:
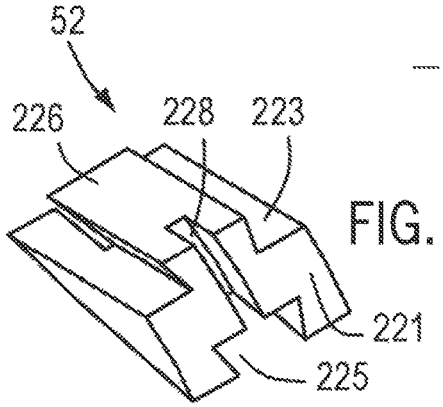
FIGS. 9A through 9F are respective first perspective, second perspective, plan, first end, lower, and second end views of an element of the apparatus of FIGS. 5A through 5C, in accordance with embodiments of the present disclosure.
Figure 9D:
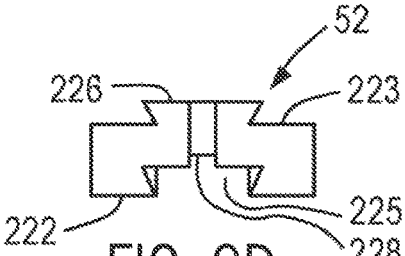
Figure 9B:
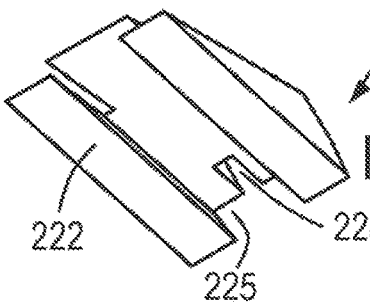
Figure 9E:
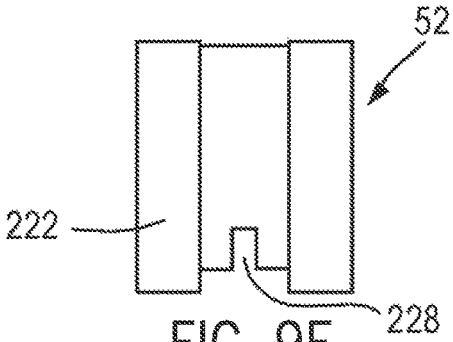
Figure 9C:
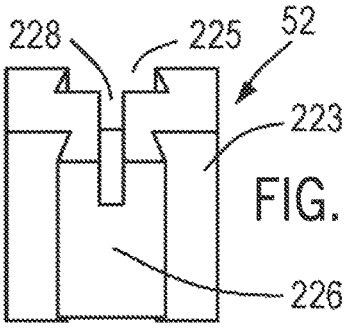
Figure 9F:
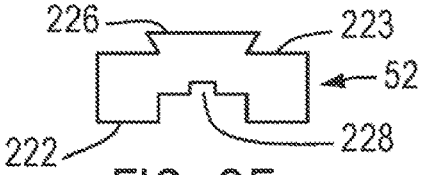

Referring now to FIGS. 5A through 7C, there is shown an expansion apparatus 50 in accordance with certain embodiments of the present disclosure. FIGS. 5A through 5C are respective isometric, side and end views of the apparatus 50 shown in a collapsed condition on a central mandrel 60. FIGS. 6A through 6C are corresponding views of the apparatus 50 in a partially expanded condition, and FIGS. 7A through 7C are corresponding views of the apparatus 50 in a fully expanded condition.

As illustrated, in certain embodiments, the apparatus 50 includes an expansion assembly 51 formed from a plurality of elements, including a set of ring elements 52 assembled together to form a centrally disposed ring structure 54, and two sets 55*a*, 55*b* of structural elements 56. The ring elements 52 are similar to the elements 12 described above, and their form and function will be understood from FIGS. TA through 4F and their accompanying description. The ring elements 52 are shown in more detail in FIGS. 8 and 9A through 9F, and include inner and outer surfaces, first and second contact surfaces, interlocking profiles, and a groove for retaining a circumferential spring, which features are equivalent in form and function to the features of the elements 12 described above. In certain embodiments, a biasing means in the form of a circumferential spring (not shown) retains the center ring structure in its collapsed condition shown in FIGS. 5A through 5C.

The geometry of the individual ring elements 52 differs from the geometry of the ring elements 12 described above in that the ring elements 52 are based on a notional wedge-shaped segment, which is unmodified (save for the provision of functional formations such as for interlocking and/or retention of the elements) and without the removal of material from the tip of the notional wedge-shaped segments. These embodiments may be particularly desirable when there is no requirement for the ring structure to have a circular inner surface, as is the case with the "floating" ring structure of the apparatus 50.

As illustrated in FIGS. 8 and 9A through 9F, in certain embodiments, each element includes an outer surface 221 and first and second contact surfaces 222, 223. The first and second contact surfaces 222, 223 are oriented in non-parallel planes, which are tangential to a circle centered on the longitudinal axis of the apparatus 50 with radius $r_3$. The inner surface of the ring structure is defined at $r_3$ and, therefore, the orientation planes are fully tangential (and angle $\theta_2$ is approximately 90 degrees). The planes converge towards the inner surface of the ring element 52 to an intersection line on a radial plane P that bisects the radial planes at the tangent points (i.e., is at an angle of $\theta_1/2$ to both). This intersection plane P defines the expanding and collapsing path of the segment. Therefore, each ring element 52 is in the general form of a wedge, and the wedges are assembled together in a circumferentially overlapping fashion to form the ring structure 54. In use, the first and second contact surfaces 222, 223 of adjacent ring elements 52 are mutually supportive. In the illustrated embodiment, the ring structure 54 is formed from twenty-four identical ring elements 52, and the angle described between the first and second contact surfaces 222, 223 of each ring element 52 is approximately 15 degrees, so that the ring elements 52 are arranged rotationally symmetrically in the ring structure 54.

As illustrated in FIGS. 9A through 9F, in certain embodiments, the first and second contact surfaces 222, 223 of the ring element 52 may have corresponding interlocking profiles 224 formed therein, such that adjacent ring elements 52 may interlock with one another. In certain embodiments, the interlocking profiles 224 include a dovetail groove 225 and a corresponding dovetail tongue 226. The interlocking profiles 224 resist circumferential and/or radial separation of the ring elements 52 in the ring structure 54, but permit relative sliding motion between adjacent ring elements 52. The interlocking profiles 224 also facilitate smooth and uniform expansion and contraction of the ring elements 52 during use. The ring elements 52 differ from the elements 12 described above in that the tongue and groove are inverted, with the tongue of the ring element 52 on the (longer) contact surface 223. This facilitates increased contact between adjacent ring elements 52 throughout the expanding and contracted range. It will be appreciated that alternative forms of interlocking profiles 224, for example, including recesses and protrusions of other shapes and forms, may be used within the scope of the present embodiments.

In certain embodiments, each element may also be provided with a groove 228, and in the assembled ring structure 54, the grooves 228 may be aligned to provide a circular groove, which extends around the ring and may accommodate a biasing element (not shown), for example, a spiral retaining ring of the type marketed by Smalley Steel Ring Company under the Spirolox brand, or a garter spring. As such, the biasing means may be located around the outer surface of the ring elements 52, to bias the apparatus 50 towards the collapsed condition illustrated in FIGS. 5A through 5D. Although one groove 228 for accommodating a biasing means is provided in the illustrated embodiment, in other embodiments, multiple grooves and biasing means may be provided.

In certain embodiments, the structural elements 56 may be in the form of spokes or struts. First ends of each of the spokes 56 are connected to a respective retaining ring 57*a*, 57*b*, which each act as a base element. Each ring element 52 is connected to a pair of spokes 56, one from each of the respective sets 55*a*, 55*b*, at their second ends. In certain embodiments, the first and second ends are provided with balls or knuckles 58, which are received in respective sockets 59 (not shown in FIG. 8 or 9A through 9F for clarity of the geometry) in the retaining rings and ring elements 52 to create a pivoting and rotating connection. In a first, collapsed condition, the apparatus 50 has a first outer diameter, which is defined by the outer edges of the ring elements 52.

Operation of the apparatus 50 will now be described with additional reference to FIGS. 6A through 7C. In certain embodiments, the apparatus 50 may be actuated to be radially expanded to a second diameter by an axial actuation force, which acts on one or both of the retaining rings 57*a*, 57*b* to move one or both with respect to the mandrel 60. As such, the retaining rings 57*a*, 57*b* function as pusher rings for the apparatus 50. Any of several suitable means known in the art may be used for application of the axial actuation force, for example, the application of a force from an outer sleeve positioned around the cylinder. The axial actuation force acts through the sets of spokes 56 to impart axial and radial force components onto the ring elements 52. In certain embodiments, the pivot point between the ring elements 52 and the respective spokes 56 is set radially further out from the mandrel 60 than the pivot point between the retaining rings 57*a*, 57*b* and the spokes 56, thus ensuring that any compressive force on the end rings has a radial component to act radially on the ring element 52. Radial expansion of the ring structure 54 is initially resisted by the circumferential spring. When the force of the circumferential spring is overcome, the ring elements 52 of the center ring structure are moved radially outward from the collapsed position, towards the partially expanded condition shown in FIGS. 6A through 6C. As the ring structure 54 moves radially outward, the spokes 56 pivot with respect to the retaining rings 57*a*, 57*b* and the ring elements 52 to create a pair of substantially conical supports for the ring structure 54. The ring elements 52 slide tangentially with respect to one another to expand the center ring structure as the first ends of the spokes 56 are moved towards one another.

As the retaining rings 57*a*, 57*b* and sets of spokes 56 are brought towards the position shown in FIGS. 7A through 7C, the ring elements 52 slide with respect to one another into the radially expanded condition. The radial movement of the ring elements 52 of the outer rings is the same as the movement of the elements 12 described with reference to FIGS. 1A through 4F. For example, the ring elements 52 slide with respect to one another in a tangential direction, while remaining in mutually supportive planar contact. The interlocking arrangement of the ring elements 52 enables the apparatus 50 to move uniformly between the collapsed and expanded condition.

The resulting expanded condition is shown in FIGS. 7A through 7C. The apparatus 50 forms an expanded ring structure 54 that is solid, with no gaps between its ring elements 52, and that has a smooth circular outer surface at its fully expanded condition. The outer diameter of the expanded ring is significantly greater than the outer diameter of the ring structures in their collapsed state, with the increased expansion resulting from the combination of sets of structural elements 56 supporting the ring structure 54. The open structure of the conical support renders this embodiment particularly suitable for applications such as lightweight centralization, swaging applications, removable support structures, and/or adjustable drift tools.

Maintaining the axial force on the retaining rings 57*a*, 57*b* will keep the apparatus in an expanded condition, and a reduction in the axial force to separate the retaining rings 57*a*, 57*b* enables the ring structure 54 and sets of spokes 56 to collapse under the retention forces of the spring element. Collapsing of the apparatus 50 to a collapsed condition is, therefore, achieved by releasing the axial actuation force. Separation of the retaining rings 57*a*, 57*b* collapses the ring structure 54 under the retaining force of its biasing spring, back to the collapsed position shown in FIGS. 5A through 5C.

In addition, the connections between the spokes 56 and the ring elements 52, and the spokes 56 and the retaining rings 57*a*, 57*b* (which in certain embodiments may be ball and socket or knuckle and socket connections) are configured to enable the transfer of a tensile force. This enables a tension to be pulled between the retaining rings 57*a*, 57*b*, the structural elements 56 and the ring elements 52 (or vice versa). This axial interlocking of the spokes 56 and the ring elements 52 ties the components together longitudinally, and enables a tension to be pulled between the elements to retract the apparatus 50 towards or to its collapsed condition. Pulling a tension may facilitate collapsing of the apparatus 50 to its original outer diameter, in conjunction with the action of a biasing spring, or in alternative embodiments, the tensile force may be used to retract the apparatus 50 without the use of a biasing spring. The apparatus 50 may, therefore, be a passive device, with no default condition defined by a biasing means.

The combination of structural elements and the ring structure enables the provision of an expanding and collapsing apparatus 50 having the advantages of an expanded ring structure that is solid, with no gaps between its elements, and a smooth circular outer surface at its fully expanded condition, with increased maximum expansion ratios. The embodiments provide increased maximum expansion ratios with few additional moving parts and little increase in complexity over with the ring structure of FIGS. TA through 4F.

Figure 10A:
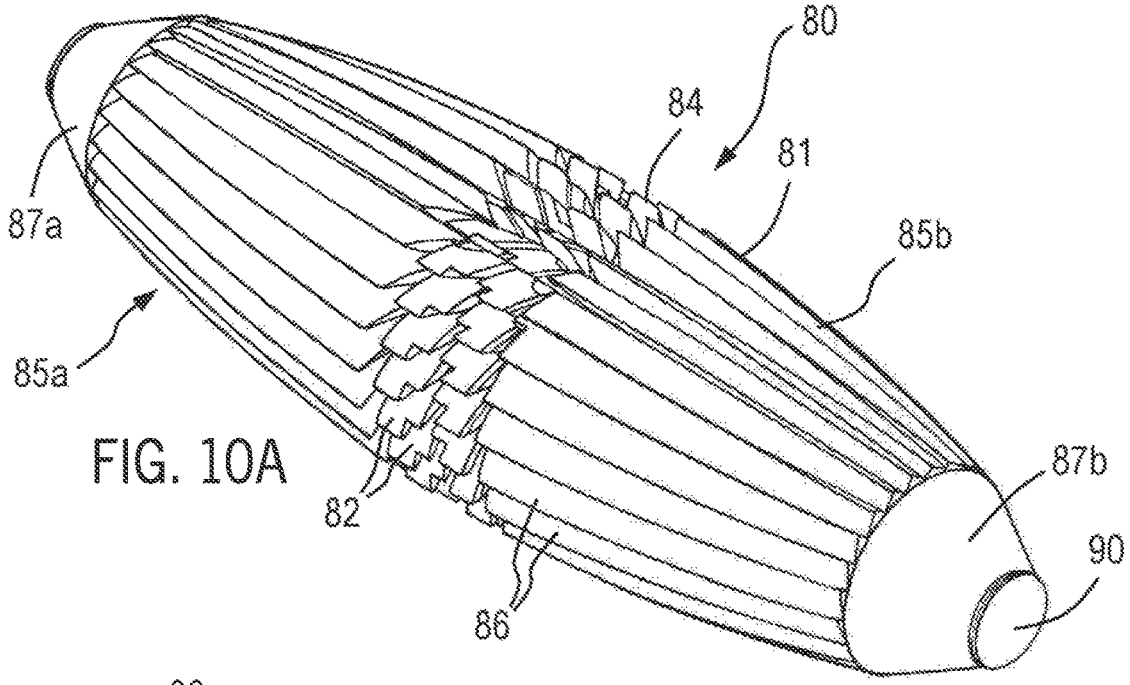
FIGS. 10A and 10B are respective isometric and longitudinal sectional views of an apparatus in a collapsed position, in accordance with embodiments of the present disclosure.
Figure 10B:
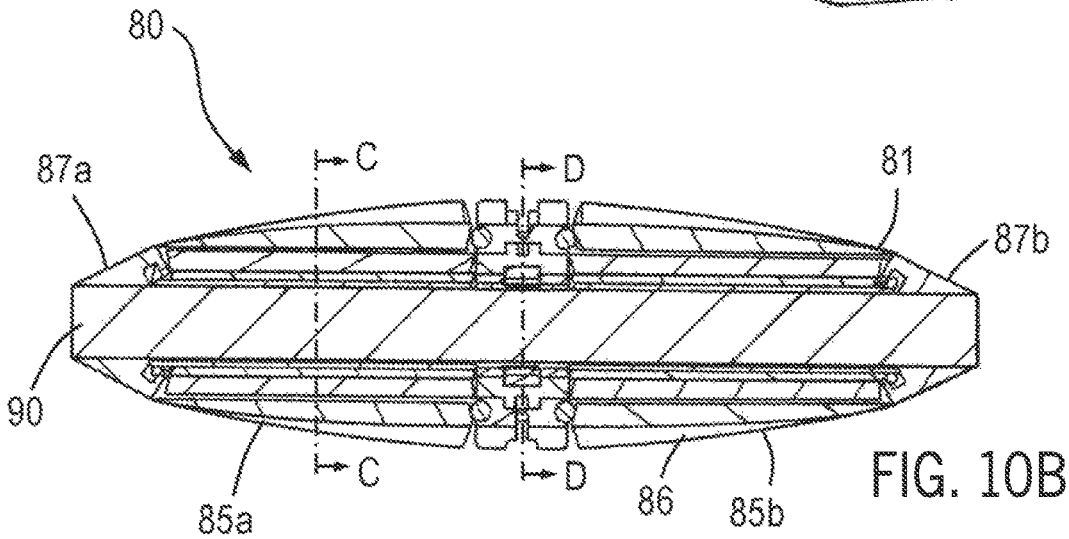
Figure 10C:
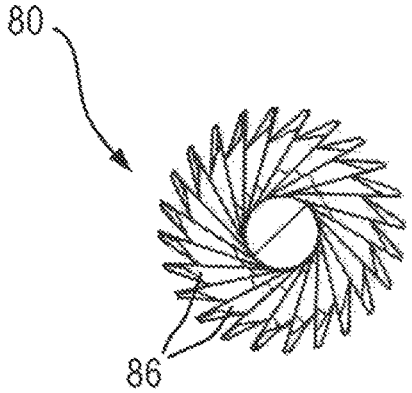
FIGS. 10C and 10D are respective cross-sectional views of the apparatus of FIGS. 10A and 10B through lines C-C and D-D, respectively, in accordance with embodiments of the present disclosure.
Figure 10D:
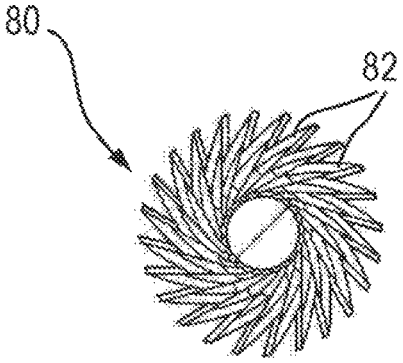
Figure 11A:
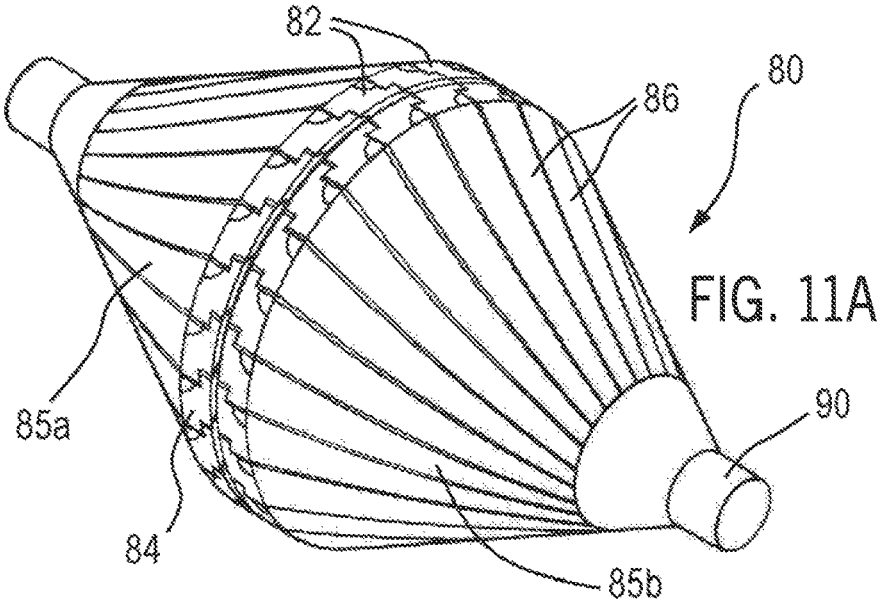
FIGS. 11A and 11B are respective isometric and longitudinal sectional views of the apparatus of FIGS. 10A through 10D in an expanded condition, in accordance with embodiments of the present disclosure.
Figure 11B:
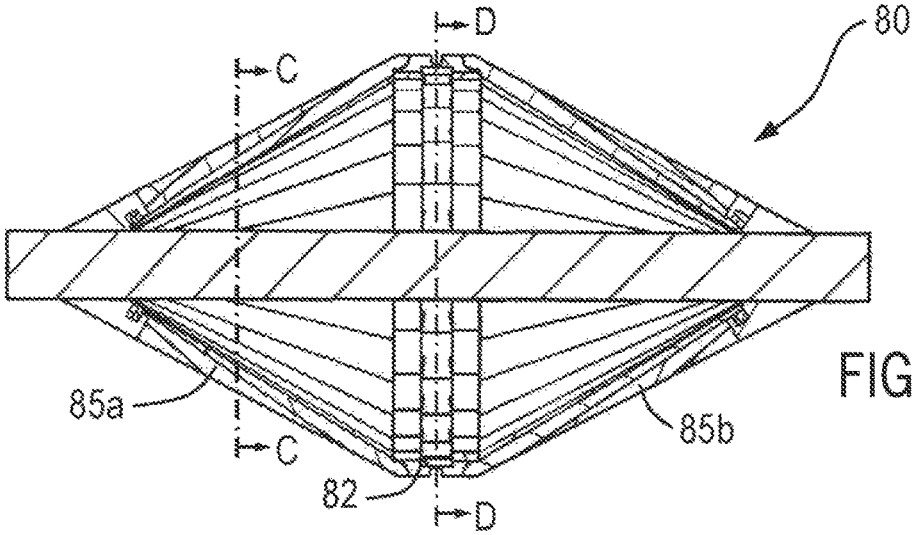
Figure 11C:
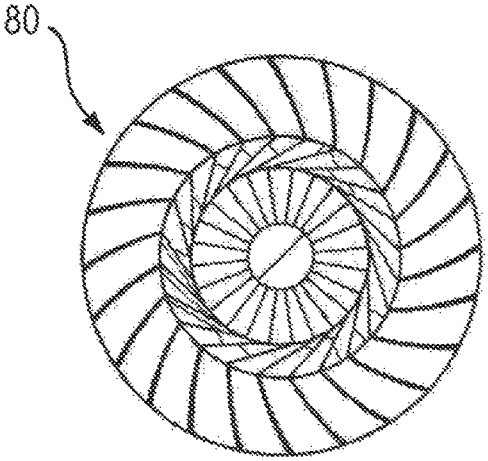
FIGS. 11C and 11D are respective cross-sectional views of the apparatus of FIGS. 11A and 11B through lines C-C and D-D, respectively, in accordance with embodiments of the present disclosure.
Figure 11D:
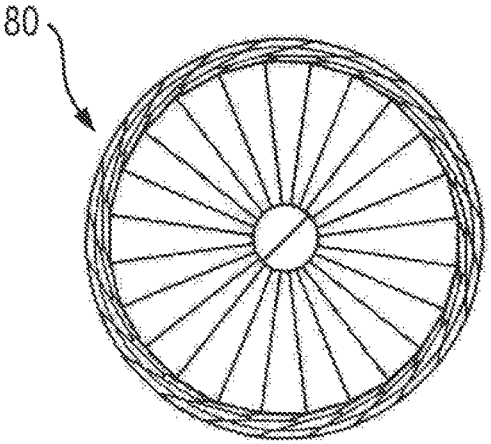

Referring now to FIGS. TOA through 11D, there is shown an expanding and collapsing apparatus 80 according to alternative embodiments. FIGS. 10A and 10B are respective isometric and longitudinal sectional views of the apparatus 80 in a collapsed position, and FIGS. 10C and 10D are respective cross-sectional views of the through lines C-C and D-D of FIG. 10B. FIGS. 11A through 11D are corresponding views of the apparatus 80 in an expanded condition.

Figure 12:
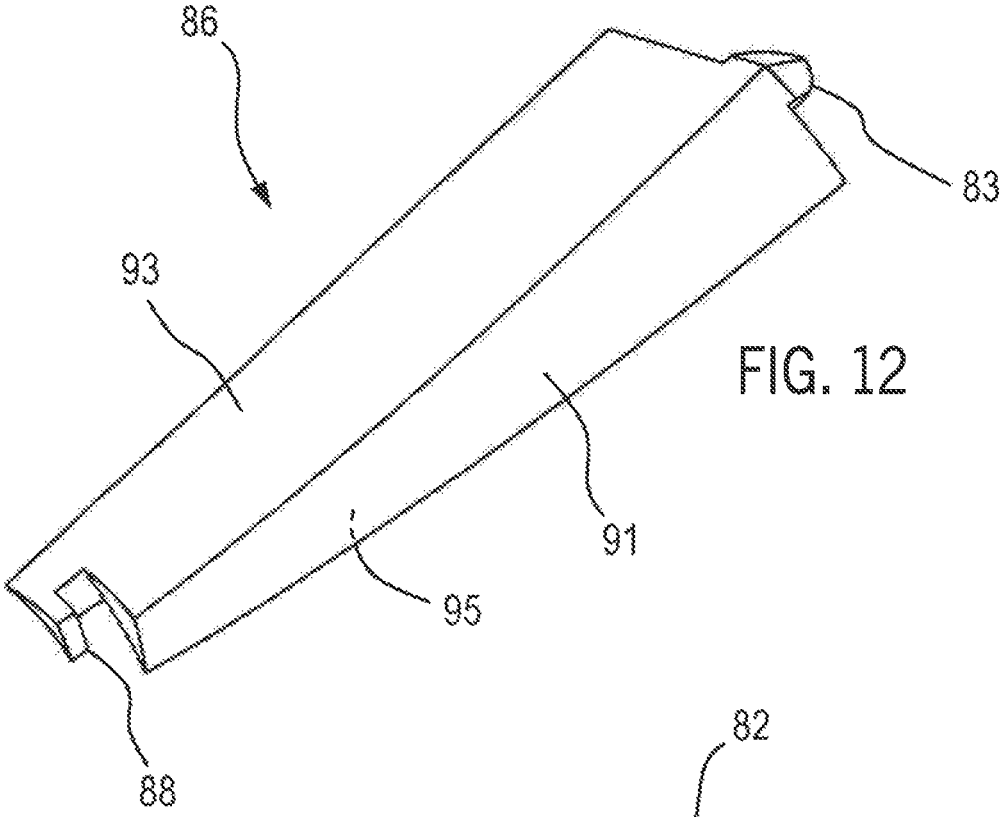
FIG. 12 is an isometric view of a structural element of the apparatus of FIGS. 10A through 10D, in accordance with embodiments of the present disclosure.
Figure 13:
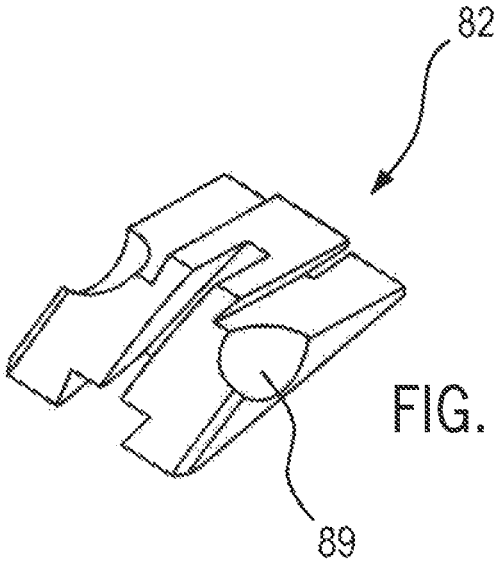
FIG. 13 is an isometric view of a ring element of the apparatus of FIGS. 10A through 10D, in accordance with embodiments of the present disclosure.

The apparatus 80 is substantially similar to the apparatus 50, and will be understood from FIGS. 5A through 9F and the accompanying description. As illustrated, in certain embodiments, the apparatus 80 includes an expansion assembly 81 formed from a plurality of elements, including a set of ring elements 82 assembled to form a centrally disposed ring structure 84. The ring elements 82, as illustrated in FIG. 13, are substantially similar in form and function to the ring elements 52 of the previous embodiments. Two sets 85*a*, 85*b* of structural elements 86 are in the form of cone segments, as illustrated in FIG. 12. The cone segment 86 has an outer surface 91, an upper planar contact surface 93, and a lower planar contact surface 95. As illustrated, in certain embodiments, first ends of each of the cone segments 86 may be connected to a respective retaining ring 87*a*, 87*b* by a hook 88 disposed at the first ends for engaging with an undercut in the retaining ring 87*a*, 87*b*. Each ring element 82 is connected to a pair of segments 86, one from each of the respective sets 85*a*, 85*b*, at the second ends of the segments 86. In certain embodiments, the second ends of the segments 86 are provided with balls or knuckles 83, which are received in respective recesses 89 in the ring elements 82 to create a pivoting and rotating connection. In a first, collapsed condition, the apparatus 80 has a first outer diameter, which is defined by the outer edges of the ring elements 82.

Operation of the apparatus 80 is substantially similar to the operation of the apparatus 50 described above. The apparatus 80 may be actuated to be radially expanded to a second diameter by an axial actuation force, which acts on one or both of the retaining rings 87*a*, 87*b* to move one or both with respect to the mandrel 90. The axial actuation force acts through the sets 85*a*, 85*b* of cone segments 86 to impart axial and radial force components onto the ring elements 82. Radial expansion of the ring structure 84 is initially resisted by the circumferential spring, but when the force of the spring is overcome, the ring elements 82 of the central ring structure 84 are moved radially outward from the collapsed position, towards the expanded condition shown in FIGS. 11A through 11D. As the ring structure 84 moves radially outward, the ring elements 82 pivot with respect to the retaining rings 87*a*, 87*b* and the ring elements 82 to create a pair of conical support structures (e.g., via the cone segments 86) for the ring structure 84. In certain embodiments, each ring element is supported in an A-frame arrangement. The ring elements 82 slide tangentially with respect to one another to expand the center ring structure 84 as the first ends of the cone segments 86 are moved towards one another. In addition, on any selected plane along the length of the cone segment 86 perpendicular to the longitudinal axis (for example section C-C of FIGS. 10C and 10D), the cone segment 86 is moving tangentially to a circle that is in the selected plane and concentric with the longitudinal axis.

Figure 14A:
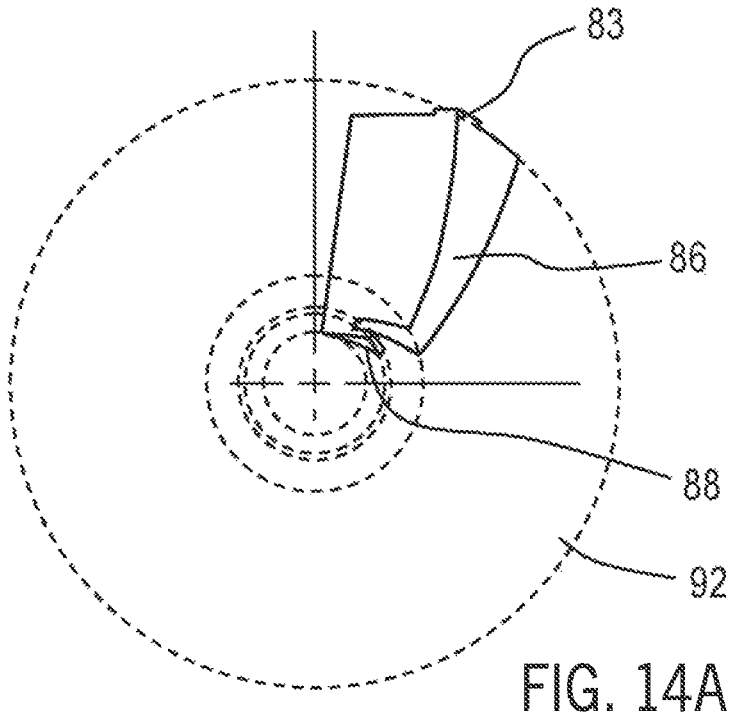
FIGS. 14A and 14B are views of the structural element of FIG. 12 with reference to a virtual cone of which the structural element is a segment, in accordance with embodiments of the present disclosure.
Figure 14B:
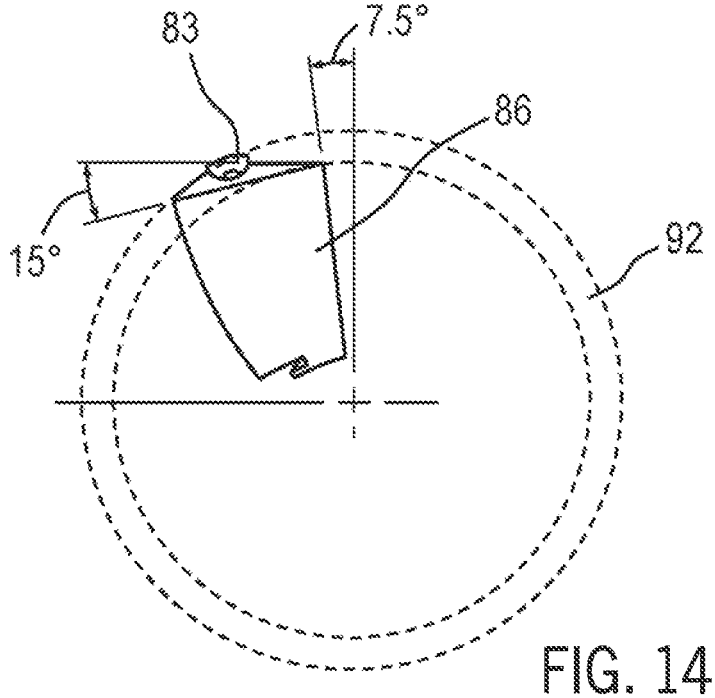
Figure 15A:
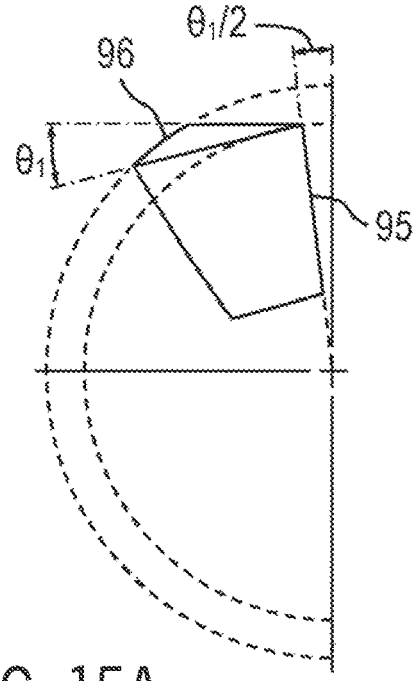
FIGS. 15A through 15C are geometric reference diagrams, useful for understanding how a structural element as described herein may be formed, in accordance with embodiments of the present disclosure.
Figure 15B:
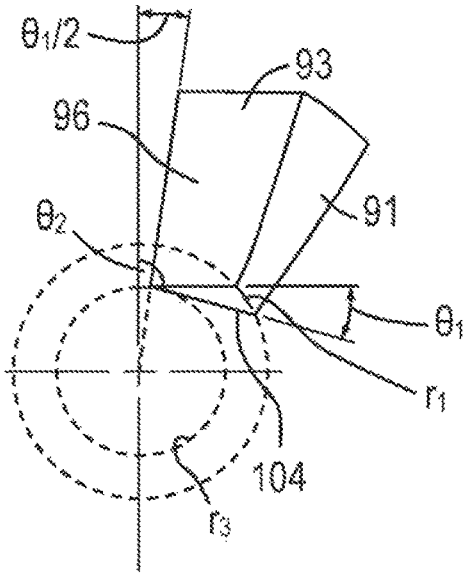
Figure 15C:
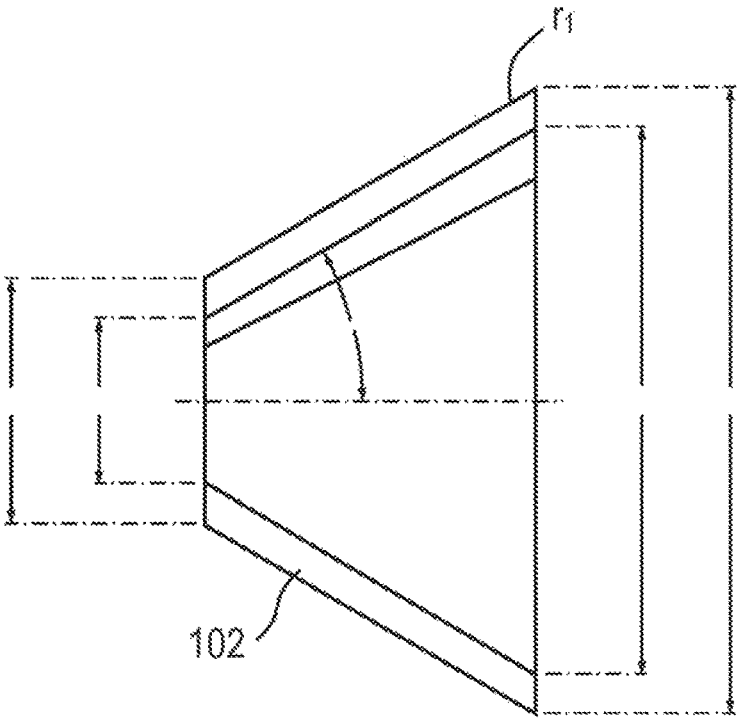

Movement of the cone segments 86 with respect to one another is governed by their shape, and FIGS. 14A, 14B, and 15A through 15C are useful for understanding the manner in which the shape of the cone segments 86 is created in certain embodiments. FIGS. 14A and 14B show the cone segment 86, complete with hook 88 and knuckle 83, as a segment of a hollow cone 92. FIGS. 15A through 15C are geometric reference diagrams, useful for understanding how a simplified cone segment 96 may be formed.

Referring to FIGS. 15A through 15C, the starting point for forming the cone segment 96 is a hollow cone 102 (FIG. 15C), with an internal cone angle, minimum inner diameter and outer diameter, and maximum inner diameter and outer diameter. In certain embodiments, the cone 102 may have any internal and external angle, and need not have a uniform wall thickness (although the example cone 102 does have a uniform wall thickness).

On the small end of the cone 102, as shown in FIG. 15B, the cross-sectional profile of the cone segment 96 is based on a notional wedge-shaped segment of a ring, as described with respect to previous embodiments. The ring is centered on an axis, with the notional wedge-shaped segment being inclined with respect to the radial direction of the ring. The nominal outer diameter of the segment is at the optimum expansion condition of the ring (with radius shown at $r_1$). As with the embodiments illustrated FIGS. 5A through 9F, the orientation planes of upper and lower contact surfaces of the segment element are tangential to a circle centered on the longitudinal axis of the apparatus with radius $r_3$. The inner surface of the ring structure is defined at $r_3$ and, therefore, the orientation planes are fully tangential (and angle $\theta_2$ is approximately 90 degrees). The angle described between the tangent points is equal to the angle $\theta_1$ of the segment. The orientation planes of the first and second contact surfaces of each notional wedge-shaped segment intersect on a radial plane P, which bisects the radial planes at the tangent points (i.e., is at an angle of $\theta_1/2$ to both). This intersection plane P defines the expanding and collapsing path of the segment. In this apparatus, the segment angle $\theta_1$ is approximately 15 degrees, and the radial plane P is inclined to the radial plane at the tangent point by approximately 7.5 degrees.

Having determined the profile 104 of one end of the segment, the internal angle of the inside face of the cone 102 defines the inclined angle of the upper and lower planar surfaces of a formed segment, which extend from the end profile 104. The upper planar surface 93 is defined by a cut through the body of the cone from the upper line of the end profile 104, where the cut remains tangential to the inner surface of the cone throughout the length of the cone. The lower planar surface 95 is defined by a cut through the body of the cone from the lower line of the end profile 104, where the cut remains tangential to the inner surface of the cone throughout the length of the cone. The outer surface 91 of the segment is the outer surface of cone between the upper and lower planar surfaces.

The geometry of a cross-section of the cone segment is the same at each position through the length of the segment: the outer surface 91 is at the nominal outer diameter of the segment at the optimum expansion condition of the ring; the first and second contact surfaces of the cone segment are tangential to the circle at radius $r_3$, and the orientation planes of the first and second contact surfaces intersect on a radial plane P inclined at an angle of $\theta_1/2$ to the radial planes at the tangent points. The same radial plane P can be described as being inclined to the upper contact surface by an angle of $90-\theta_1/2$ degrees and inclined to the lower contact surface by an angle of $90+\theta_1/2$. The principles illustrated in FIGS. 15A through 15C may be used to determine the basic shape of the cone segment, which may then be detailed with additional features such as grooves and undercuts to create the functional cone segment 86.

In use, as the retaining rings 87 and sets 85 of cone segments 86 are brought towards the position shown in FIGS. 11A through 11D, the ring elements 82 and the structural ring elements 86 slide with respect to one another into the radially expanded condition. The radial movement of the elements of the outer rings is substantially similar to the movement of the elements described with reference to FIGS. TA through 4F: the elements 82, 86 slide with respect to one another in a tangential direction, while remaining in mutually supportive planar contact. The centrally positioned ring elements 82 ensure that the outer structural segments 86 remain held in a uniform pattern, equally spaced and evenly deployed. The expansion of the center ring also controls the alignment and the order of the outer structural segments 86.

The resulting expanded condition is shown in FIGS. 11A through 11D. The apparatus 80 may be expanded to an optimal expansion condition, at which the planar surfaces of cone segments 86 are in full contact, and where the outer diameter defined by the ring structure 84 is slightly smaller than the inner diameter of a conduit or borehole within which the apparatus 80 is disposed. Further thrust on the retaining rings 87 causes over-expansion of the ring structure 84, without substantially affecting the surface profile of the conical or cylindrical ring structures.

Maintaining the axial force on the retaining rings 87 may keep the apparatus 80 in an expanded condition, and a reduction in the axial force to separate the retaining rings 87 enables the ring structure 84 and sets 85*a*, 85*b* of spokes to collapse under the retention forces of the spring element. Collapsing of the apparatus 80 to a collapsed condition is, therefore, achieved by releasing the axial actuation force. Separation of the retaining rings 87 collapses the ring structure 84 under the retaining force of its biasing spring, back to the collapsed position shown in FIGS. 10A through 10C.

The combination of structural elements and the ring structure enables the provision of an expanding and collapsing apparatus with increased maximum expansion ratios. The embodiments described herein provide increased maximum expansion ratios with few additional moving parts and little increase in complexity over with the ring structure of FIGS. TA through 4F. The apparatus forms an expanded ring structure that is solid, with no gaps between its elements and has a smooth circular outer surface at its fully expanded condition. In addition, the conical support structures created by the cone segments are formed as solid, smooth flanks of the expanded apparatus. This facilitates use of the conical structures as deployment or actuation devices, or support structures for seal elements and other mechanical structures, as will be described in more detail below.

Figure 16A:
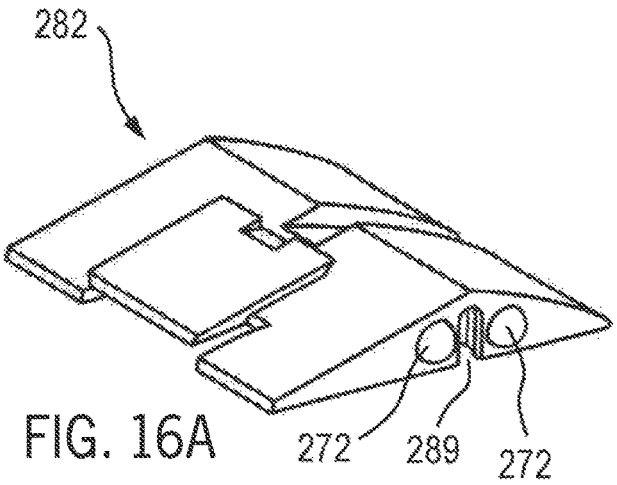
FIGS. 16A through 16C are respective first isometric, lower, and second isometric end views of a ring element of an apparatus, in accordance with embodiments of the present disclosure.
Figure 16B:
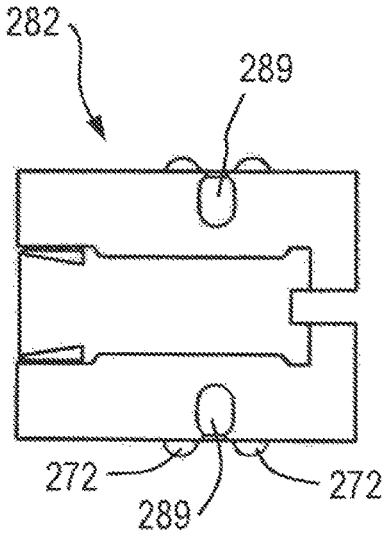
Figure 16C:
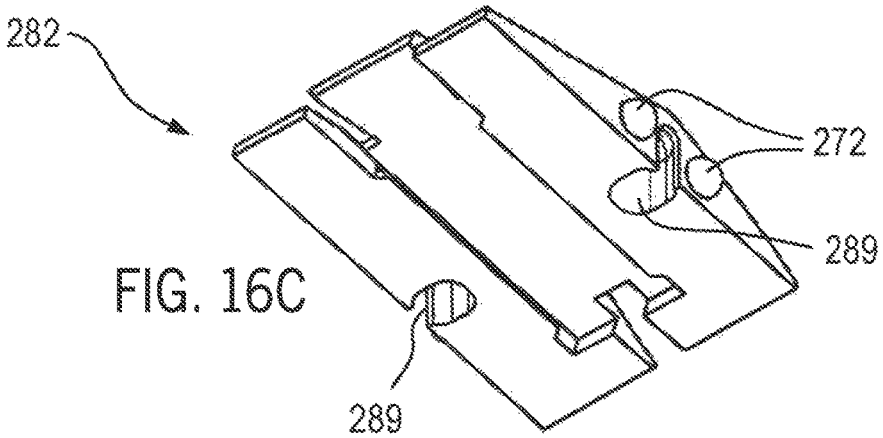
Figure 17A:
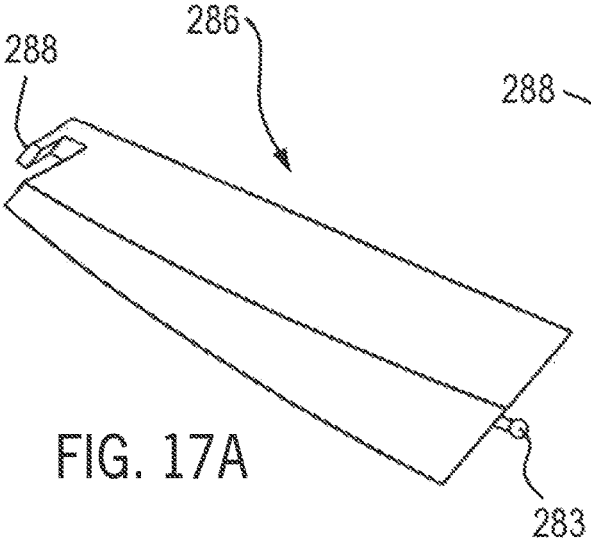
FIGS. 17A and 17B are respective first and second isometric views of a structural element of an apparatus, in accordance with embodiments of the present disclosure.
Figure 17B:
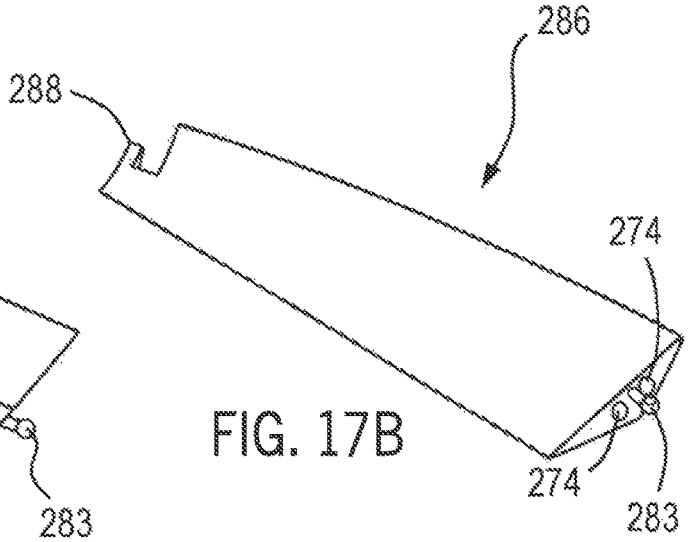
Figure 18A:
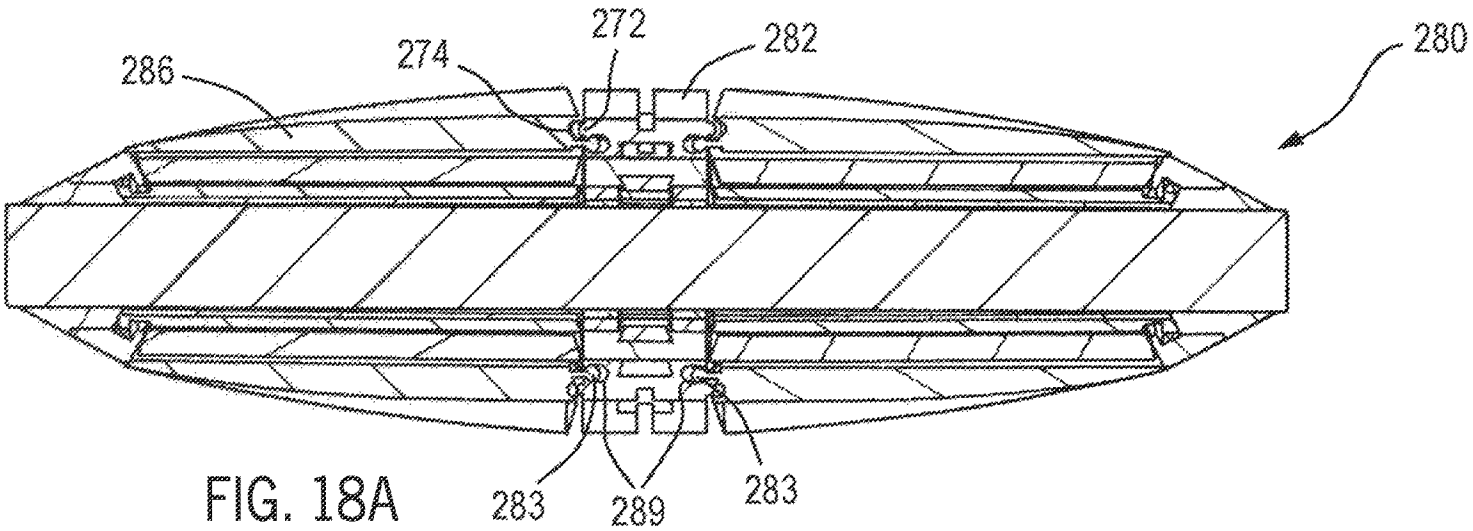
FIGS. 18A and 18B are longitudinal sectional views of an apparatus incorporating the ring element and structural element of FIGS. 16A through 17B in collapsed and expanded conditions, respectively, in accordance with embodiments of the present disclosure.
Figure 18B:
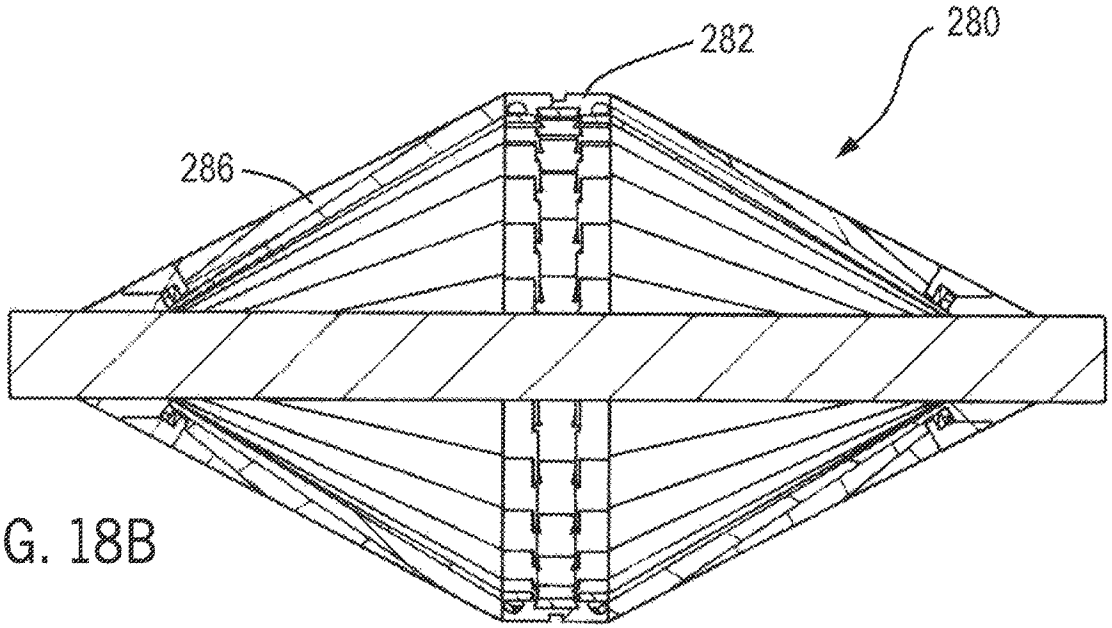

A variation to the apparatus 80 will now be described with reference to FIGS. 16A through 18B. FIGS. 18A and 18B are longitudinal sectional views of an apparatus 280, which is substantially similar to the apparatus 80 described above and will be understood from FIGS. 10A through 15C and the accompanying description. FIGS. 16A through 16C are various views of a ring element 282 of the apparatus 280, and FIGS. 17A and 17B are isometric views of a structural element 286 of the apparatus 280. The basic geometry of the ring element 282 and structural element 286 is substantially similar to the geometry of the elements 82, 86 as previously described. As with the apparatus 80, in certain embodiments, a hook 288 may be provided for engaging with an undercut in a respective retaining ring. However, the elements 282, 286 differ in the configuration of their connection to one another. More specifically, instead of the spherical ball joint and socket provided in components of the apparatus 80, the apparatus 280 has a knuckle joint 283 provided on the structural element 286, and a corresponding socket 289 on the ring element 282. In certain embodiments, the socket 289 includes an opening on the lower contact surface for receiving the knuckle 283, and a U-shaped slot in the side wall, which enables the elements to be assembled while retaining the knuckle 283, and allows a tension to be pulled between the structural element 286 and a respective retaining ring (or vice versa).

In certain embodiments, corresponding side walls of the ring element 282 and the structural element 286 are also provided with a cooperating arrangement of knurls 272 and sockets 274. In such embodiments, the knurls 272 of the ring elements 282 self-locate in the sockets 274 of the structural elements 286 when the apparatus 280 is in its expanded condition, shown in FIG. 18B, and provide additional support to the structure. In the illustrated embodiment, two knurls 272 are provided on each side wall of each ring element 282, with corresponding sockets 274 provided on the contacting side wall of the respective structural element 286, but it will be appreciated that in other embodiments, the position may be reversed, and/or other configurations of locating formations may be provided.

Figure 19A:
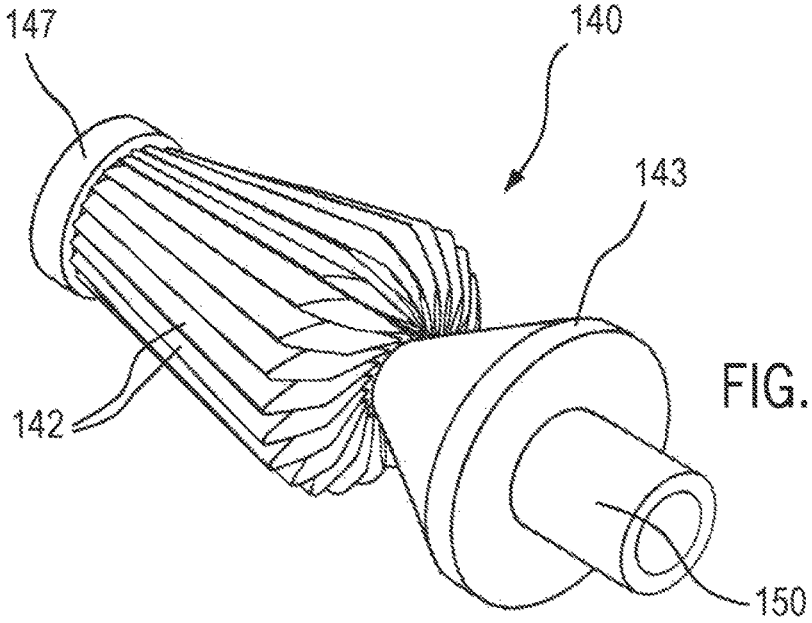
FIGS. 19A through 19C are respective isometric, longitudinal sectional, and end views of an apparatus in a collapsed condition, in accordance with embodiments of the present disclosure.
Figure 19C:
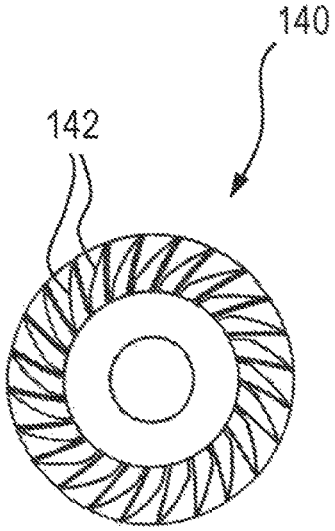
Figure 19B:
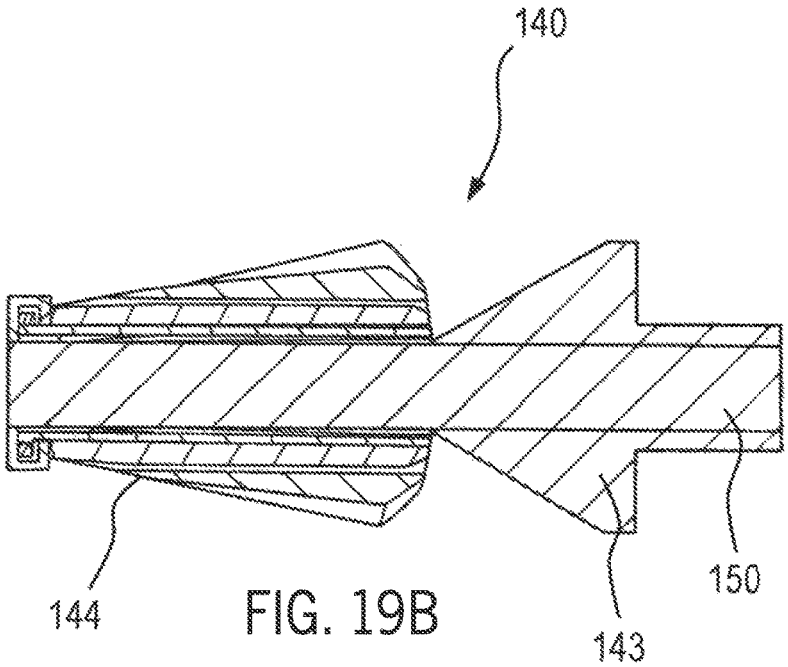
Figure 20A:
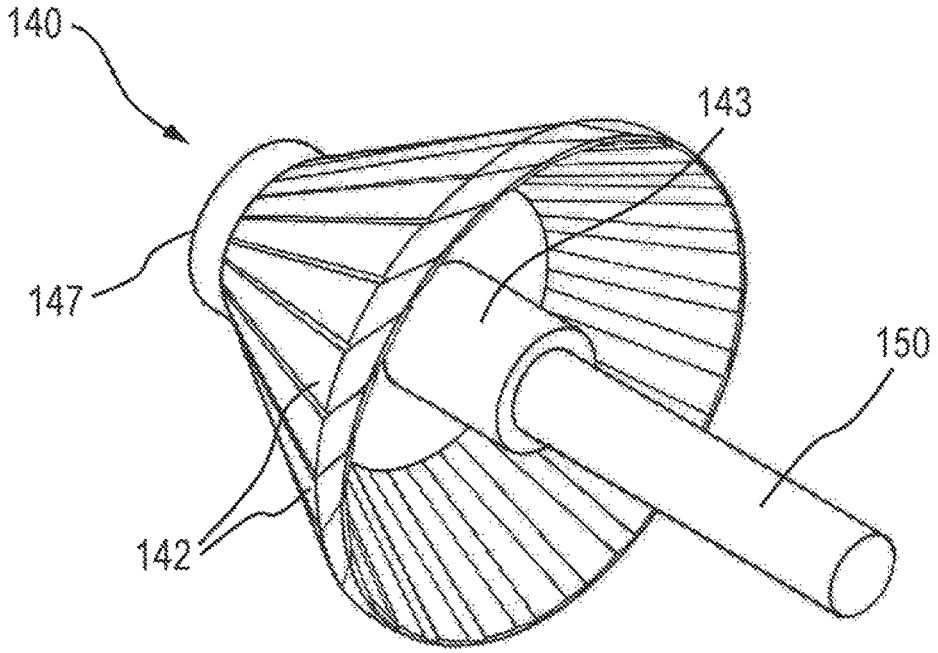
FIGS. 20A through 20C are respective isometric, longitudinal sectional, and end views of the apparatus of FIGS. 19A through 19C in an expanded condition, in accordance with embodiments of the present disclosure.
Figure 20C:
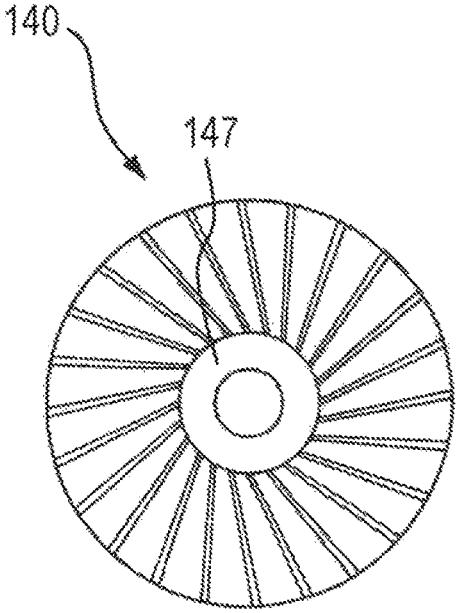
Figure 20B:
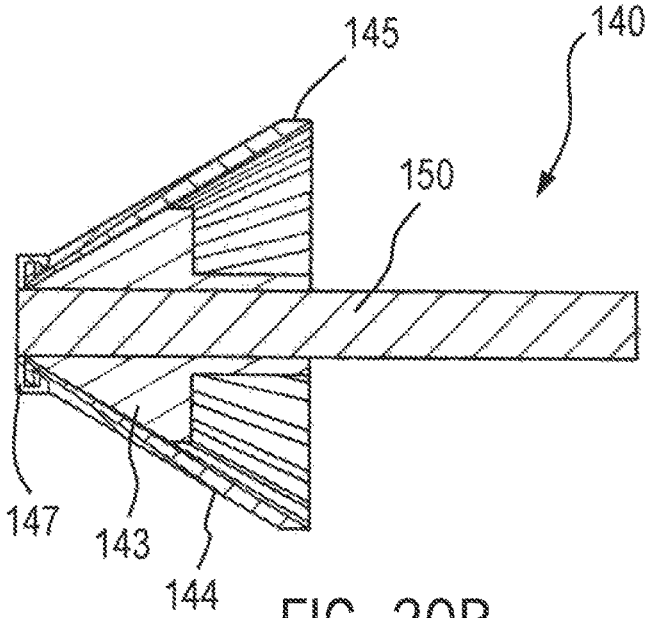

Although the foregoing embodiments include combinations of cylindrical ring structures and conical support assemblies, the principles of the embodiments described herein may also be applied to expanding cone structures without connection to cylindrical rings. For example, certain embodiments are described with reference to FIGS. 19A through 20D. FIGS. 19A through 19C are respective isometric, longitudinal sectional, and end views of an apparatus 140 in a collapsed condition. FIGS. 20A through 20C are corresponding views of the apparatus 140 in an expanded condition. In certain embodiments, the apparatus 140 includes an expansion assembly 141 formed from a plurality of elements, including a set of elements 142 assembled together to form conical ring structure 154. The elements 142 are assembled on a mandrel 150, with first ends of the elements 142 connected to a retaining ring 147. Second ends of the elements 142 are adjacent an actuating wedge cone 143.

The elements 142 are substantially similar to the cone segments 86, and their form and function will be understood from FIGS. 10A through 11D and the accompanying description. The shape of the elements 142 is created by the principles described with reference to FIGS. 14A through 15C. The elements 142 include an outer surface, an upper planar contact surface, and a lower planar contact surface. The contact surfaces are mutually supportive when assembled to form the ring structure. In a first, collapsed condition, the apparatus 140 has a first outer diameter, which is defined by the outer edges of the second ends of the elements 142. The shape of the apparatus 140 in its collapsed condition is substantially conical.

In use, the apparatus 140 may be actuated to be radially expanded to a second diameter by an axial actuation force, which acts on one or both of the retaining ring 147 or a wedge member 143 to move one or both with respect to the mandrel 150. The force causes the wedge member 143 to move axially with respect to the elements 142, and transfer a component of the axial force onto inner surfaces of the elements 142. The angle of the wedge member 143 transfers a radial force component to the elements 142, which causes them to slide with respect to one another along their respective contact surfaces.

The movement of the expanding elements 142 is tangential to a circle defined about the longitudinal axis of the apparatus 140. The contact surfaces of the elements 142 mutually support one another before, during, and after expansion. The radial position of the elements 142 increases on continued application of the axial actuation force until the elements 142 are located at a desired outer radial position. This radial position may be defined by a controlled and limited axial displacement of the wedge member 143 or, alternatively, may be determined by an inner surface of a bore or tubular within which the apparatus 140 is disposed.

FIGS. 20A through 20C show the apparatus 140 in its expanded condition. At an optimal expansion condition, shown in FIGS. 20B and 20C, the outer surfaces of the individual elements 142 combine to form a complete conical surface with no gaps in between the individual elements 142. At the second end of the elements 142, a cylindrical surface 145 is formed at the optimal expanded condition. The outer surfaces of the individual elements 142 combine to form a complete circle with no gaps in between the individual elements. The outer surface of the expansion apparatus may be optimized for a specific diameter, to form a perfectly smooth cone and round expanded ring (within manufacturing tolerances) with no extrusion gaps on the inner or outer surfaces of the ring structure. The design of the expansion apparatus 140 also has the benefit that a degree of under expansion or over expansion (for example, to a slightly different radial position) does not introduce significantly large gaps.

It is a feature of the described arrangement that the elements are mutually supported before, throughout, and after the expansion, and do not create gaps between the individual elements during expansion or at the fully expanded position. In addition, the arrangement of elements in a circumferential ring, and their movement in a plane perpendicular to the longitudinal axis, facilitates the provision of smooth side faces or flanks on the expanded ring structure. This enables use of the apparatus in close axial proximity to other functional elements.

Figure 21A:
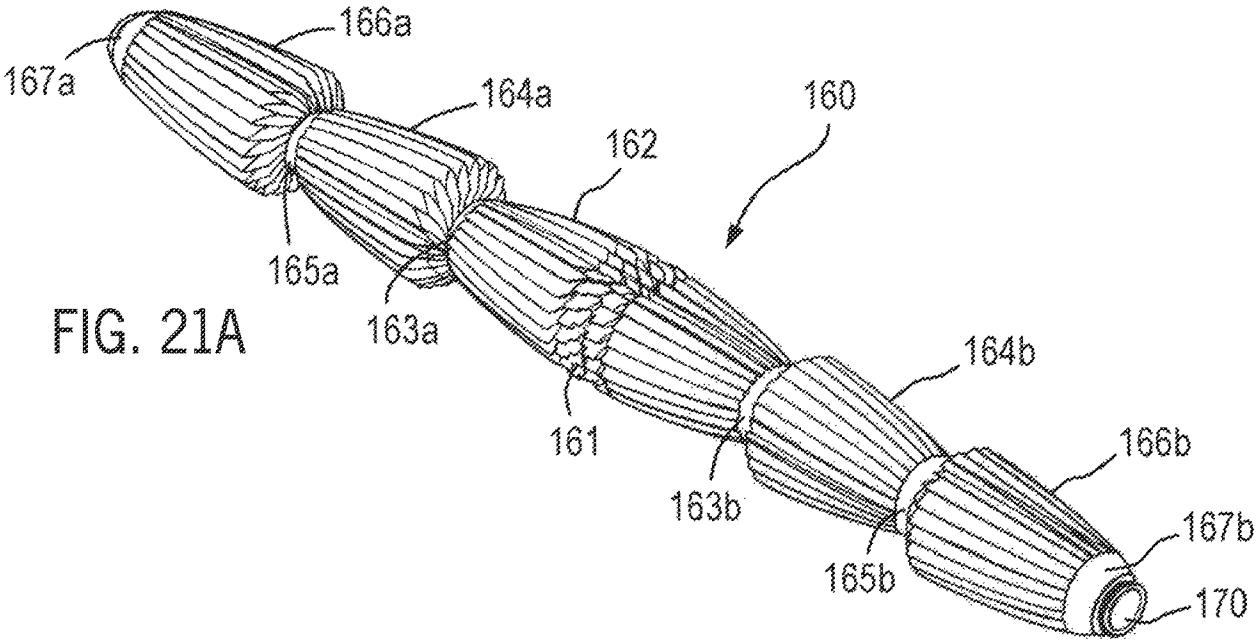
FIGS. 21A through 21C are respective isometric, longitudinal sectional and cross-sectional views of an apparatus in a collapsed condition, in accordance with embodiments of the present disclosure.
Figure 21B:
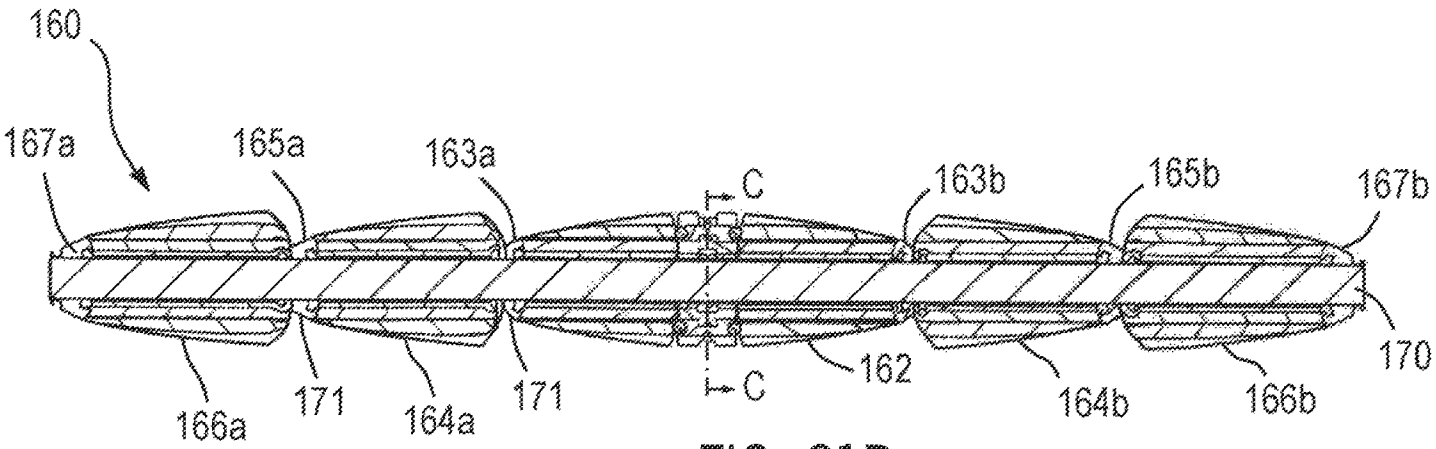
Figure 21C:
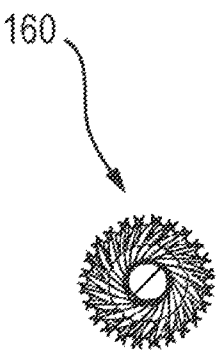
Figure 22A:
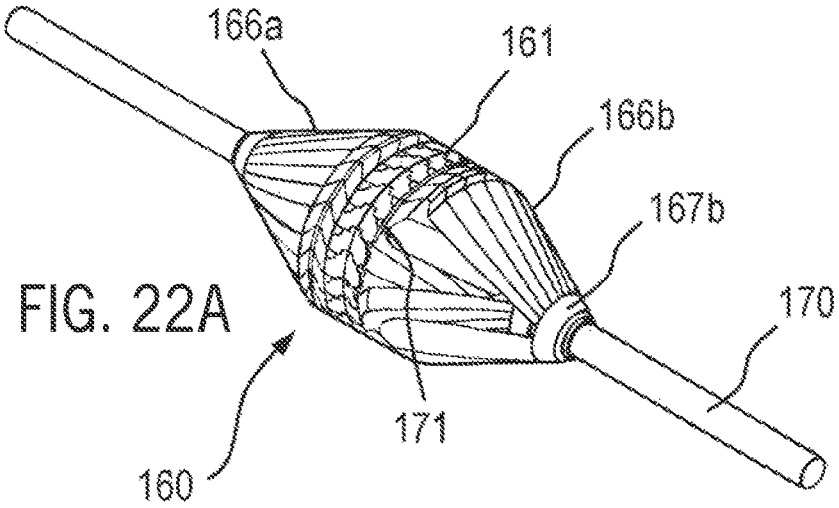
FIGS. 22A and 22B are respective partially cut away isometric and longitudinal sectional views of the apparatus of FIGS. 21A through 21C in an expanded condition, in accordance with embodiments of the present disclosure.
Figure 22B:
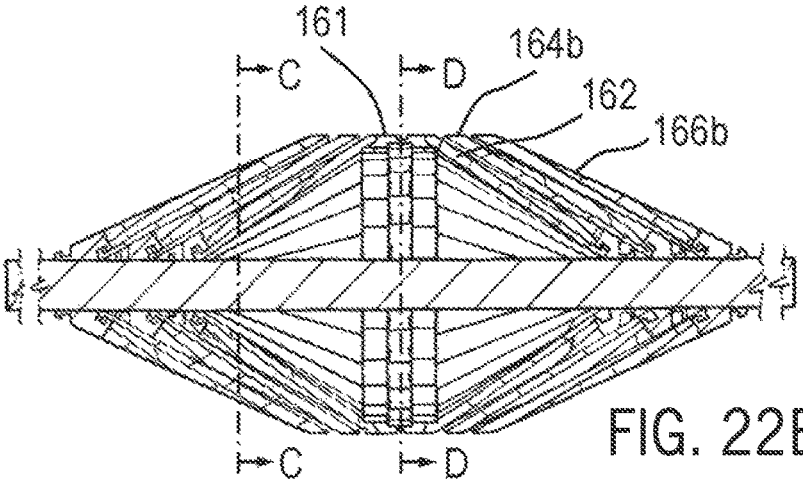
Figure 22C:
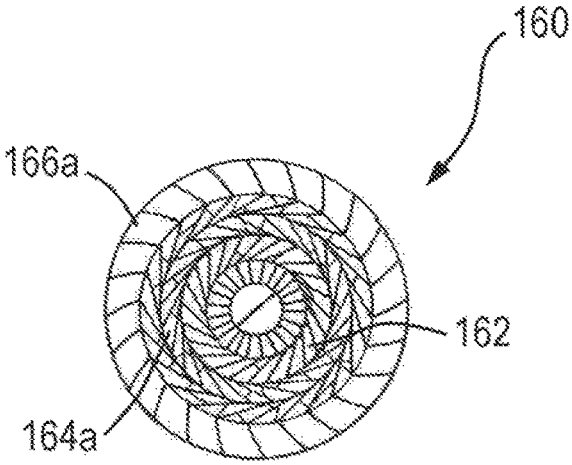
FIGS. 22C and 22D are respective cross-sectional views of the apparatus of FIGS. 22A and 22B through lines C-C and D-D, in accordance with embodiments of the present disclosure.
Figure 22D:
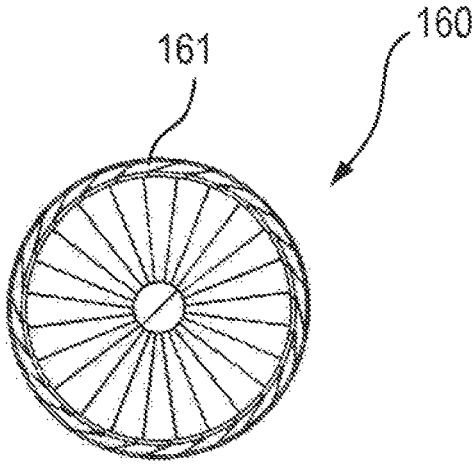
Figure 23A:
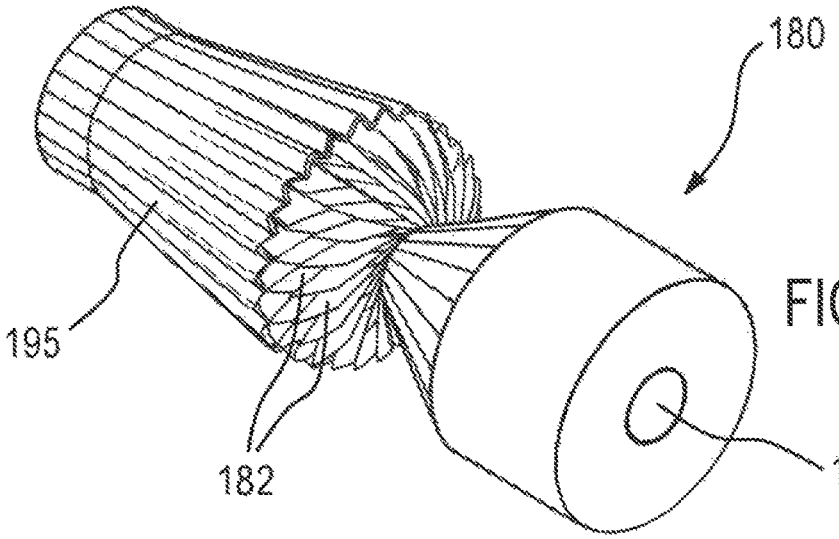
FIGS. 23A through 23C are respective isometric, longitudinal sectional, and end views of a seal apparatus in a collapsed condition, in accordance with embodiments of the present disclosure.
Figure 23B:
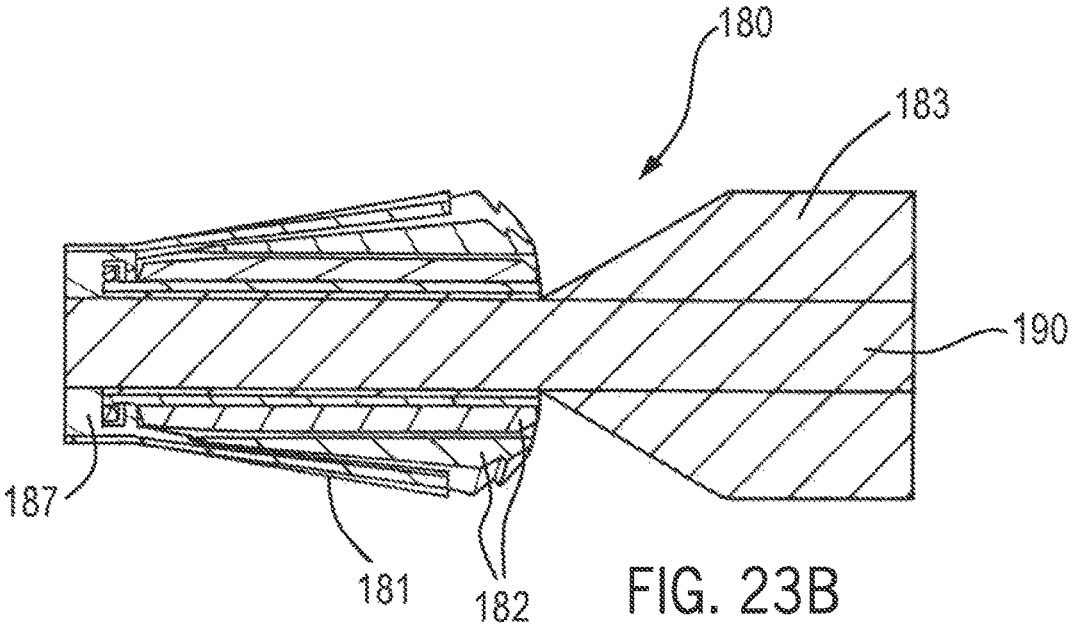
Figure 23C:
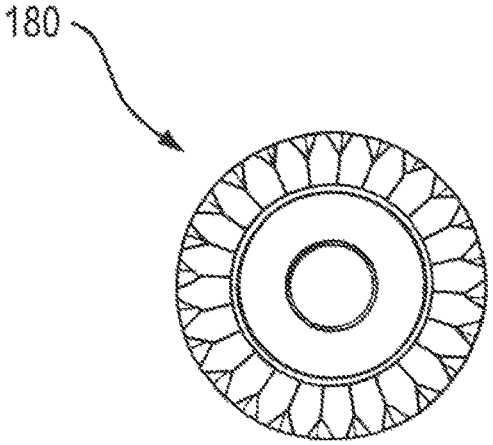
Figure 24A:
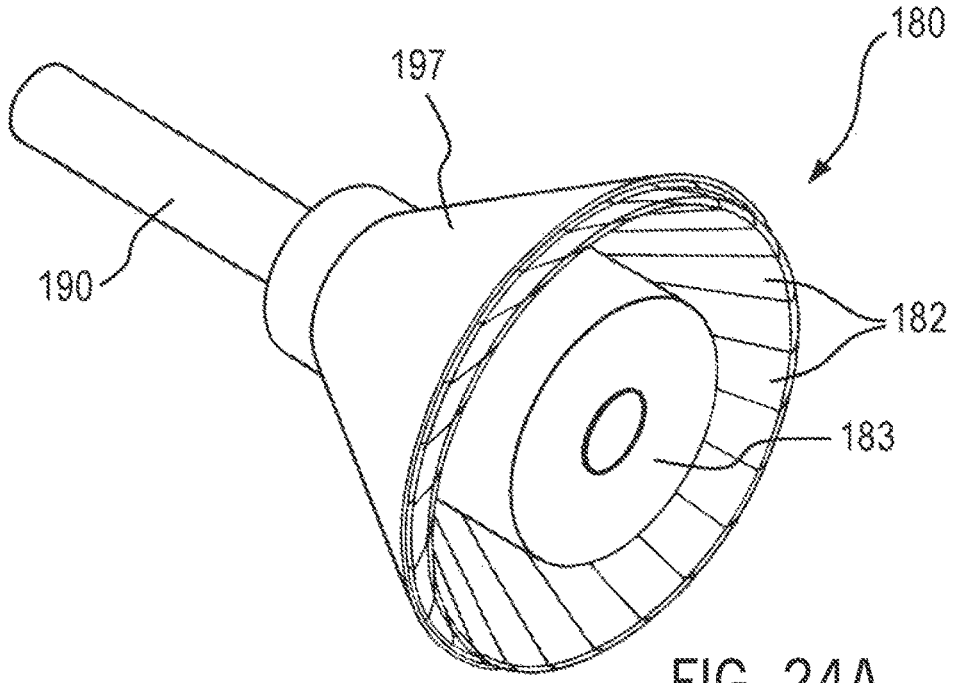
FIGS. 24A through 24C are respective isometric, longitudinal sectional, and end views of the apparatus of FIGS. 22A through 22C in an expanded condition, in accordance with embodiments of the present disclosure.
Figure 24B:
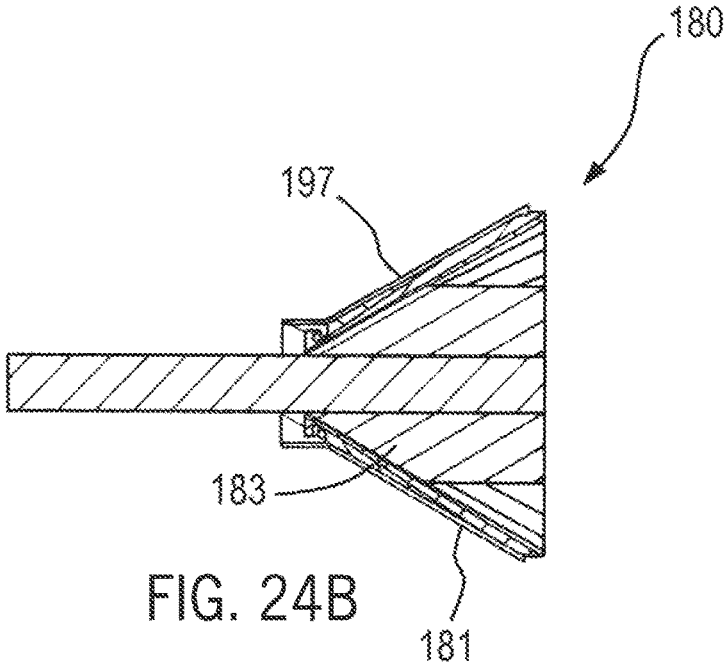
Figure 24C:
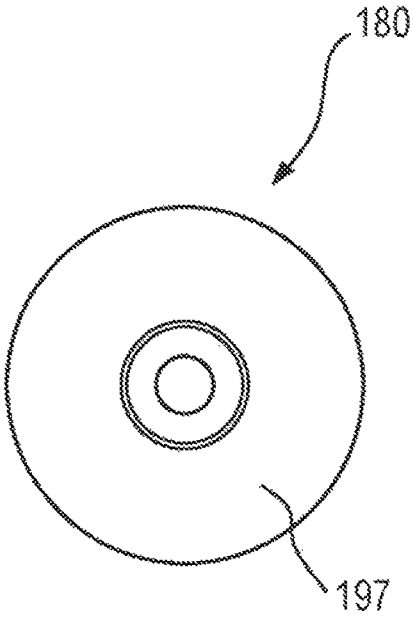

In certain embodiments, the apparatus 140 may be used in conjunction with the apparatus of other embodiments to provide an assembly of expanding apparatus. For example, certain embodiments are described with reference to FIGS. 21A through 22D. FIGS. 21A through 21C are respective isometric, longitudinal sectional, and cross-sectional views of an apparatus 160 in a collapsed condition. FIGS. 22A and 22B are respective partially cut away isometric and longitudinal sectional views of the apparatus 160 in an expanded condition. FIGS. 22C and 22D are respective cross-sectional views of the apparatus 160 of FIGS. 22A and 22B through lines C-C and D-D of FIG. 22B.

As illustrated, in certain embodiments, the apparatus 160 includes a mandrel 170 supporting a centrally disposed expanding apparatus 162, which is of the same form of the apparatus 80, with the same functionality and operation. In addition, on either side of the apparatus 162 are expanding apparatus 164*a*, 164*b* including cone structures of similar construction as the apparatus 140, with the same functionality and operation. Axially outside of the apparatus 164*a*, 164*b* are additional expanding apparatus 166*a*, 166*b*, which include cone structures of similar construction as the apparatus 140, and have the same functionality and operation.

In use, the apparatus 160 may be actuated to be radially expanded to a second diameter by an axial actuation force, which acts on one or both of retaining rings 167*a*, 167*b* to move one or both with respect to the mandrel 170. Relative movement of the outer retaining rings 167*a*, 167*b* causes the expanding apparatus 162, 164*a*, 164*b*, 166*a*, 166*b* to expand to their expanded conditions, driven by the conical wedge surfaces of the respective retaining rings 163*a*, 163*b*, 165*a*, 165*b*.

The expanded condition of the apparatus 160 is shown in FIGS. 22A through 22D. As described above with reference to FIGS. 10A through 11D, the apparatus 162 expands to a form which defines first and second hollow conical support structures at first and second flanks of the apparatus 162. The internal angles of the hollow cones formed by expanding apparatus 164*a*, 164*b* correspond to the external cone angles of the apparatus 162, and the apparatus 164*a*, 164*b* are brought into abutment with the outer flanks of the apparatus 162 to create a nested, layered support structure. Similarly, the internal angles of the hollow cones formed by expanding apparatus 166*a*, 166*b* correspond to the external cone angles of the apparatus 164*a*, 164*b*, and the apparatus 166*a*, 166*b* are brought into abutment with the outer flanks defined by apparatus 164*a*, 164*b*. The combined apparatus 160, as illustrated in FIG. 22B, provides additional support for the cylindrical ring structure 161 of the apparatus 162 due to the increase in effective wall thickness created by the abutment of conical support structures in a nested arrangement. Each conical surface is substantially or completely smooth and, therefore, the contact between conical support structures over the majority of the surfaces to optimize mechanical support.

In such embodiments, the direction in which the cone segments are layered differs between adjacent apparatus 162, 164*a*, 164*b*, 166*a*, 166*b*. For example, the layering of cone segments in the apparatus 164*a*, 164*b* is reversed compared to the direction of layering in the apparatus 162, 166*a*, 166*b*. This results in a cross-ply effect between support layers in the expanded condition, as illustrated in FIG. 22A, thereby enhancing mechanical support and load bearing through the apparatus 162, 164*a*, 164*b*, 166*a*, 166*b*, and increasing the convolution of any path between segments of adjacent support layers.

Retraction of the apparatus 162, 164*a*, 164*b*, 166*a*, 166*b* to a collapsed condition is performed by releasing or reversing the axial force on the outermost retaining rings 167*a*, 167*b*. In certain embodiments, this is facilitated by lips 171 provided on the inner surface of the cone segments, as illustrated in FIGS. 21B and 22A. When the expanding cone is in a collapsed condition, the lips 171 of its cone segments engage with an external rim on the retaining ring 167*a*, 167*b* of an adjacent expanding cone. When the outermost pair of expanding cones 166*a*, 166*b* is collapsed under tension, the lips 171 engage the rim of the retaining rings 165*a*, 165*b* to impart tension to the retaining rings 165*a*, 165*b* and retract the expanding cones 164*a*, 164*b*. Similarly, when the expanding cones 164*a*, 164*b* are collapsed under tension, the lips 171 engage the rim of the retaining rings 163*a*, 163*b* to impart tension to the retaining rings 163*a*, 163*b* and retract the expanding apparatus 162.

Although two pairs of expanding cones are provided to support the apparatus 162 illustrated FIGS. 21A to 22D, in other embodiments, fewer or greater numbers of expanding cones may be used, depending on the application. In certain embodiments, support may be provided by a single expanding cone brought into abutment with just one of the flanks of the apparatus 162. Alternatively, in other embodiments, multiple expanding cones may be used in a nested configuration to support just one of the flanks of the apparatus 162. Alternatively, in other embodiments, unequal numbers of expanding cones may be used to support opposing flanks of the apparatus 162.

Within the scope of the embodiments described herein, the expanding apparatus used in nested configurations as described with reference to FIGS. 21A through 22D may have different physical properties including but not limited to configuration, size, wall thickness, conical angle, and/or material selection, depending on application. For example, certain embodiments are described with reference to FIGS. 21A through 22D, the cone segments of the apparatus 164*a*, 164*b* differ from the cone segments of the apparatus 162, 166*a*, 166*b* to provide an improved sealing effect. In certain embodiments, cone segments of the apparatus 164*a*, 164*b* may be formed from metal that is coated with a compliant polymeric material, such as a silicone polymer coating. In certain embodiments, all surfaces of the elements may be coated, and the mutually supportive arrangement of the cone segments within the apparatus 164*a*, 164*b*, combined with the support from the adjacent apparatus 162, 166*a*, 166*b*, may keep them in compression in their operating condition. This enables the combined apparatus 160 to function effectively as a flow barrier, and in some applications, the barrier created is sufficient to seal against differential pressures to create a fluid tight seal.

In certain embodiment, the material selected for the cone segments itself may be a compliant or elastomeric material such as an elastomer, polymer, or rubber rather than a coated metallic or other relatively hard material. Alternatively, in other embodiments, the segments may include a skeleton or internal structure formed from a metallic or other relatively hard material, coated or encased in a compliant or elastomeric material such as an elastomer, polymer, or rubber. The cone segments of all, some, or one of the expanding apparatus may be formed from these alternative materials, or different materials may be used for different expanding apparatus. An individual expanding apparatus may be configured to provide sealing functionality and may, therefore, similarly be fully or partially formed from compliant or elastomeric materials.

Referring now to FIGS. 23A through 24C, there is shown an expanding and collapsing apparatus 180 configured as a seal for a fluid conduit or borehole. As illustrated, in certain embodiments, the apparatus 180 includes an expansion assembly 181 formed from a plurality of elements, including a set of ring elements 182 assembled together to form a conical ring structure 184. The ring elements 182 are assembled on a mandrel 190, with first ends of the ring elements 182 connected to a retaining ring 187. Second ends of the ring elements 182 are adjacent an actuating wedge cone 183. The ring elements 182 are similar to the cone segments 86, 142, and their form and function will be understood from FIGS. 10A through 11D and 19A through 20B, and the accompanying description. The shape of the ring elements 182 is created by the principles described with reference to FIGS. 14A through 15C. The cone segments include an outer surface, an upper planar contact surface, and a lower planar contact surface. The contact surfaces are mutually supportive when assembled to form the ring structure 184. In a first, collapsed condition, the apparatus 180 has a first outer diameter, which is defined by the outer edges of the second ends of the ring elements 182. The shape of the assembly in its collapsed condition is substantially conical.

The apparatus 180 differs from the apparatus 140 described above in that it is provided with a pleated layer 195 of compliant sealing material. As illustrated, in certain embodiments, the layer 195 surrounds the retaining ring 187 and the expanding assembly 181 over the majority of its length, and is pleated to follow the profiled surface of upstanding edges and grooves defined by the collapsed assembly 181. The apparatus 180 may be actuated by an axial actuation force, which acts on one or both of the retaining ring 187 or the wedge 183. As the apparatus 180 is expanded to the expanded condition shown in FIGS. 24A through 24C, the layer 195 is unfolded to form a compliant conical sheath 197 around the expanded conical structure.

The apparatus 180 is just one example of how the embodiments described herein may be applied to a fluid barrier or sealing apparatus, and other fluid barrier or sealing configurations are within the scope of the embodiments described herein. For example, the apparatus may be configured to operate in conjunction with a sealing element, for example, an elastomeric body or an inflatable bladder, disposed beneath a hollow conical structure formed by the expanded cone segments.

Figure 25A:
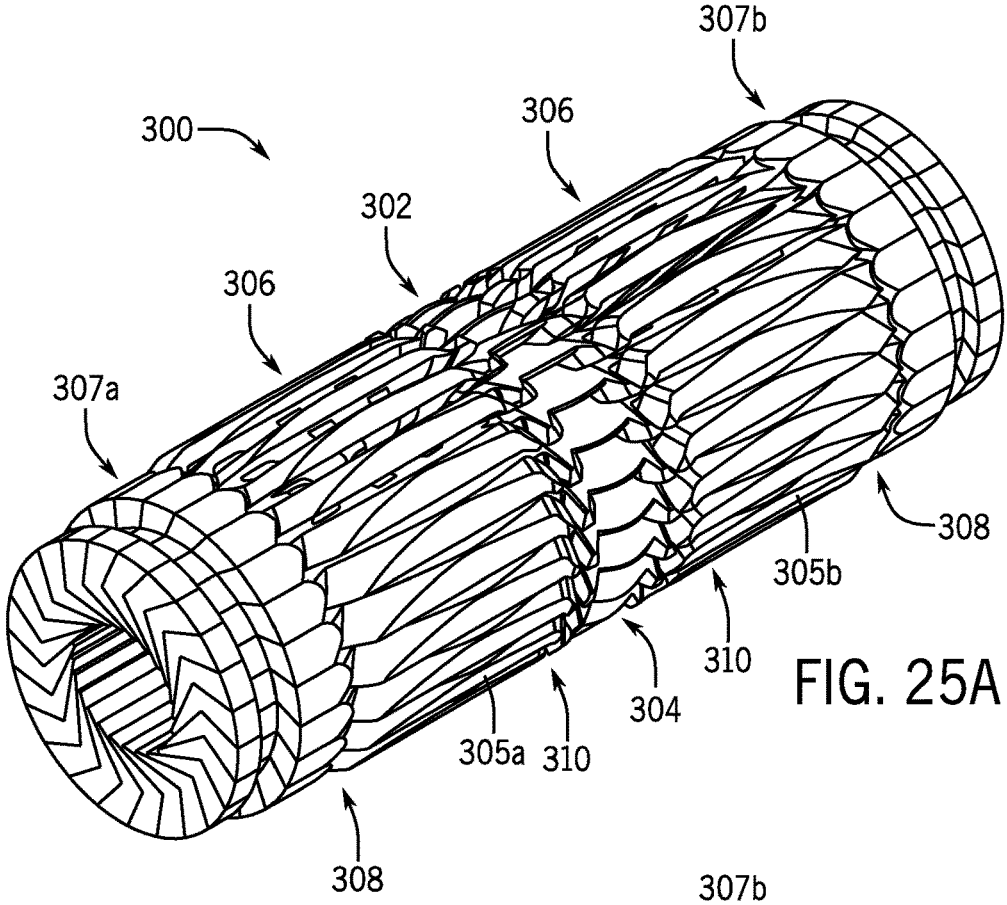
FIGS. 25A and 25B are respective isometric and sectional views of an apparatus in a collapsed condition, in accordance with embodiments of the present disclosure.
Figure 25B:
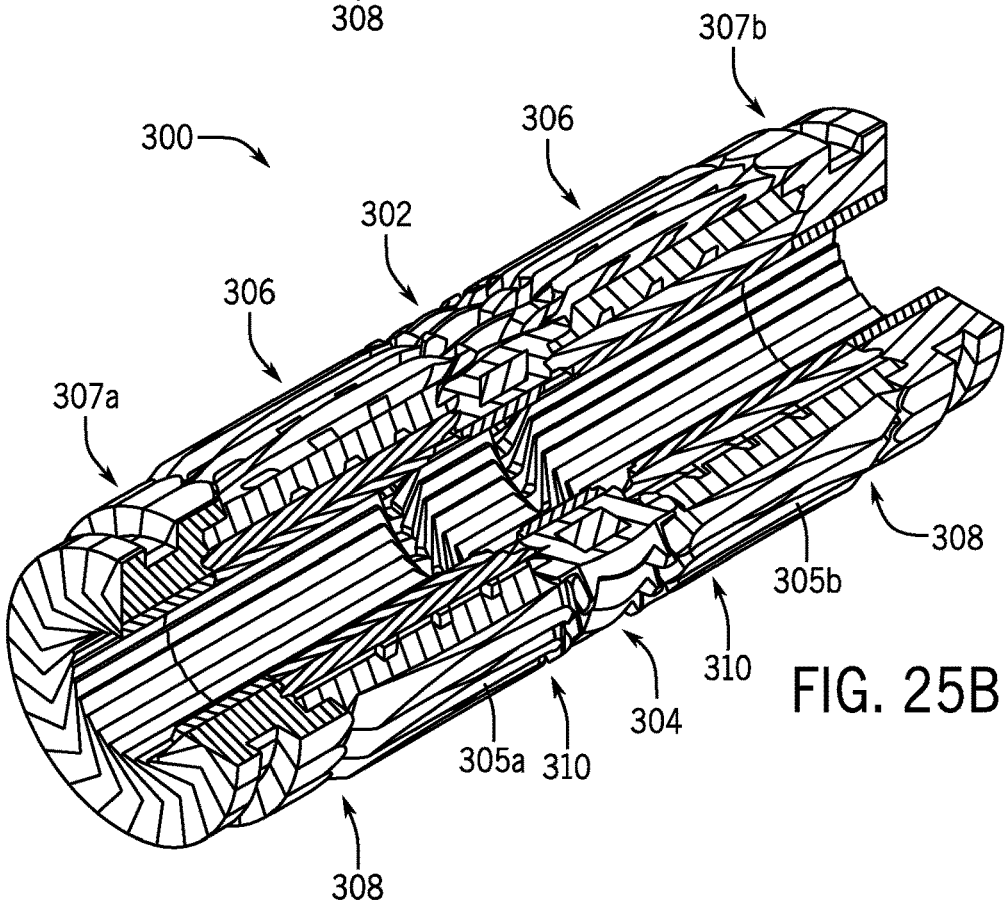
Figure 26A:
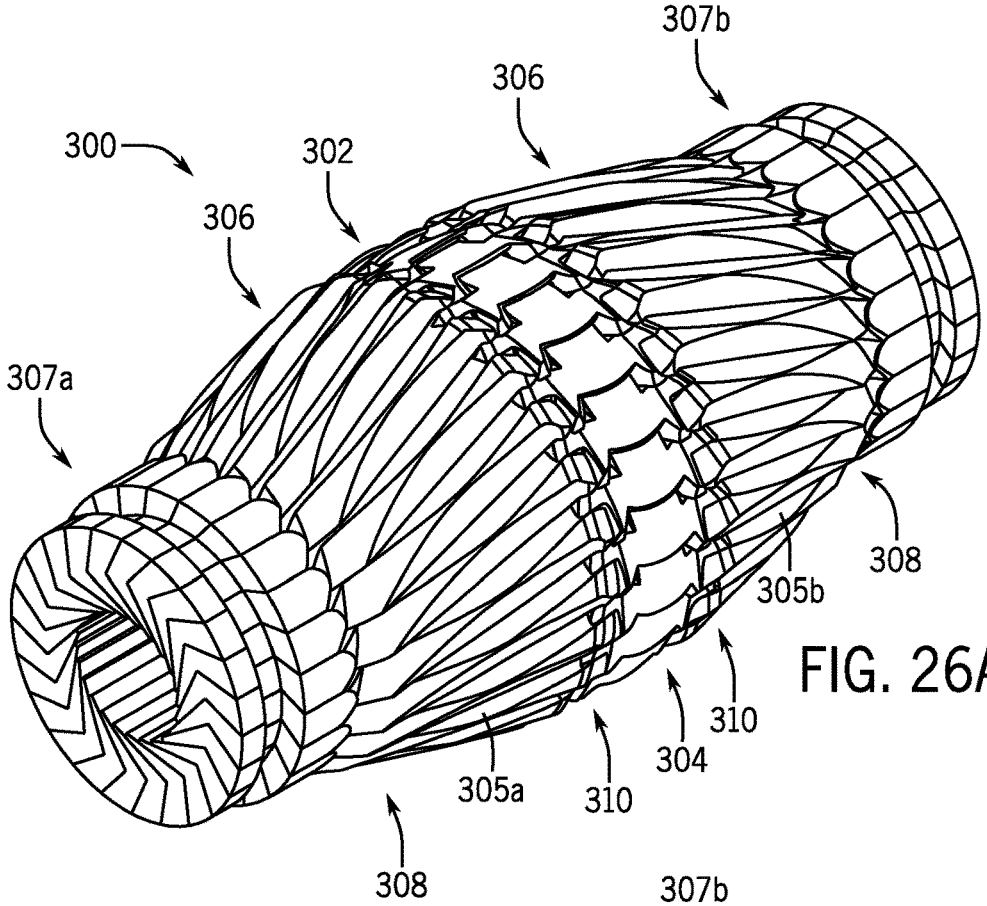
FIGS. 26A and 26B are respective isometric and sectional views of the apparatus of FIGS. 25A and 25B in a partially expanded condition, in accordance with embodiments of the present disclosure.
Figure 26B:
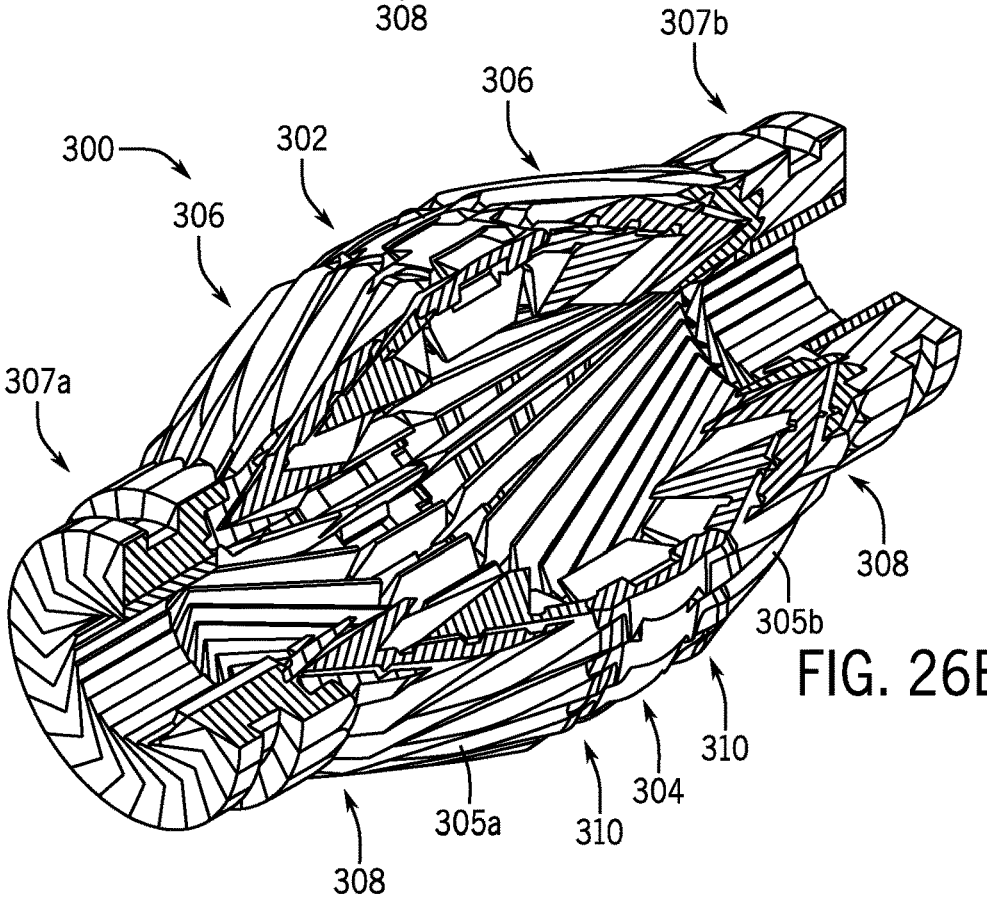
Figure 27A:
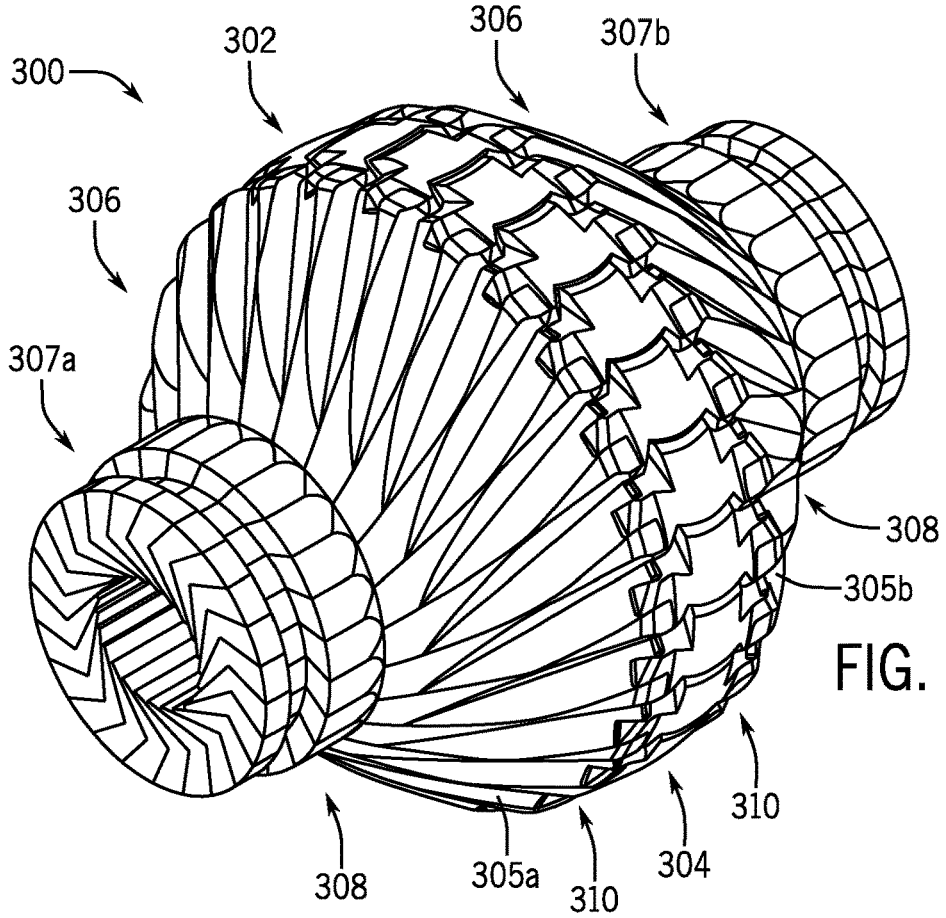
FIGS. 27A and 27B are respective isometric and sectional views of the apparatus of FIGS. 25A through 26B in a fully expanded condition, in accordance with embodiments of the present disclosure.
Figure 27B:
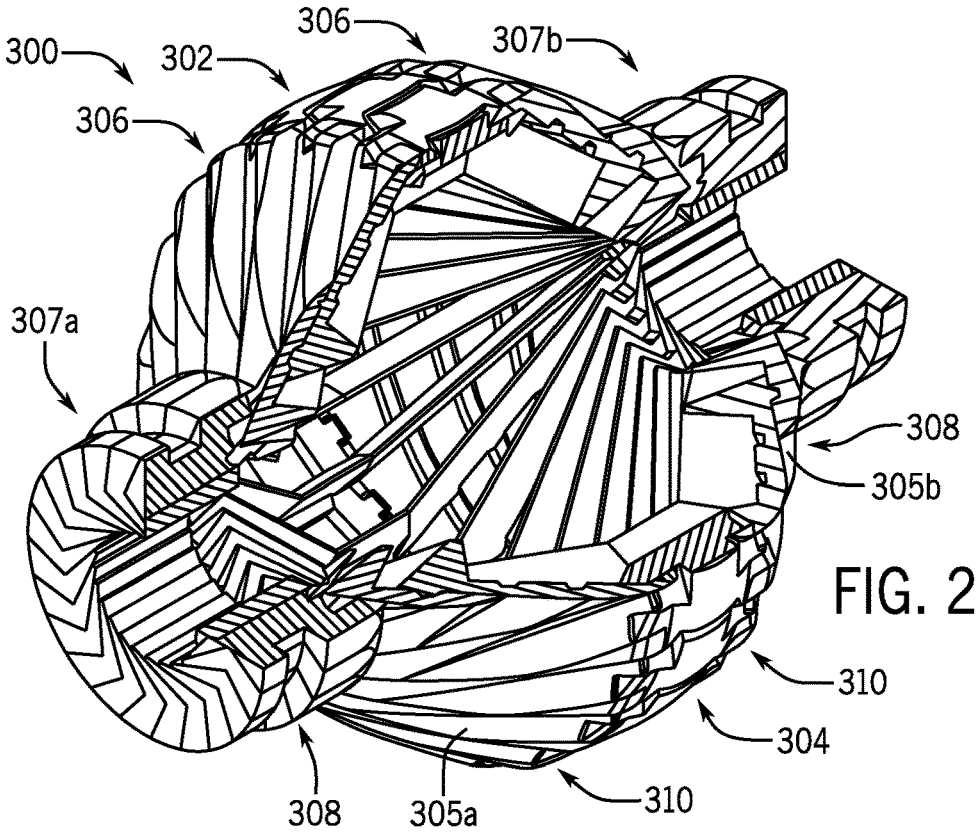

Referring now to FIGS. 25A through 36B, there is shown an expanding and collapsing apparatus 300 according to alternative embodiments. FIGS. 25A and 25B are respective isometric and sectional views of the apparatus 300 in a collapsed condition, FIGS. 26A and 26B are respective isometric and sectional views of the apparatus 300 in a partially expanded condition, and FIGS. 27A and 27B are respective isometric and sectional views of the apparatus 300 in a fully expanded condition.

The apparatus 300 is substantially similar to the apparatus 50, 80, and will be understood from FIGS. 5A through 18B and the accompanying description. As illustrated, in certain embodiments, the apparatus 300 includes an expansion assembly formed from a plurality of elements, including a set of ring elements 302 assembled to form a centrally disposed ring structure 304 around a longitudinal axis. In certain embodiments, the ring structure 304 is configured to be moved between an expanded condition and a collapsed condition by sliding the ring elements 302 with respect to one another in a direction tangential to a circle concentric with the ring structure 304 formed by the ring elements 302. Two sets 305*a*, 305*b* of structural elements 306 (i.e., support elements) are in the form of cone segments. As illustrated, in certain embodiments, first ends 308 of each of the support elements 306 may be connected to a respective retaining ring 307*a*, 307*b* (i.e., base element). In addition, in certain embodiments, second ends 310 of each of the support elements 306 may be connected to a respective ring element 302. In certain embodiments, each ring element 302 is connected to a pair of support elements 306, one from each of the respective sets 305*a*, 305*b*, at second ends 310 of the support elements 306. In the collapsed condition, the apparatus 300 has a first outer diameter, which is defined by the outer surfaces of the ring elements 302.

Figure 28:
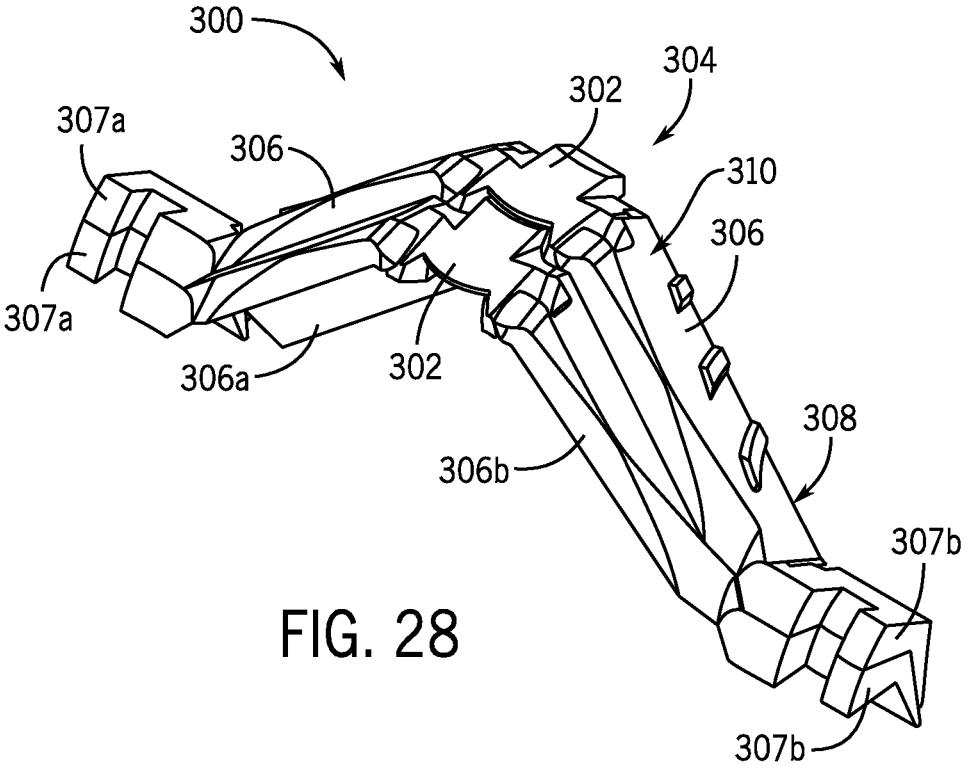
FIG. 28 is a perspective view of two central ring elements, two pairs of sets of support elements, and two pairs of base elements, illustrating how these elements of the apparatus of FIGS. 25A through 27B interact with each other, in accordance with embodiments of the present disclosure.
Figure 29A:
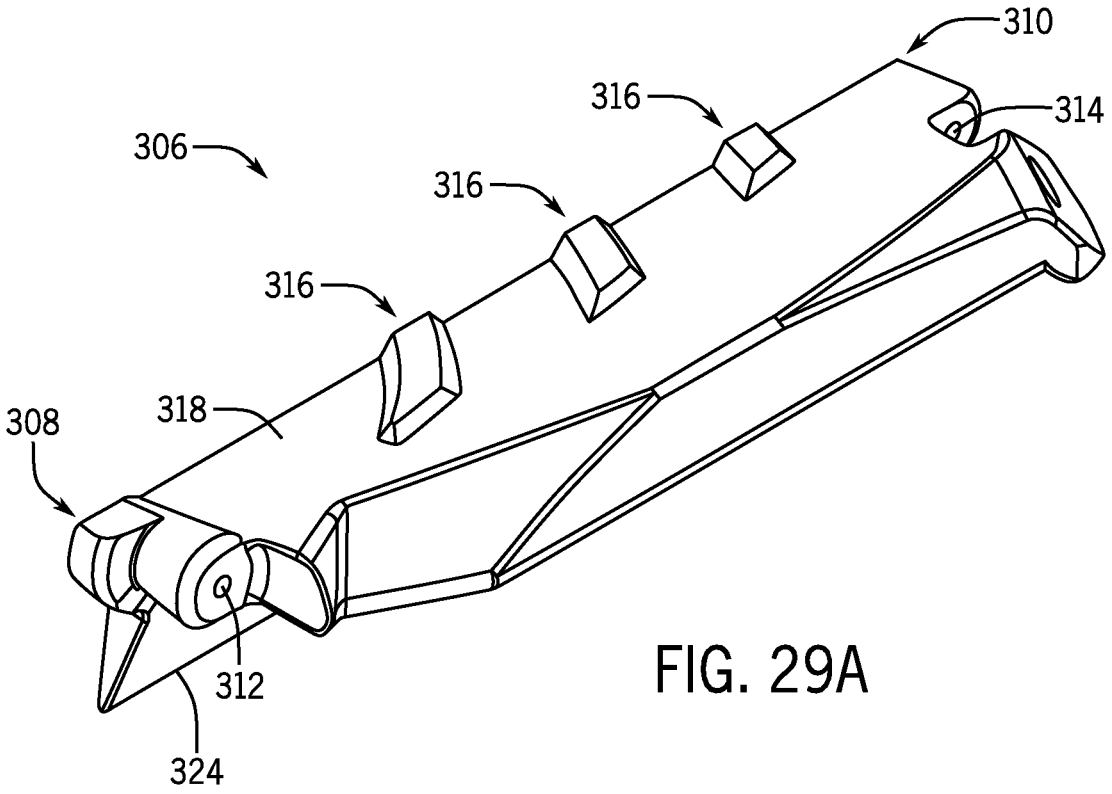
FIGS. 29A through 29D are various views of the support elements of the apparatus of FIGS. 25A through 27B, in accordance with embodiments of the present disclosure.
Figure 29B:
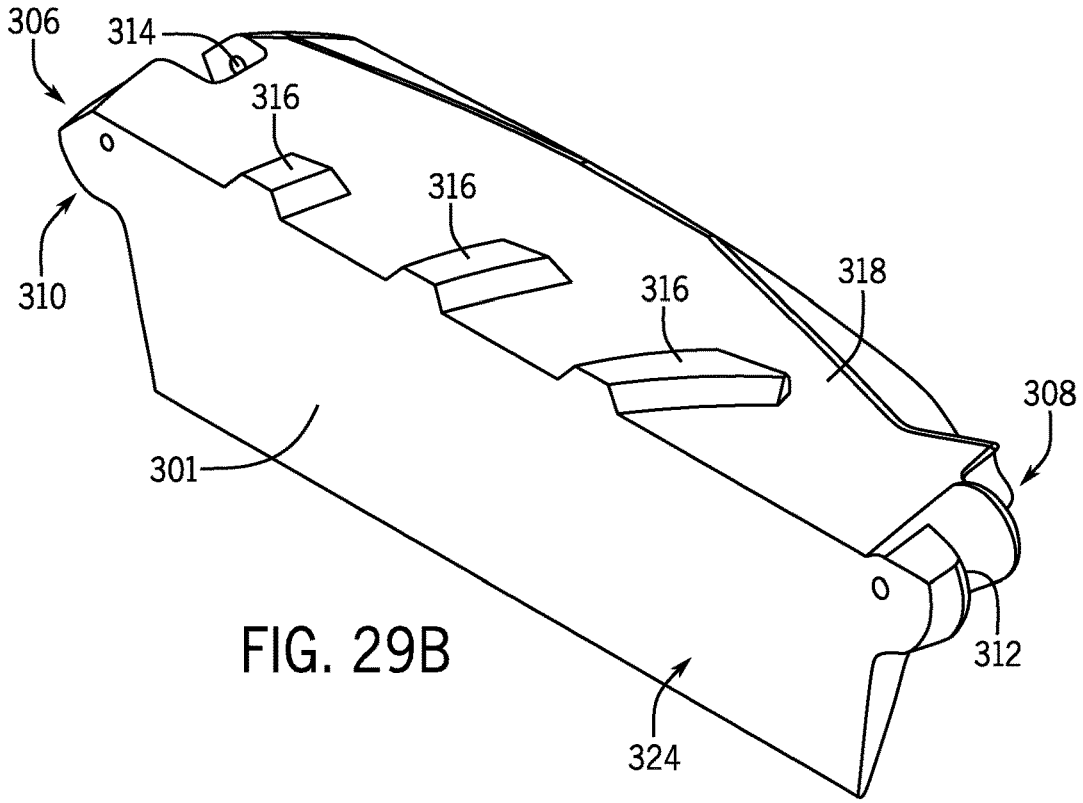
Figure 29C:
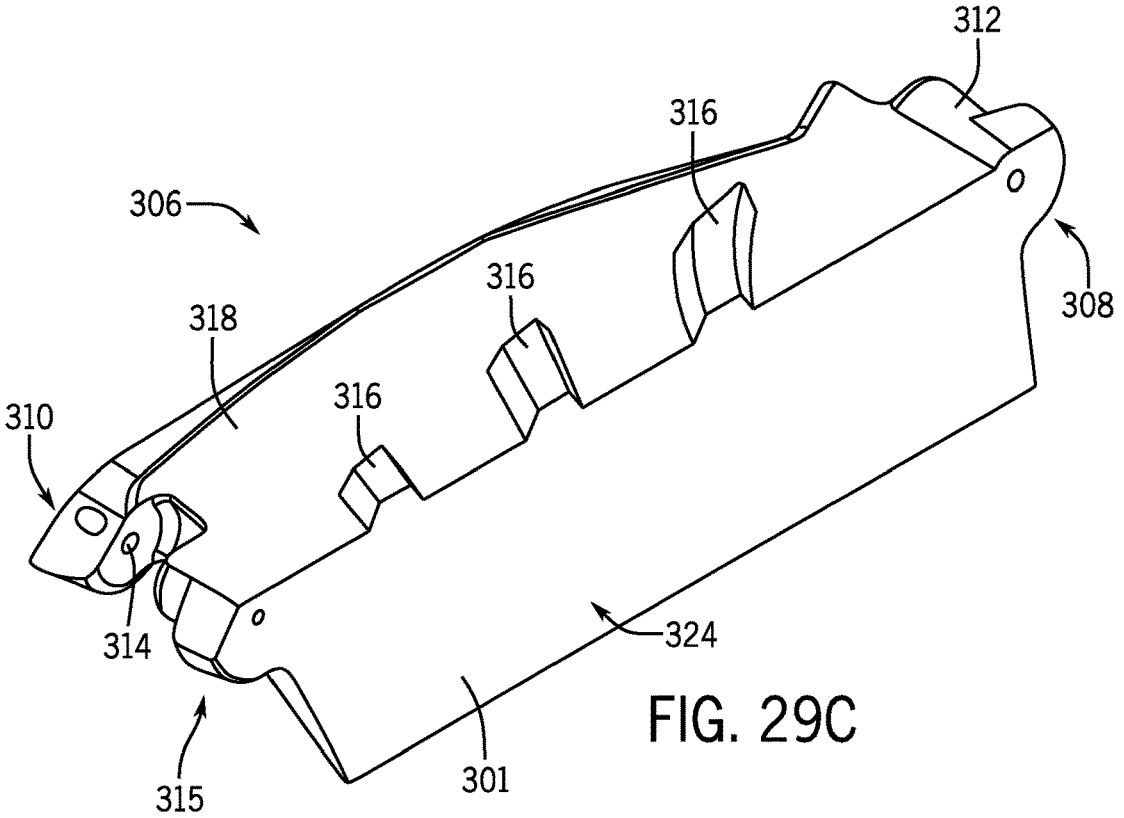
Figure 29D:
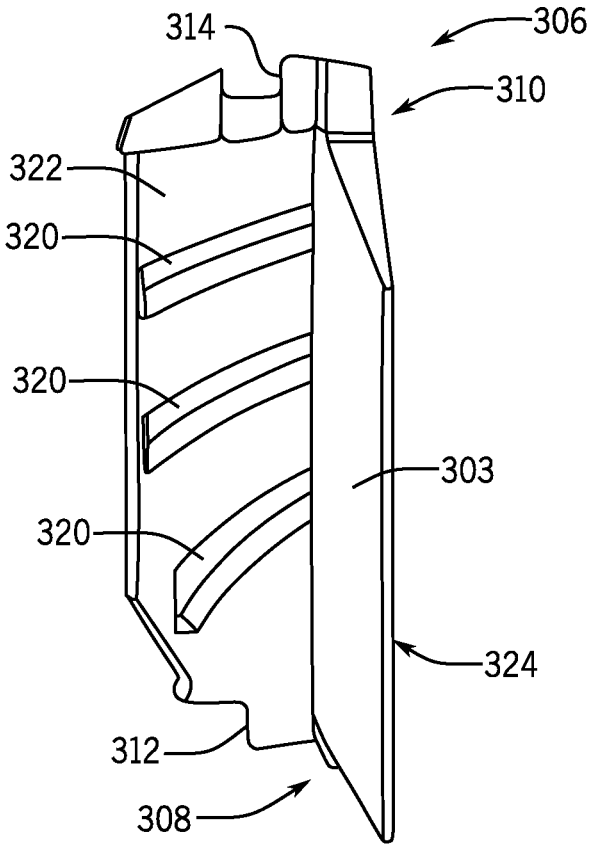

The support elements 306 are described with reference to FIGS. 29A through 32G, the ring elements 302 are described with reference to FIGS. 33A through 35, and the base elements 307*a*, 307*b* are described with reference to FIGS. 36A and 36B. In addition, FIG. 28 is a perspective view of two central ring elements 302, two pairs of sets 305*a*, 305*b* of support elements 306, and two pairs of base elements 307*a*, 307*b*, illustrating how these elements of the apparatus 300 interact with each other in the fully expanded condition illustrated in FIGS. 27A and 27B.

Operation of the apparatus 300 is substantially similar to the operation of the apparatus 50, 80 described above. The apparatus 300 may be actuated to be radially expanded from the collapsed condition having a first diameter to the expanded condition having a second diameter by an axial actuation force. The axial actuation force acts on one or both of the retaining rings 307*a*, 307*b* to move one or both with respect to a mandrel (not shown). The axial actuation force moves the one or both retaining rings 307*a*, 307*b* in a longitudinal (e.g., axial) direction toward the ring elements 302. The axial actuation force acts through the sets 305*a*, 305*b* of support elements 306 to impart axial and radial force components onto the ring elements 302. The retaining rings 307*a*, 307*b* may move the first end 308 of the support elements 306 in a longitudinal (e.g., axial) direction and the second end of the support elements in the axial direction toward the ring elements 302 and in a radially outward direction with respect to the longitudinal axis. Movement of the support elements 306 may impart the axial and radial force components onto the ring elements 302. In certain embodiments, radial expansion of the ring structure 304 may be resisted by a force created by a circumferential spring or external sleeve (e.g., made of an elastic material), but when the force is overcome, the ring elements 302 of the central ring structure 304 may be moved radially outward from the collapsed position, towards the partially expanded condition shown in FIGS. 26A and 26B, and then towards the fully expanded condition shown in FIGS. 27A and 27B. As the ring structure 304 moves radially outward, the ring elements 302 pivot with respect to the base elements 307*a*, 307*b* and the ring elements 302 to create a pair of conical support structures (e.g., via the support elements 306) for the ring structure 304. The ring elements 302 slide tangentially with respect to one another to expand the center ring structure 304 as the first ends 308 of the cone elements 306 are moved towards one another.

FIGS. 29A through 29D are various views of the support elements 306 of the apparatus 300. As illustrated, in certain embodiments, each of the support elements 306 includes various features that facilitate the expanding and collapsing nature of the apparatus 300. For example, in certain embodiments, each of the support elements 306 may include a first hinge 312 disposed at the first end 308 of the support element 306 and a second hinge 314 disposed at the second end 310 of the support element 306. In general, support hinges 312, 314 facilitate connection between the support elements 306 and adjacent elements around a respective pivot axis, as described in greater detail herein. For example, lower support hinges 312 may couple to a respective ring mating hinge to facilitate a lower hinge connection between the respective support element 306 and an adjacent retaining ring 307 (e.g., base element), and upper support hinges 314 may couple to a respective element mating hinge to facilitate an upper hinge connection between the respective support element 306 and an adjacent central ring element 302.

As described in greater detail below, each of the hinges 312, 314 may include axes of rotation that align with axes of rotation of the ring mating hinges of adjacent base elements 307 (e.g., a lower hinge axis of rotation) or the element mating hinges of adjacent central ring elements 302 (e.g., an upper hinge axis of rotation). In certain embodiments, the lower hinge connection and the upper hinge connection may be angularly offset such that axial movement of the hinge may cause the ring elements 302 to move radially outward (e.g., expand), as well as slide with respect to one another in a direction tangential to a circle concentric with the ring structure 304 formed by the ring elements 302. The hinges 312, 314 allow compression/tension to be applied to the apparatus 300 along it axis, allowing positive expansion and retraction to be controlled by the relative position of the base elements 307 to each other. In certain embodiments, the upper and/or lower hinge connections comprise ball and socket connections, knuckle and socket connections, hinge and pin connections, or any suitable rotatable connection.

In addition, in certain embodiments, each of the support elements 306 may include a first interlocking feature, which may include a set of male interlock features 316 disposed on an upper planar contact surface 318 (e.g., outer surface) of the support element 306. Furthermore, in certain embodiments, each of the support elements 306 may include a second interlocking feature, which may include a set of female interlock features 320 disposed on a lower planar contact surface 322 (e.g., inner surface) of an adjacent support element 306. The first interlocking feature may be configured to interlock with the second interlocking feature of an adjacent support element 306. For example, each male interlock feature of a set of male interlock features 316 of a support element 306 may be configured to mate with corresponding female interlock features of a set of female interlock features 320 of an adjacent support element 306. In certain embodiments, the first interlocking feature may be configured to interlock with the second interlocking feature of the adjacent support element 306 in the expanded condition. In certain embodiments, the first interlocking feature is configured to at least partially interlock with the second interlocking feature of the adjacent support element in the collapsed condition. For example, in certain embodiments, the first interlock feature may include two male interlock features 316 (e.g., first male interlock feature and second male interlock feature) and the second interlock feature may include two female interlock features 320 (e.g., first female interlock feature and second female interlock feature). In certain embodiments, the collapsed condition, the first male interlock feature may interlock with the first female interlock feature; however, the second male interlock feature may disengage from the second female interlock feature. In yet other embodiments, the first interlocking feature may be configured to fully disengage from the second interlocking feature when in the collapsed condition.

In addition, in certain embodiments, each of the support elements 306 may include a secondary wedge 324 (e.g., support load feature) configured to support a radial load exerted on the ring structure 304. In certain embodiments, the secondary wedge 324 may take the form of a wall portion that extends at least partially radially inward, with respect to the ring structure 304, from a portion of the inner surface of the support element 306. In certain embodiments, the secondary wedge 324 may extend substantially perpendicular from a portion of the inner surface of the support element 306. In other embodiments, the secondary wedge 324 may extend radially inward, with respect to the ring structure 304, from a lateral side 315 of the inner surface of the support element 306. In certain embodiments, the secondary wedge 324 has a first surface 301 and a second surface 303. In certain embodiments, the second surface 303 may be disposed between 2 degrees and 45 degrees offset from the first surface. An angle between the first surface 301 and the second surface 303 may form a secondary wedge angle of the secondary wedge 324 of the support element 306.

With respect to the hinges 312, 314 of the support elements 306, in certain embodiments, expansion and contraction motion of the elements of the expanding and collapsing apparatus described herein may not be strictly controlled. For example, in certain embodiments, mechanical connection between the elements of the apparatus may not be present during retraction, and instead may be reliant on point-contact during expansion, thereby resulting in a certain degree of uncertainty during expansion that the elements will be correctly aligned, as well as a certain amount of reliance on spring-forces for retraction.

Figure 30:
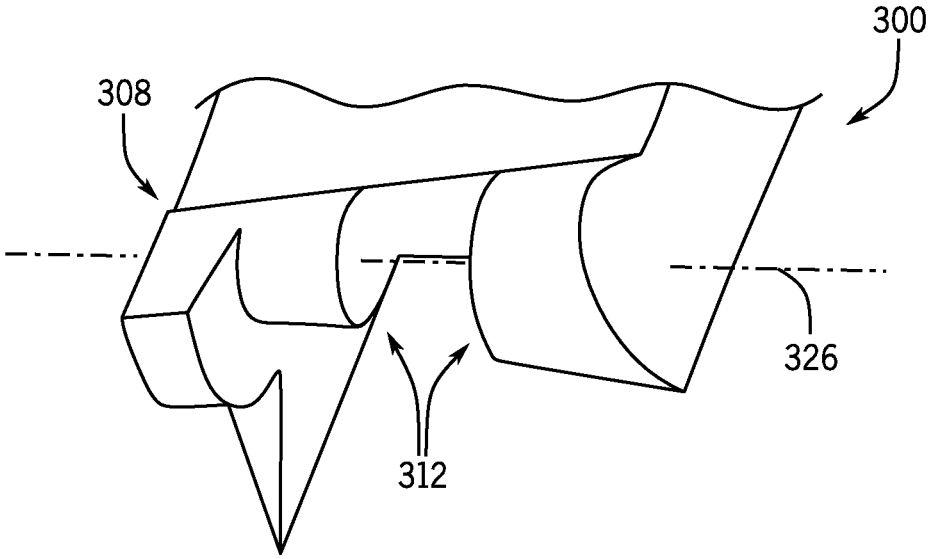
FIG. 30 is a partial perspective view of a support element, illustrating an axis that is formed by a hinge disposed on the first end of the support element.

However, an understanding of the geometry and motion of the elements allows appropriate pivot axes (e.g., upper hinge axis of rotation and lower hinge axis of rotation) to be determined for the hinges. These axes relate to the motion of the elements relative to an adjacent element of the apparatus (e.g., ring element with adjacent support element, support element with adjacent base element, and so forth). Elements rotate around these axes relative to the adjacent element. Using these determined axes, the hinges 312, 314 of the support elements 306 may be created to allow a continuous mechanical connection between all elements of the apparatus 300 during expansion and contraction. For example, FIG. 30 is a partial perspective view of a support element 306, illustrating an axis 326 that is formed by the hinge 312 disposed on the first end 308 of the support element 306. The axis 326 is determined to facilitate the relative motion of the support element 306 with respect to an adjacent base element 307. It will be appreciated that all of the other hinges described herein (e.g., the hinges 312, 314 of the support elements 306, as well as hinges of the ring elements 302 and the base elements 307, may be similarly constructed based on a determination of the relative motion between the respective elements.

Figure 31A:
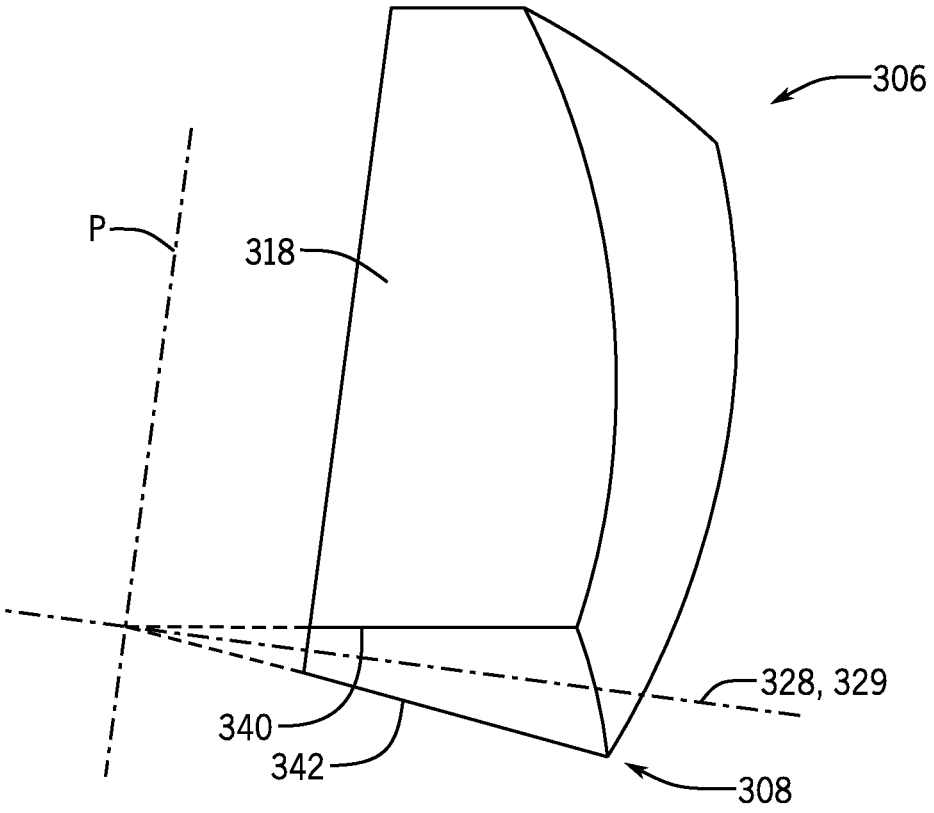
FIGS. 31A and 31B are geometric reference diagrams, useful for understanding how a support element as described herein may be formed, in accordance with embodiments of the present disclosure.
Figure 31B:
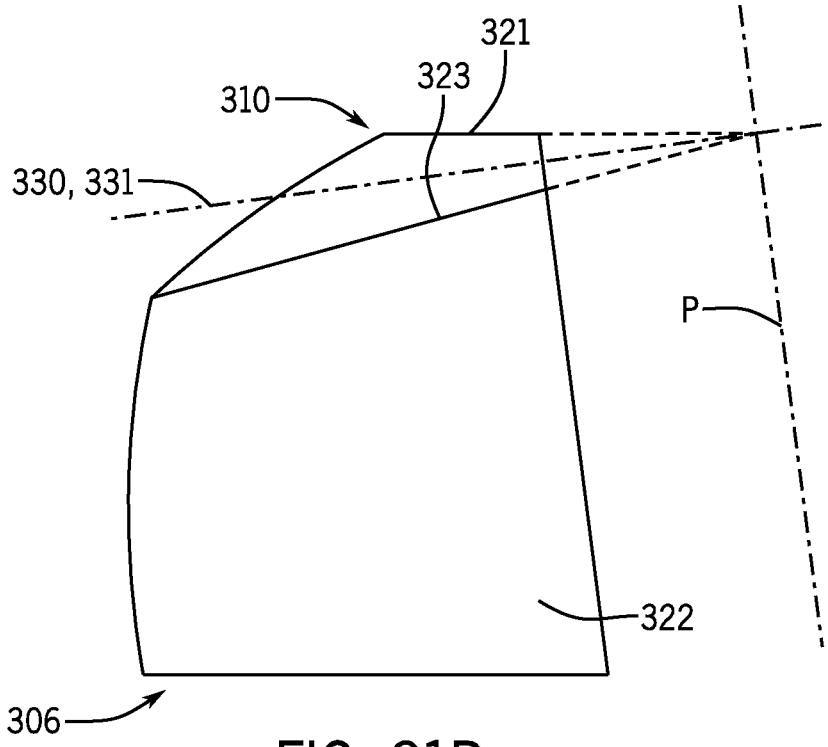

Motion of the support elements 306 relative to adjacent elements of the expanding and collapsing apparatus 300 is governed by their shape, and FIGS. 31A and 31B are useful for understanding the manner in which the shape of the support elements 306 is created in certain embodiments. For example, a bisecting line between the upper planar contact surface 318 and the lower planar contact surface 322 (i.e., a line that is equidistant from the upper planar contact surface 318 and the lower planar contact surface 322) at both bottom and top faces (i.e., at the first end 308 and the second end 310, respectively) of the support elements 306 forms the rotation axes for the support elements 306 at the bottom and top faces. In general, these axes are perpendicular to the motion plane P for the support elements 306.

For example, FIG. 31A illustrates a bisecting line 328 between the upper planar contact surface 318 (e.g., outer surface) and the lower planar contact surface 322 (e.g., inner surface) of a support element 306 at the bottom face (i.e., at the first end 308 of the support element 306), which is perpendicular to the motion plane P. In certain embodiments, the bisecting line 328 defines the lower hinge axis of rotation 329 for the lower hinge connection between the first end 308 of the support element 306 and the retaining ring 307. As such, the lower hinge axis of rotation 329 extends along the first end 308 of the support element 306 and is substantially equidistant from a lower outer edge 317 and a lower inner edge 319. In certain embodiments, the lower outer edge 317 corresponds to an edge between the outer surface 318 and the first end 308 of the support element 306 and the lower inner edge 319 corresponds to an edge between the inner surface 322 and the first end 308 of the support element 306.

Similarly, FIG. 31B illustrates a bisecting line 330 between the upper planar contact surface 318 (e.g., outer surface) and the lower planar contact surface 322 (e.g., inner surface) of a support element 306 at the top face (i.e., at the second end 310 of the support element 306), which is perpendicular to the motion plane P. The bisecting line 330 defines the upper hinge axis of rotation 331 for the upper hinge connection between the second end 310 of the support element 306 and the respective ring elements 302. As such, the upper hinge axis of rotation 331 extends along the second end 310 of the support element 306 and is substantially equidistant from an upper outer edge 321 and an upper inner edge 323. In certain embodiments, the upper outer edge 321 corresponds to an edge between the outer surface 318 and the second end 310 of the support element 306 and the upper inner edge 323 corresponds to an edge between the inner surface 322 and the second end 310 of the support element 306. By revolving hinges 312, 314 around these determined axes, features can be developed that ensure a constant mechanical connection for the full range of expansion and retraction of the apparatus 300.

With respect to the interlocks 316, 320 of the support elements 306, in certain embodiments, load capacity on the expanding and collapsing apparatus described herein may be limited due to a lack of load-sharing between support elements 306. For example, in certain embodiments, the support elements 306 may not support each other in directions parallel to upper and lower planes. Introduction of the interlocks 316, 320 of the support elements 306 enables the support elements 306 to support adjacent elements in the respective array 305 in directions parallel to the upper and lower planes. In addition, the interlocks 316, 320 of the support elements 306 allow support for a relatively wide range of motion of the elements, not only a final determined position. Furthermore, the interlocks 316, 320 prevent relative movement of adjacent support elements 306 in an additional dimension. This allows support to be kept when the final expansion diameter is not known. Accordingly, the interlocks 316, 320 of the support elements 306 adds self-supporting functionality to support elements 306, prevents plane-plane movement of the support elements 306, which prevents bending, further constrains the freedom of movement of the expanding and collapsing apparatus 300, and allows further distribution/sharing of stress, such that the expanding and collapsing apparatus 300 acts more like a solid piece, as opposed to an assembly of parts.

As illustrated in FIGS. 29A through 29D, in certain embodiments, the male interlocks 316 of the first interlocking feature may be in the form of extensions of protrusions extending from the upper planar contact surfaces 318 (e.g., outer surface) of the support elements 306, which are configured to mate with female interlocks 320, of the second interlocking feature, of adjacent support elements 306, which may be in the form of similarly shaped grooves or recesses into the lower planar contact surfaces 322 (e.g., inner surface) of the support elements 306. In certain embodiments, using the lower pivot axis and the wedge profile, the center point of the expansion of the support elements 306 may be determined. For example, as described in greater detail below with respect to FIGS. 32B through 32G, concentric circles may be drawn from the center point, which create the path along which the sets of interlocks 316, 320 are created. A new lower center point may then be created by rotating the original upper center point around the primary axis of the cone ("x-axis") by an amount equal to the wedge angle of the support element 306.

Motion of the support elements 306 relative to adjacent support elements 306 is governed by their shape, and FIGS. 31A and 31B are useful for understanding the manner in which the shape of the support elements 306 is created in certain embodiments. As described above, each of the support elements 306 rotates around a pivot axis (e.g., lower hinge axis of rotation 329) of an adjacent base support 307 (e.g., via a hinge 312), and this pivot axis represents a neutral axis for the rotation of the support element 306 (i.e., its position will not change). Adjacent support elements 306 expanding relative to each other create a sinusoidal relationship (i.e., they move up and out relative to each other as a function of both the expansion angle and the wedge/element angle). This may be approximated as a guide circle centered on the neutral axis (e.g., the axis of its respective hinge 312) of the support elements 306.

The upper planar contact surface 318 (e.g., outer surface) of the support element 306 is not along this neutral axis. However, the upper planar contact surface 318 meets the neutral axis at an origin point 332 (see FIG. 32A), which is stationary. In certain embodiments, the origin point 332 may be disposed in a location offset from the respective support element 306. As illustrated in FIGS. 32B through 32G, concentric upper guide circles 334 may be drawn relative to the origin point 332 of the support element 306. In certain embodiments, the male interlocks 316 of the first interlocking feature are disposed along these concentric upper guide circles 334. For example, each protrusion of a set of protrusions of the male interlocks 316 are configured to respectively extend from the outer surface of a respective support element 306 along a respective protrusion guide path that follows a portion of a respective upper guide circle of the concentric upper guide circles 334.

When fully expanded, the upper planar contact surface 318 of one support element 306 is fully mated to the lower planar contact surface 322 of an adjacent support element 306. Thus, to create the female interlocks 320, respective origin points 332 of the support elements 306 are rotated by the wedge angle 336 (e.g., which is equal to an angle between the origin point 332 and a translated origin point 338) around the primary axis (e.g., "x-axis") 344 of the expanding and collapsing apparatus 300. In certain embodiments, the translated origin point 338 may be disposed in a location offset from the respective support element 306. From this point, the concentric lower guide circles 346 of the same dimension as the male interlocks 316 are created, and the female interlocks 320 of the second interlocking feature are created along these lines. That is, each recess of the set of recesses of the female interlocks 320 are configured to follow a respective recess guide path that follows a portion of a respective lower guide circle configured to pass through the respective support element 306. As such, the male interlocks 316 are centered on the origin point 332, while the female interlocks 320 are centered on the translated origin point 338.

Figure 32A:
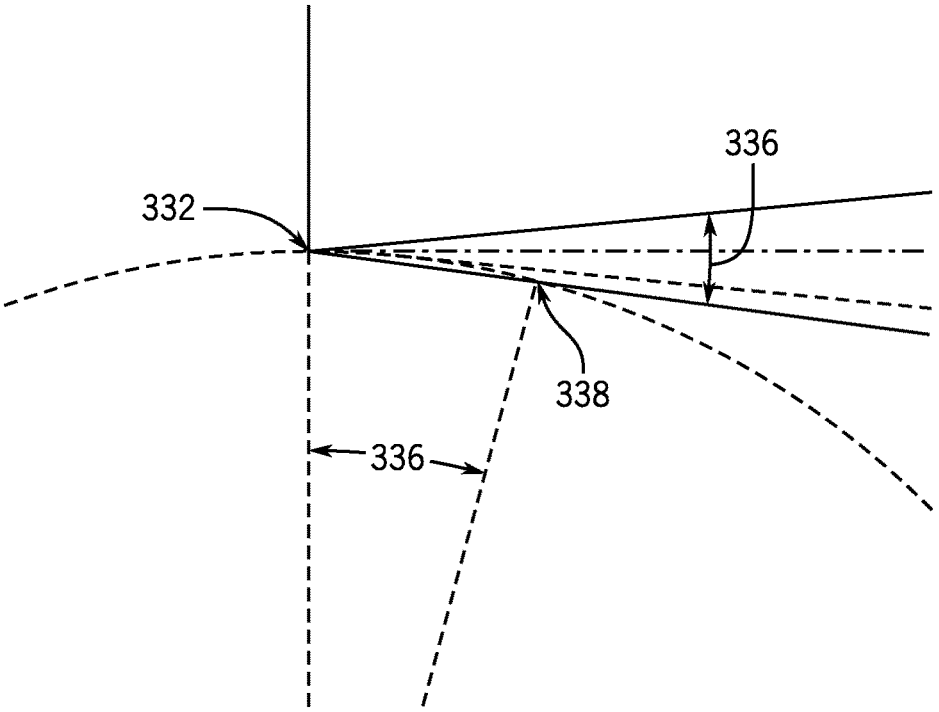
FIGS. 32A through 32G are geometric reference diagrams, useful for understanding how a support element as described herein may be formed, in accordance with embodiments of the present disclosure.
Figure 32B:
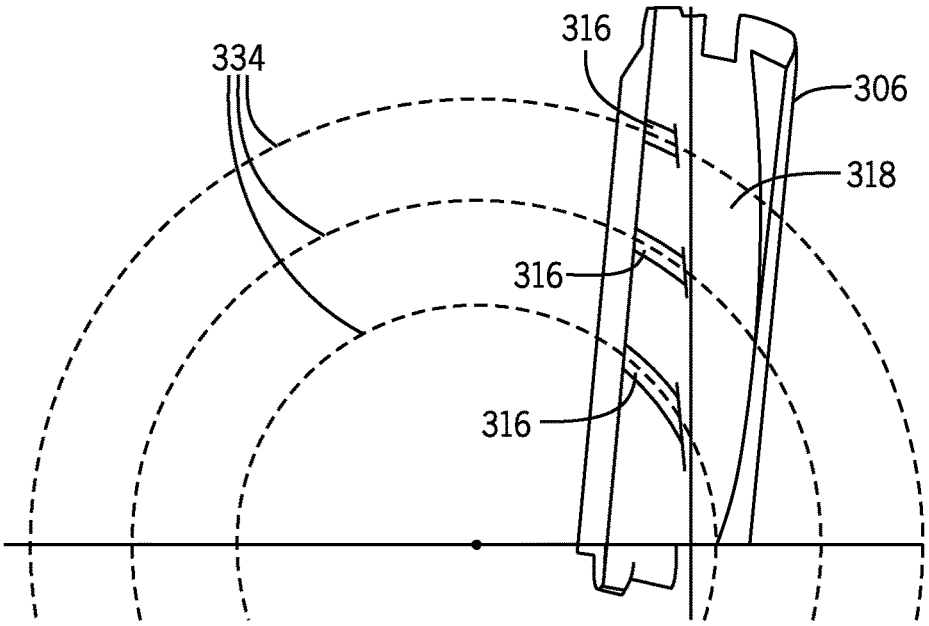
Figure 32C:
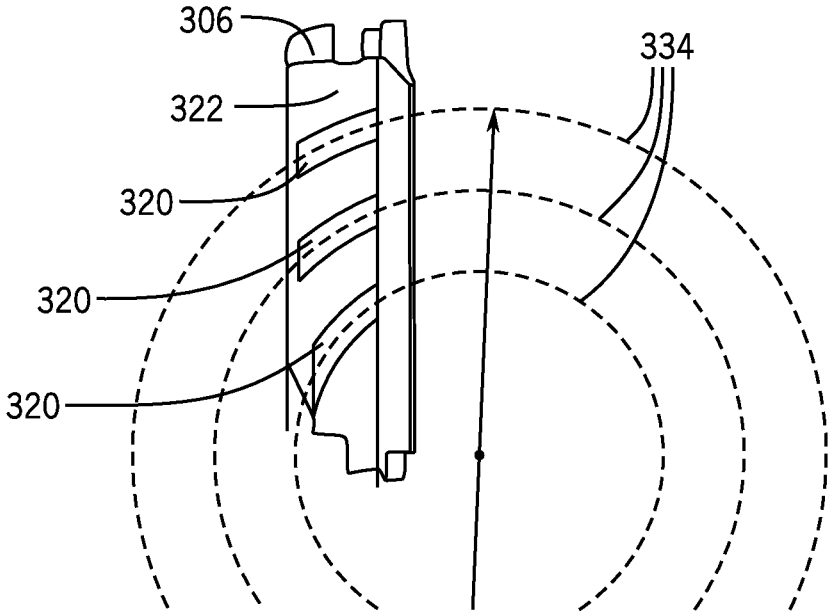
Figure 32D:
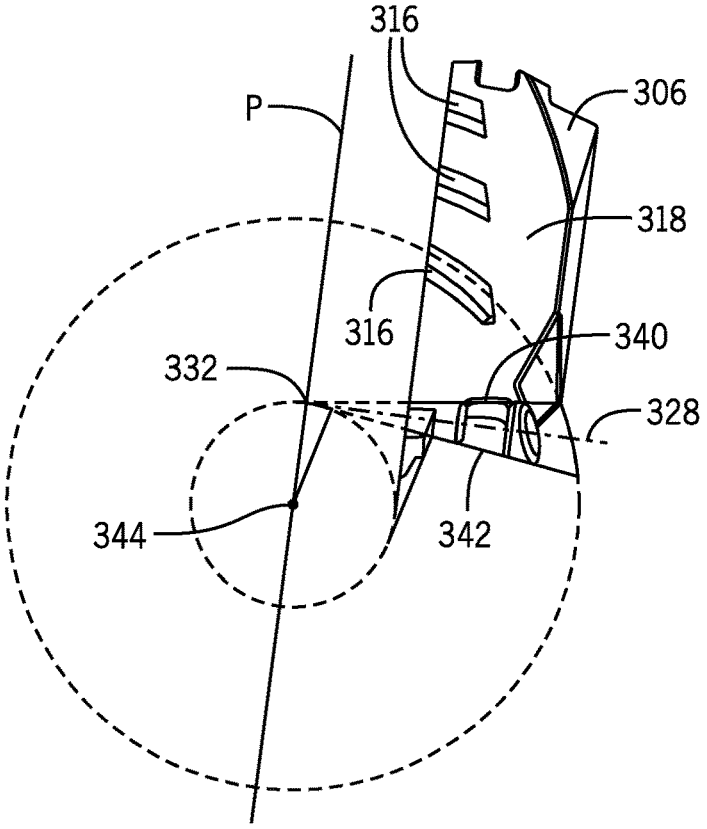
Figure 32E:
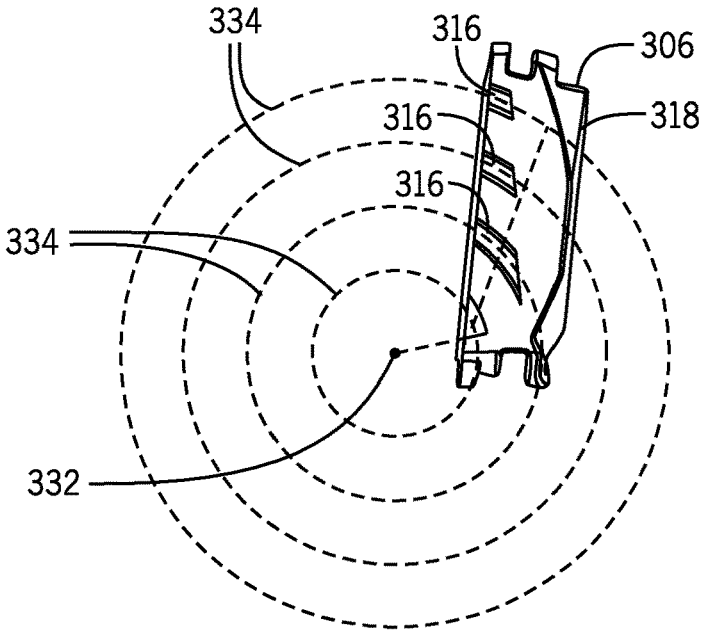
Figure 32F:
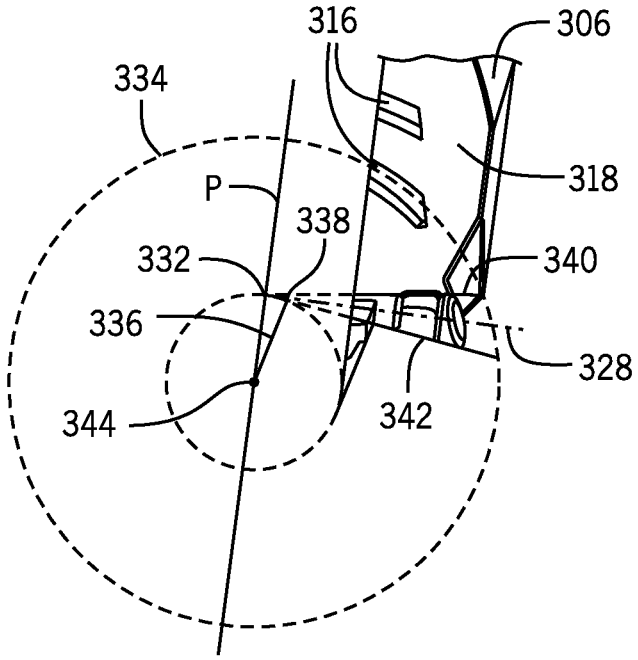
Figure 32G:
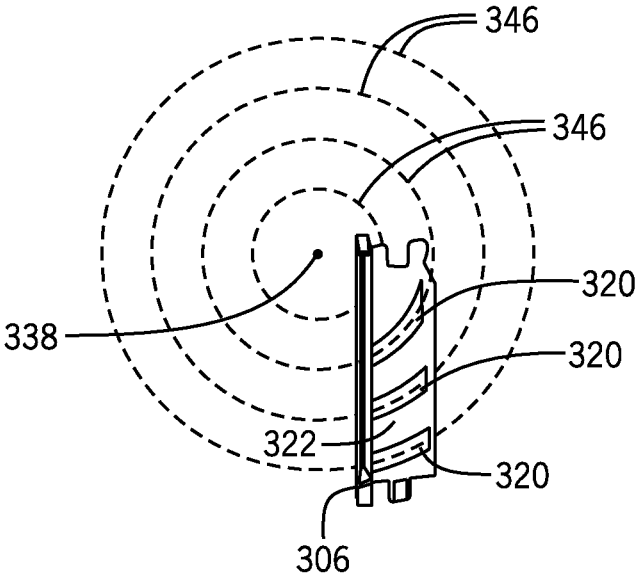

In certain embodiments, adjustment techniques may be used to account for a "cam effect" as the male interlocks 316 swing into position during expansion. More simply, the channels on the lower side of the support elements 306 (i.e., the female interlocks 320 on the lower planar contact surfaces 322 of the support elements 306) are an inverse feature based on the ribs on the upper side of the support elements 306 (i.e., the male interlocks 316 on the upper planar contact surfaces 318 of the support elements 306), rotated at the wedge angle around the x-axis for their position to mate correctly with an adjacent support element 306. In certain embodiments, an upper guide circle and a corresponding lower guide circle may have a substantially similar diameter (e.g., diameters within 5% of each other, within 2% of each other, within 1% of each other, or even closer). Furthermore, in certain embodiments, the origin point 332 of the respective upper guide circle may be offset from the translated origin point 338 of the respective lower guide circle As illustrated in FIG. 32D, the origin point 332 may be defined as the intersection of converging lines corresponding to edges 340, 342 (i.e., which relate to the upper planar contact surface 318 and the lower planar contact surface 322, respectively) of the support elements 306, wherein the origin point 332 is a point along the motion plane P from the primary rotation axis (e.g., "x-axis") 344 of the expanding and collapsing apparatus 300. As illustrated in FIG. 32E, the concentric circles 334 from the origin point 332 define the location at which the male interlocks 316 are disposed along the upper planar contact surface 318 of the support elements 306. As illustrated in FIG. 32F, as described above, the origin point 332 (i.e., the "upper origin point") may be defined as the convergence point of the lines (e.g., that form the wedge angle 336) corresponding to edges 340, 342 of the support elements 306, and the translated origin point 338 (i.e., the "lower origin point") may be defined as rotation of the wedge angle from the origin point 332 around the x-axis 344. As illustrated in FIG. 32G, concentric circles 346 from the translated origin point 338 define the location at which the female interlocks 320 are disposed along the lower planar contact surface 322 of the support elements 306.

FIGS. 33A through 33E are various views of the ring elements 302 of the apparatus 300. As illustrated, in certain embodiments, each of the ring elements 302 includes various features that facilitate the expanding and collapsing nature of the apparatus 300. For example, in certain embodiments, each of the ring elements 302 may include a first hinge 348 disposed on a first side 350 of the ring element 302 and a second hinge 352 disposed on a second side 354 of the ring element 302. In general, the hinges 348, 352 facilitate connection between the ring elements 302 and adjacent support elements 306 around a respective pivot axis, as described in greater detail herein. For example, the hinges 348 facilitate connection between the respective ring element 302 and an adjacent support element 306 of the first set 305*a* of support elements, and the hinges 352 facilitate connection between the respective ring element 302 and an adjacent support element 306 of the second set 305*b* of support elements. As described in greater detail above, similar to the hinges 312, 314 of the support elements 306, each of the hinges 348, 352 of the ring elements 302 may include axes of rotation that align with axes of rotation of mating hinges 314 of adjacent support elements 306. The orientation of the axes of rotation of the hinges 348, 352 of the ring elements 302 may be determined in a substantially similar manner as described above with respect to the hinges 312, 314 of the support elements 306.

Figure 33A:
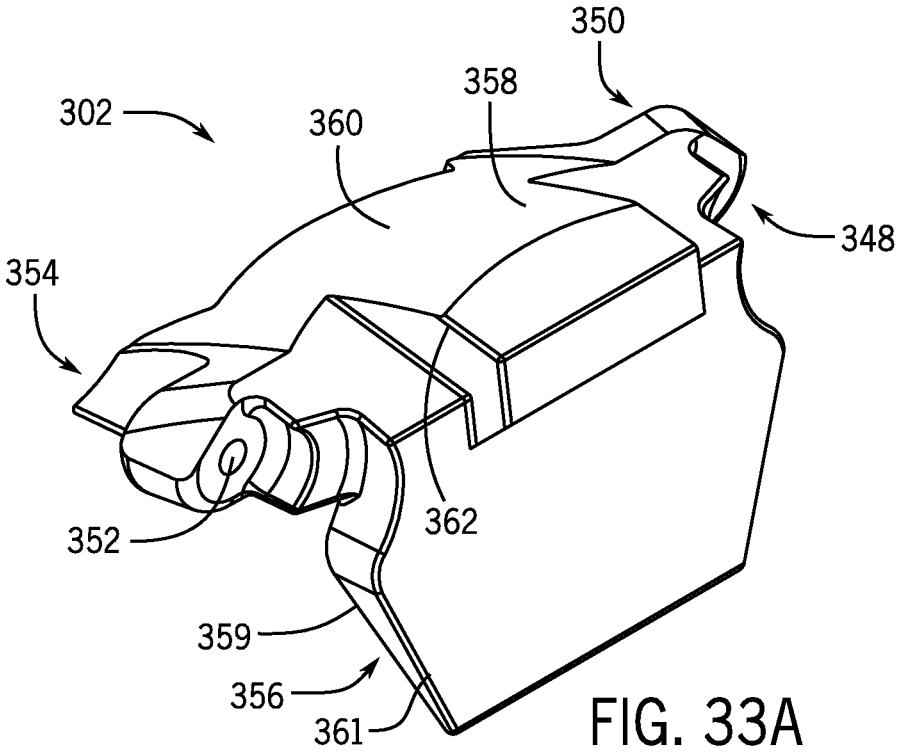
FIGS. 33A through 33E are various views of the ring elements of the apparatus of FIGS. 25A through 27B, in accordance with embodiments of the present disclosure.
Figure 33B:
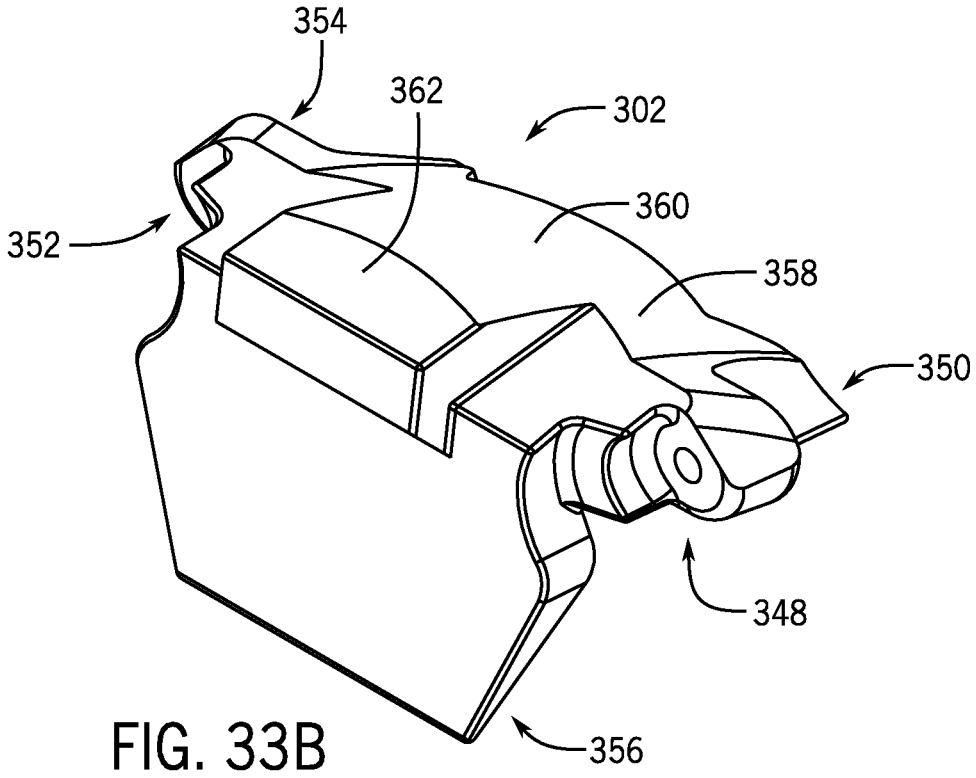
Figure 33C:
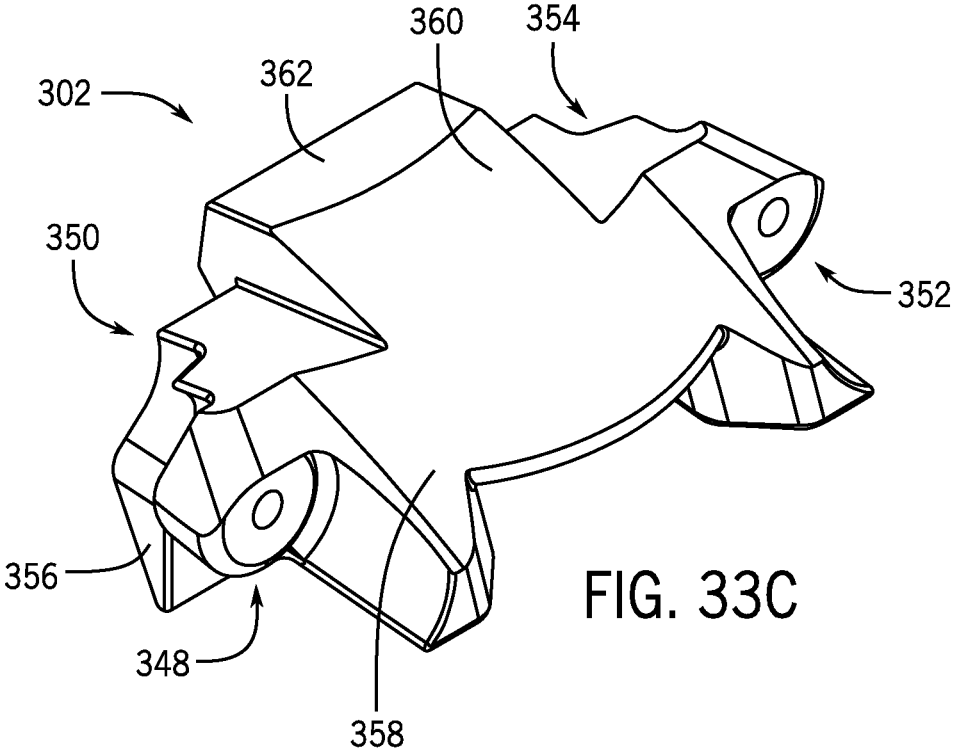
Figure 33D:
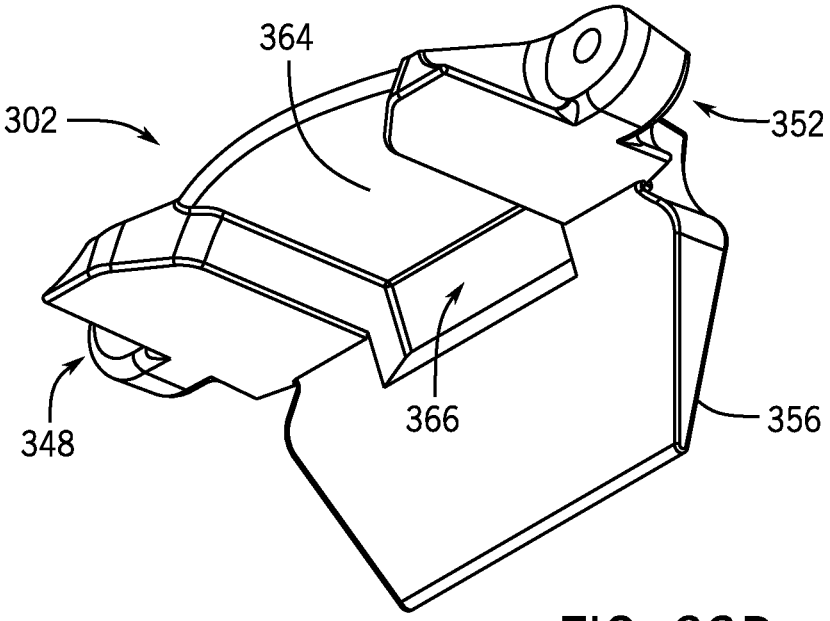
Figure 33E:
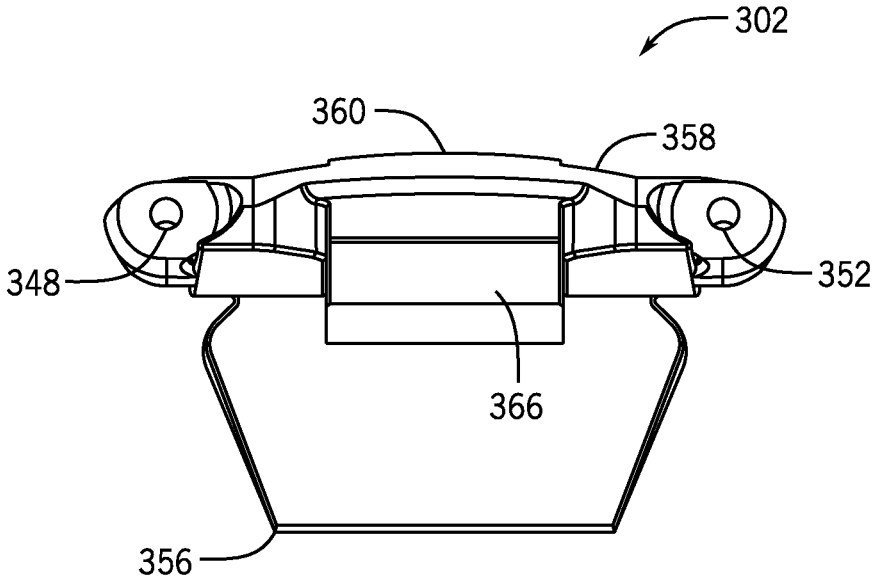

In addition, in certain embodiments, each of the ring elements 302 may include a secondary wedge 356, which may take the form of a wall portion that extends substantially perpendicular from a side of a ring cap 358 of the ring element 302. In addition, as illustrated in FIGS. 33A through 33C, in certain embodiments, the ring cap 358 of the ring element 302 may include a domed outer geometry 360 having a male dovetail 362. In addition, as illustrated in FIGS. 33D and 33E, in certain embodiments, the ring cap 358 may include an inner geometry 364 having a female dovetail 366, which is configured to mate with a male dovetail 362 of an adjacent ring element 302.

With respect to the secondary wedge 356 of the ring elements 302, in certain embodiments, there may be relatively low strength provided by the elements of the expanding and collapsing apparatus described herein. For example, load characteristics of the expanding and collapsing apparatus may generate relatively large forces that are mostly perpendicular to the section of the element with the most material, thereby resulting in relatively large amounts of material of the expanding and collapsing apparatus being unstressed, while relatively small amounts of material of the expanding and collapsing apparatus being overstressed. Therefore, the load-bearing capacity of the expanding and collapsing apparatus may be limited by the relatively small amount of material being overstressed.

Altering the shape of the ring elements 302, as illustrated in FIGS. 33A through 33E, to include the secondary wedge 356 will help remove the unstressed areas, and add material to the relatively highly stressed areas without changing the expansion and contraction properties of the apparatus 300. In other words, adding the secondary wedge 356 to the ring elements 302 creates a more even stress distribution, and increases the capacity of the individual ring elements 302. It will be appreciated that the secondary wedges 324 of the support elements 306 (as well as the secondary wedges 378 of the base elements 307, described below) serve substantially similar purposes.

Figure 34A:
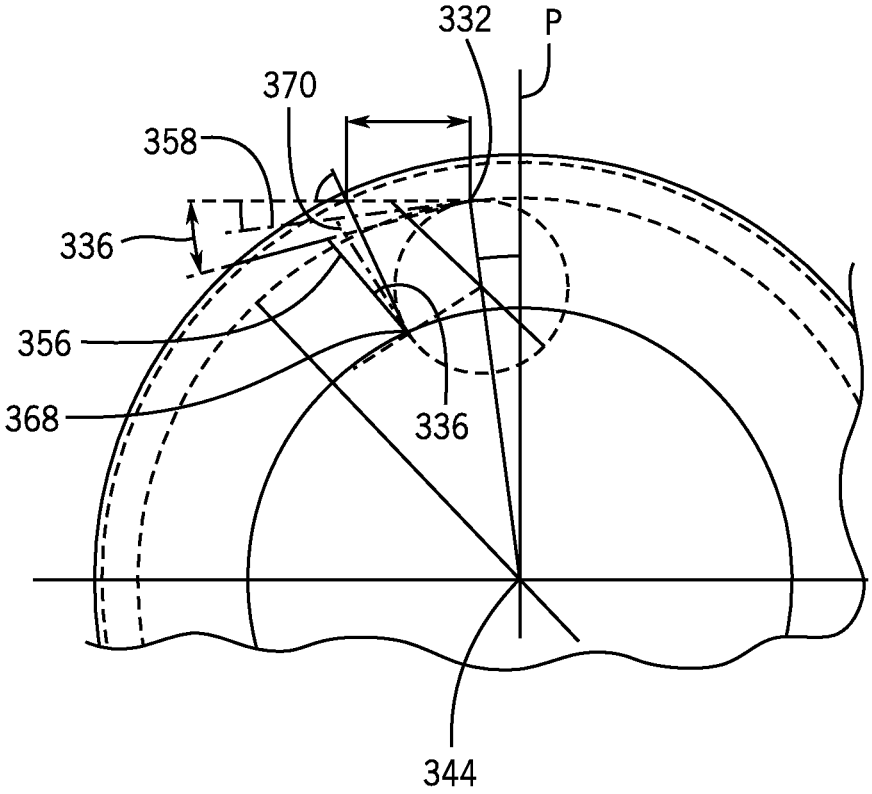
FIGS. 34A and 34B are geometric reference diagrams, useful for understanding how a ring element as described herein may be formed, in accordance with embodiments of the present disclosure.

As illustrated in FIG. 34A, in certain embodiments, the secondary wedge 356 of the ring elements 302 extends substantially perpendicular from an inner surface of the wedge (e.g., formed by the ring cap 358 of the ring elements 302). In certain embodiments, the ring cap 358 has an inner geometry 364 (e.g., inner surface) and an outer domed geometry 360 (e.g., outer surface) offset from the inner surface such the ring cap 358 has a wedge shape. An angle between the inner surface and the outer surface forms the wedge angle 336. In general, the wedge angle 336 of the wedge formed by the ring cap 358 of the ring element 302 is the same as (e.g., within 2 degrees, within 1.5 degrees, within 1 degree, within 0.5 degree, or even closer, in certain embodiments) the wedge angle 336 of the secondary wedge 356. A bisector line 368 may be formed between the two new edges of a first surface 359 and a second surface 361 of the secondary wedge 356 to create a secondary centerline 370, which is perpendicular to an imaginary line that passes through the center point (e.g., along the x-axis 344 of the expanding and collapsing apparatus 300) of the collapsed ring elements 302 (e.g., the longitudinal axis). For a cone segment, an additional step may be needed. For example, because the cone is designed in the expanded position, and rotates rather than slides to expand, the geometry should be translated to the collapsed position.

Figure 34B:
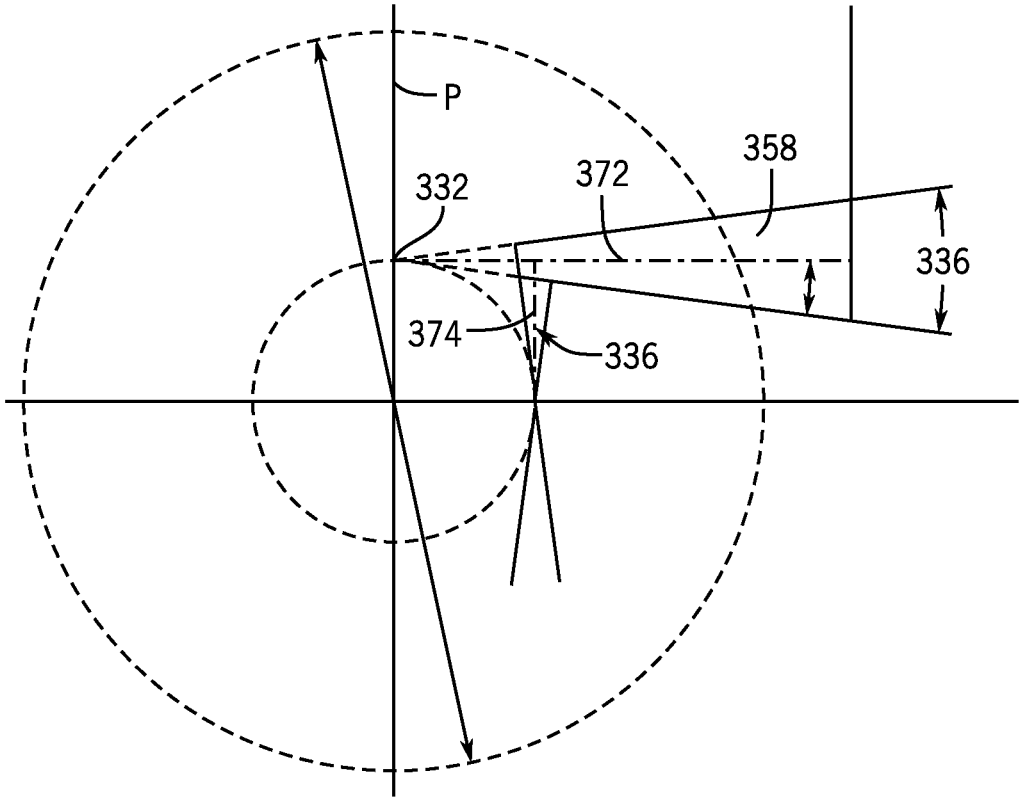

FIG. 34B illustrates a ring element 302 having a secondary wedge 356 (e.g., ring load feature) to differentiate from the simple wedge geometry discussed in reference to FIG. 3. As discussed above, the secondary wedge 356 may have the same wedge angle 336 as the primary wedge (e.g., formed by the ring cap 358). In general, the secondary wedge 356 lies below the direction of expansion. In certain embodiments, the secondary wedge 356 extends at least partially radially inward, with respect to the ring structure 304, from the inner surface of the ring element 302. In other words, the angle between a mid-plane line 372 of the primary wedge and a mid-plane line 374 of the secondary wedge 356 is between 0 degrees and 180 degrees. For example, in certain embodiments, the angle between a mid-plane line 372 of the primary wedge and a mid-plane line 374 of the secondary wedge 356 may be between approximately (90°-wedge angle/2) and 180°. In certain embodiments where the elements of the expanding and collapsing apparatus 300 are collapsing around a mandrel, the secondary wedge 356 may be trimmed if the lowest point passes below the diameter of the mandrel, in such a way that moving up along the motion plane would cause interference with the mandrel.

The secondary wedge 356 of the ring elements 302 increases the moment of inertia in the loading direction of the elements of the expanding and collapsing apparatus 300, thereby providing resistance to bending. In addition, the secondary wedge 356 of the ring elements 302 provides a positive stop for the ring elements 302 to prevent over-deflection. In addition, the secondary wedge 356 of the ring elements 302 allows a larger bearing area when under full load, thereby providing quantifiable limits to rotation/canting of the ring elements 302.

With respect to the domed outer geometry 360 of the ring cap 358 of the ring elements 302, in certain embodiments, the domed outer geometry 360 provides a feature that is rotationally symmetric around the primary axis of the ring structure 304 of the expanding and collapsing apparatus 300, thereby enabling a rolling motion against the casing while under load, as opposed to a pinching force. The domed outer geometry 360 protects a seal component (e.g., elastomer), described in greater detail below, from forces that would result in its potential damage. In addition, the domed outer geometry 360 allowed for greater pressure ratings, dependent upon the seal component used.

Figure 35:
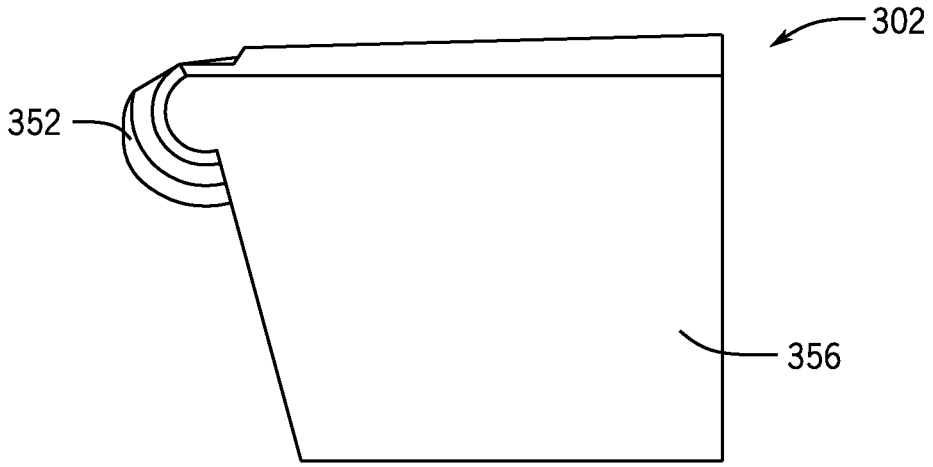
FIG. 35 is a partial side view of a ring element, in accordance with embodiments of the present disclosure.

As illustrated in FIGS. 33A through 33E, in certain embodiments, the hinges 348, 352 of the ring elements 302 may be a single hinge element configured to be inserted within two hinge elements of the hinges 312, 314 of the support elements 306. As illustrated in FIG. 35, in certain embodiments, the hinges of the ring elements 302 may be mitered according to the expansion angle to ensure full contact when at full expansion.

Figure 36A:
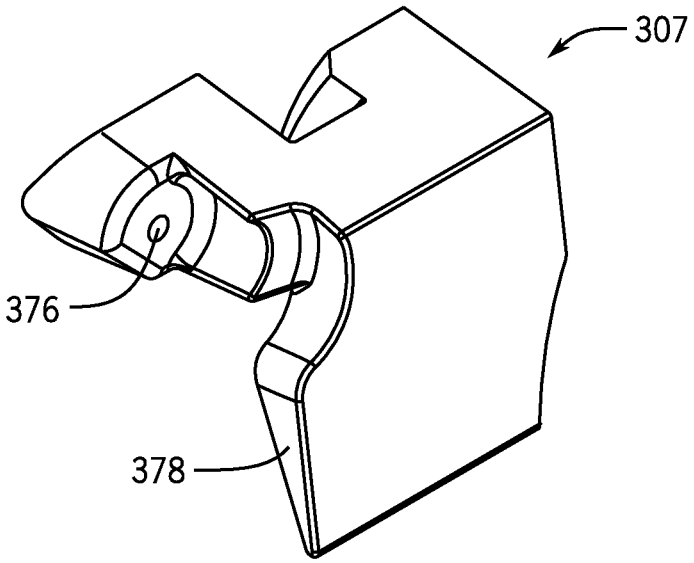
FIGS. 36A and 36B are perspective views of the base elements of the apparatus of FIGS. 25A through 27B, in accordance with embodiments of the present disclosure.
Figure 36B:
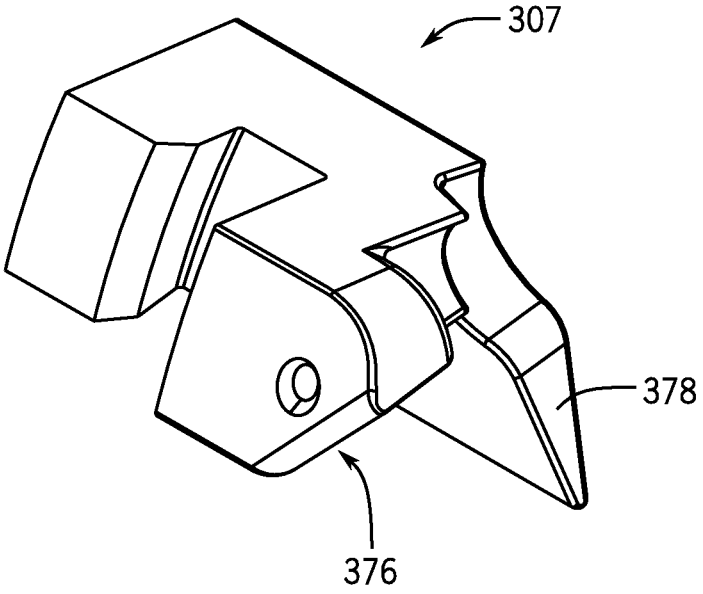

FIG. 36A and FIG. 36B are views of the base elements 307 of the apparatus 300. As illustrated, in certain embodiments, each of the base elements 307 includes various features that facilitate the expanding and collapsing nature of the apparatus 300. For example, in certain embodiments, each of the base elements 307 may include a hinge 376 that facilitates connection between the base elements 307 and adjacent support elements 306 around a respective pivot axis, as described in greater detail herein. For example, the hinge 376 facilitates connection between the respective base element 307 and an adjacent support element 306. As described in greater detail above, similar to the hinges 312, 314 of the support elements 306 and the hinges 348, 352 of the ring elements 302, the hinges 376 of the base elements 307 may include an axis of rotation that aligns with an axis of rotation of mating hinges 312 of adjacent support elements 306. The orientation of the axes of rotation of the hinges 376 of the base elements 307 may be determined in a substantially similar manner as described above with respect to the hinges 312, 314 of the support elements 306. In addition, in certain embodiments, each of the base elements 307 may include a secondary wedge 378, which may take the form of a wall portion that extends substantially perpendicular from the base element 307.

In certain embodiments, the various embodiments of the expanding and collapsing apparatus may be radially surrounded by the seal component 380 to, for example, create a seal between the expanding and collapsing apparatus and the mandrel or tubular within which the expanding and collapsing apparatus is disposed. In particular, an outer surface of the seal component 380 is configured to contact the mandrel or tubular, within which the apparatus 300 is disposed, to generate the seal. In certain embodiments, the seal component 380 may include a compliant material such as an elastomer, a polymer, rubber, or some combination thereof. As such, the seal component 380 generally stretches and/or deforms during expansion to reach the mandrel or tubular wall such that a seal is created between the mandrel or tubular wall and the pleated elastomer sheath. This may cause a reduction in the wall thickness of the seal component 380 available for sealing, and may pre-stress the seal component 380, thereby reducing the strength available for sealing. The embodiments described herein address this concern by reducing the amount that the seal component 380 stretches during expansion of the expanding and collapsing apparatus. In certain embodiments, the diameter of the seal component 380 in the expanded condition is between 65-95 percent longer than the diameter of the seal component 380 in the collapsed condition.

Figure 37:
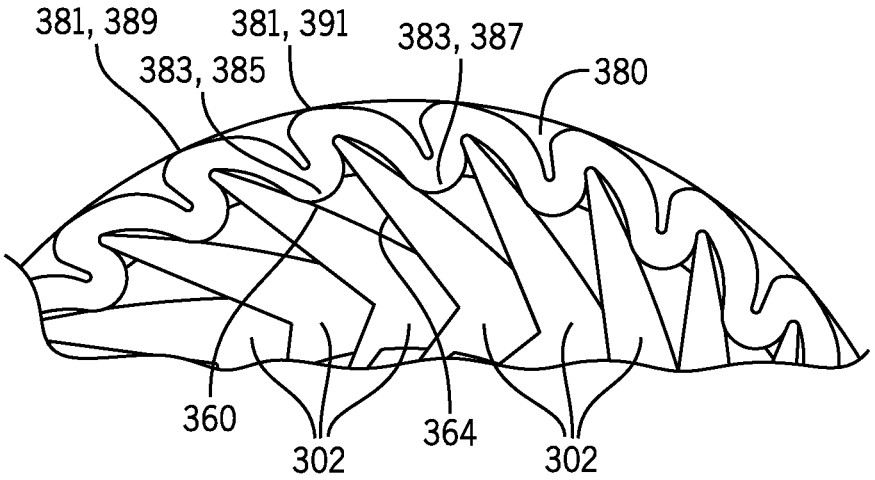
FIG. 37 is a cutaway sectional view of an elastomer disposed around an apparatus, in accordance with embodiments of the present disclosure.

For example, as illustrated in FIG. 37, in certain embodiments, the seal component 380 (e.g., elastomer) is generally shaped to follow the outer contours of the ring elements 302 of the expanding and collapsing apparatus 300. For example, in certain embodiments, the seal component 380 may have a corrugated cross-sectional profile in the collapsed condition. As the ring elements 302 expand, the contours of the corrugated cross-sectional profile in the seal component 380 unfold to produce a fully circular section in the expanded condition. This is done by creating a profile in the 380 that includes curves that generally follow the collapsed external profile of an array of ring elements, which generally reduces the amount of stretch needed in the 380 at the point of sealing, as well as increases the strength.

In certain embodiments, the corrugated cross-sectional profile includes a plurality of outer curved bends 381 and a plurality of inner curved bends 383. In the collapsed condition, each outer curved bend 381 is positioned between a first inner curved bend 385 and a second inner curved bend 387 and each inner curved bend 381 is positioned between a first outer curved bend 389 and a second outer curved bend 391, such that outer curved bends 381 alternate with inner curved bends 383 along the corrugated cross-sectional profile. In certain embodiments, each inner curved bend of the plurality of inner curved bends 383 may be disposed between the outer domed geometry 360 of a first ring element of the plurality of ring elements 302 and an inner geometry 364 of a second ring element of the plurality of ring elements 302. Furthermore, in certain embodiments, each outer curved bend 381 of the plurality of outer curved bends is disposed about an outer edge of a ring cap of a respective ring element 302.

In certain embodiments, in the collapsed condition, each inner curved bend 383 may have a first curvature and each outer curved bend has a second curvature. In addition, in the expanded condition, each inner curved bend and each outer curved bend may have a same third curvature. In certain embodiments, the third curvature may be a substantially similar radius of curvature as the circular cross-sectional profile of the seal component 380 in the expanded condition. Moreover, in certain embodiments, a portion of each outer curved bend of the plurality of outer curved bends 381 is configured to contact a tubular within which the apparatus 300 is disposed in the collapsed condition.

Figure 38A:
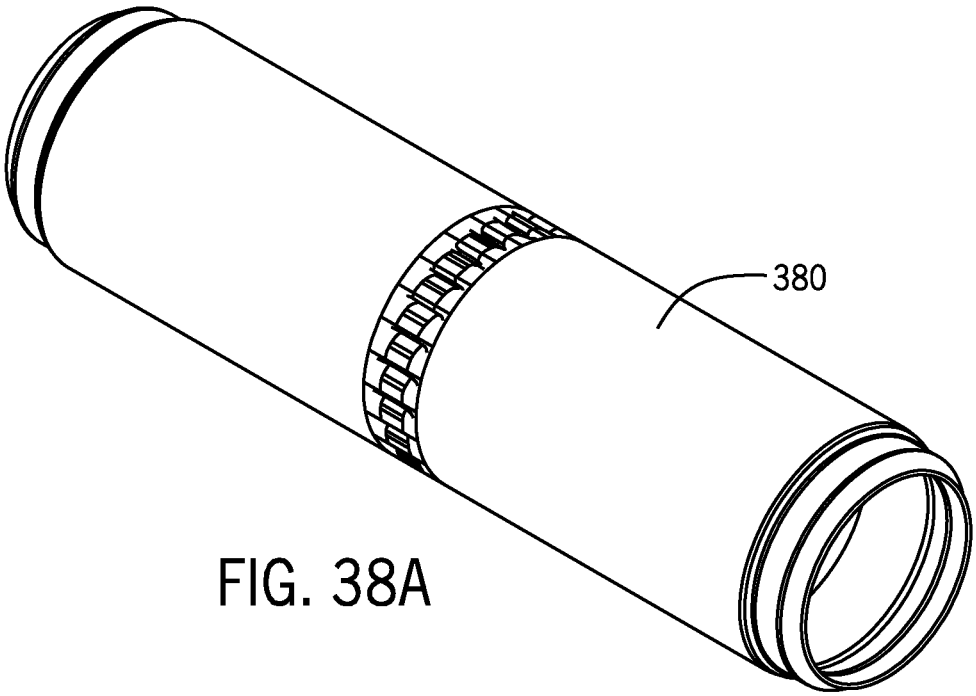
FIGS. 38A through 38C are various views of the elastomer of FIG. 37 disposed around an apparatus, in accordance with embodiments of the present disclosure.
Figure 38B:
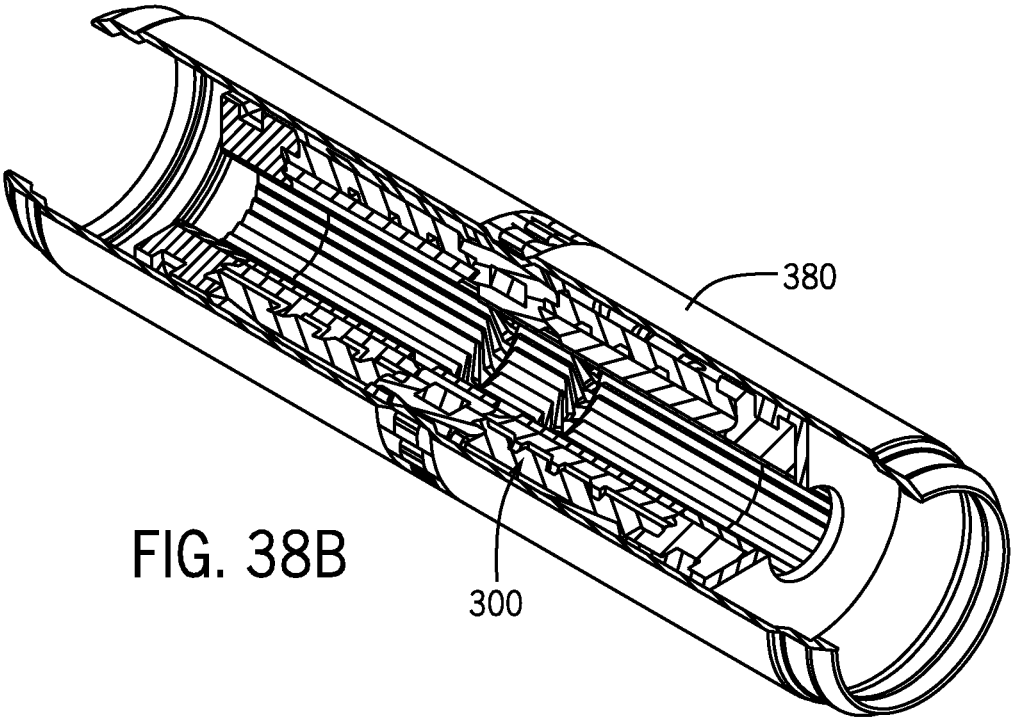
Figure 38C:
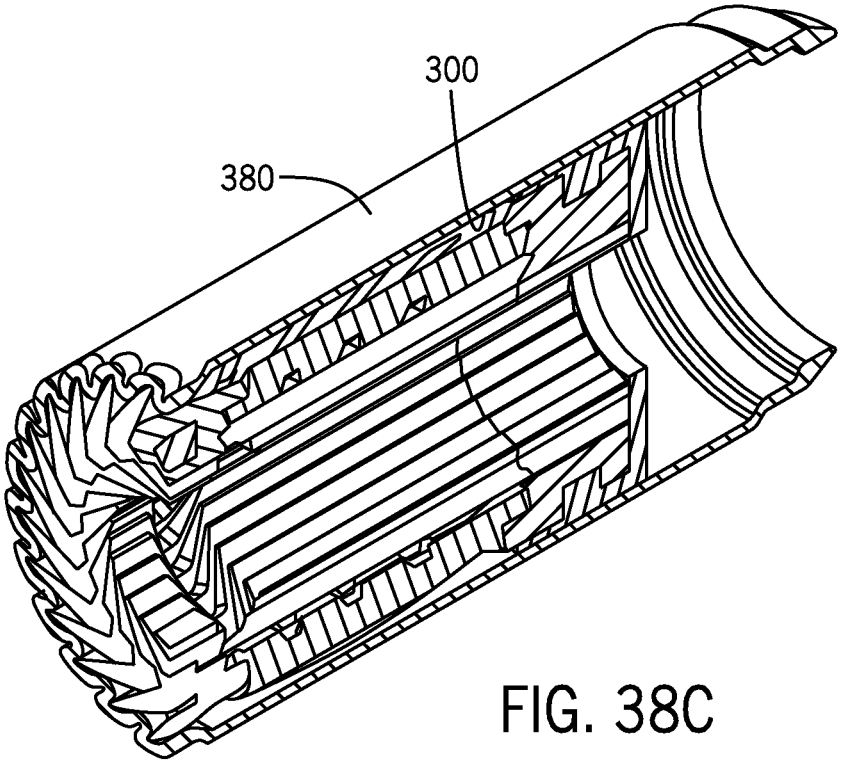

As such, in general, the combined loop length of a cross-section of the seal component 380 should be equal to or less than the minimum expanded circumference. FIGS. 38A through 38C are various views of the seal component 380 surrounding the apparatus 300. However, it will be appreciated that, in other embodiments, the seal component 380 may include an internal profile that includes curves that match any one of the other embodiments of the expanding and collapsing apparatus described herein.

As such, the seal component 380 may be used to help generate a seal between the expanding and collapsing apparatus described herein and a mandrel or other tubing within which the expanding and collapsing apparatus is disposed. However, in certain circumstances, a void may be left underneath the seal component 380 (e.g., between the seal component 380 and the elements of the expanding and collapsing apparatus). The pressure in the well is potentially divided into two separate volumes with different pressures: (1) pressure above the seal (e.g., uphole), and (2) pressure below the seal (e.g., downhole). The purpose of the seal created by the seal component 380 is to isolate these two pressures and prevent flow between the two separate volumes. In this scenario, the maximum pressure the seal created by the seal component 380 would experience is the difference between the uphole and downhole pressures (i.e., the differential pressure between the two separate volumes).

Because the expansion created by the seal component 380 may leave a void under the expanded structure, the void will be at an isolated pressure. This results in the seal structure seeing hydrostatic pressure—not just the differential pressure between the two separate volumes. To limit the seal to just the differential pressure, the void underneath the seal (e.g., annular seal pressure) may be opened to either the uphole pressure or the downhole pressure. Accordingly, in certain embodiments, a mechanism (e.g., pressure equalizing valve) may be used to equalize pressure to the annular seal void dependent upon the pressure conditions. For example, whichever of the above or below pressures is lowest may be equalized to the void under the seal, and if the direction of the pressure differential changes, the pressure under the seal may equalize to the new lowest pressure.

Figure 39A:
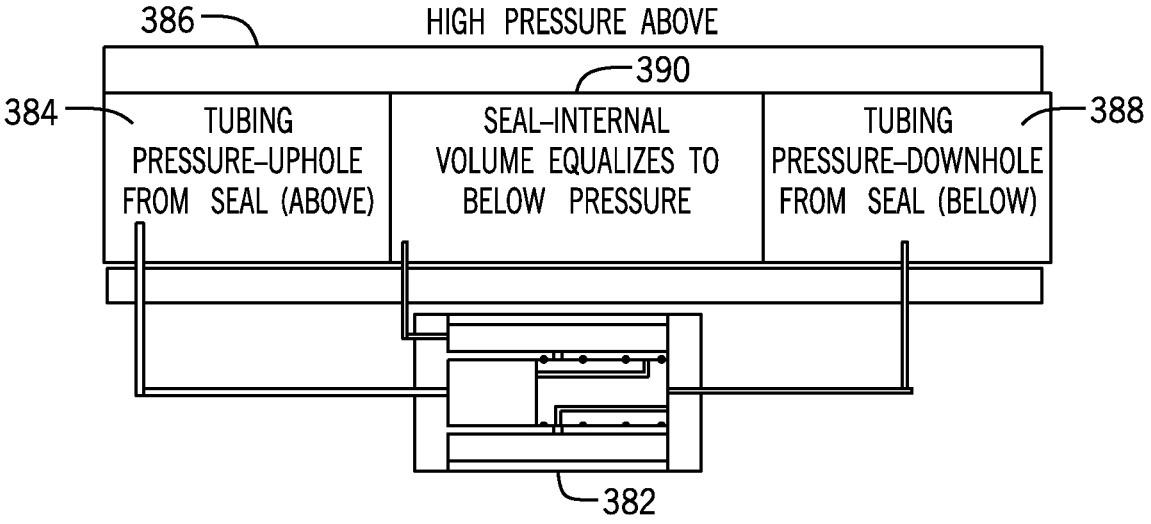
FIGS. 39A and 39B are schematic diagrams of a pressure equalizing system configured to eliminate hydrostatic pressure between the elastomer of FIGS. 37 through 38C and an apparatus, in accordance with embodiments of the present disclosure.
Figure 39B:
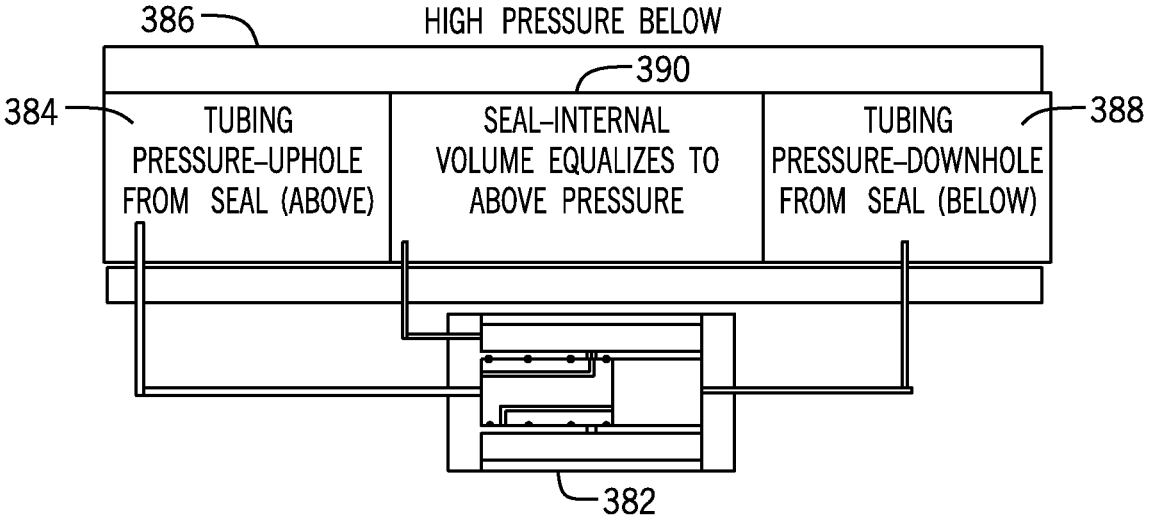

As illustrated in FIGS. 39A and 39B, in certain embodiments, a bi-directional shuttling valve 382 (e.g., pressure equalizing valve) may be used, which is hydraulically coupled to both an uphole volume 384 within a mandrel 386 (or tubing) and a downhole volume 388 within the mandrel 386. As described above, the separate uphole and downhole volumes 384, 388 are created by the seal created by the seal component 380 (e.g., elastomer) via expansion of the apparatus 300 described herein. In certain embodiments, the valve 382 may govern pressure within the apparatus 300 under the seal component 380 and the plurality of support elements 306. In certain embodiments, the valve 382 may shuttle according to the pressure differential between the uphole and downhole volumes 384, 388 to eliminate hydrostatic pressure from acting on the seal created by the elastomer 380. In particular, as illustrated in FIGS. 39A and 39B, in certain embodiments, the valve 382 may shuttle to a first position or to a second position to allow the lowest pressure of the uphole and downhole volumes 384, 388 into an internal volume 390 under the seal created by the elastomer 380. For example, as illustrated in FIG. 39A, if the higher pressure is in the uphole volume 384 and the lower pressure is in the downhole volume 388, the valve 382 may shuttle to the first position allow the lower pressure of the downhole volume 388 into the internal volume 390 under the seal created by the seal component 380.

In certain embodiments, the pressure equalizing valve 382 may include a downhole port fluidly connected to the downhole volume 388 to fluidly couple the pressure equalizing valve 382 to the downhole volume 388. Conversely, as illustrated in FIG. 39B, if the higher pressure is in the downhole volume 388 and the lower pressure is in the uphole volume 384, the valve 382 may shuttle to the second position to allow the lower pressure of the uphole volume 384 into the internal volume 390 under the seal created by the seal component 380. In certain embodiments, the pressure equalizing valve 382 may include an uphole port fluidly connected to the uphole volume 384 to fluidly couple the pressure equalizing valve 382 to the uphole volume 384. Moreover, in certain embodiments, the pressure equalizing valve 382 may include an internal volume port fluidly connected to the internal volume 390 of the apparatus 300. Thus, the internal volume 390 of the apparatus 300 may be fluidly coupled to the uphole volume 384 and the downhole volume 388 via the pressure equalizing valve 382. In certain embodiments, the pressure equalizing valve 382 may be disposed within the internal volume 390 of the apparatus 300. In other embodiments, the pressure equalizing valve 382 may be disposed external to the internal volume 390 of the apparatus 300.

The embodiments described herein may be used to provide an anti-extrusion ring or back-up ring for a wide range of expanding, radially expanding or swelling elements. For example, the apparatus may be used as an anti-extrusion or back-up ring for compressible, inflatable and/or swellable packer systems. Alternatively, or in addition to, the expansion apparatus may provide support or back-up for any suitable flow barrier or seal element in the fluid conduit. This may function to improve the integrity of the fluid barrier or seal, and/or enable a reduction in the axial length of the seal element or flow barrier without compromising its functionality. A particular advantage is that equipment incorporating the expansion apparatus described herein may be rated to a higher maximum working pressure.

In the foregoing embodiments, where the expanding and collapsing apparatus is used to create a seal, the seal is typically disposed between the expanding ring structures (and the elastomer sheath) and the tubular within which the expanding and collapsing apparatus is disposed. In alternative embodiments (not illustrated), an expanding ring structure can be used to provide a seal, or at least a restrictive flow barrier directly. To facilitate this, the elements that are assembled together to create the ring structures may be formed from metal or a metal alloy that is coated with a polymeric, elastomeric or rubber material. An example of such a material is a silicone polymer coating. All surfaces of the elements may be coated, for example by a dipping or spraying process, and the mutually supportive arrangement of the elements keeps them in compression in their operating condition. This enables the ring structures themselves to function as flow barriers, and in some applications, the barrier created is sufficient to seal against differential pressures to create a fluid tight seal.

A further application of the embodiments described herein is to a fluid conduit patch tool and apparatus. A typical patching application requires the placement and setting of a tubular section over a damaged part of a fluid conduit (such as a wellbore casing). A patch tool includes a tubular and a pair of setting mechanisms at axially separated positions on the outside of the conduit for securing the tubular to the inside of the fluid conduit. It is desirable for the setting mechanisms to provide an effective flow barrier, but existing patch systems are often deficient in providing a fluid-tight seal with the inner surface of the fluid conduit.

A patch tool incorporating the expanding and collapsing apparatus described herein has the advantage of high expansion for a slim outer diameter profile, which enables the tool to be run through a restriction in the fluid conduit, to patch a damaged part of the conduit that has a larger inner diameter than the restriction. For example, the patching tool could be run through a part of the fluid conduit that has already been patched.

In a further alternative embodiment (not illustrated), the characteristics of the expanding/collapsing apparatus may be exploited to provide a substrate that supports a seal or another deformable element. As described herein, the expanded ring structures provide a smooth circular cylindrical surface and/or a smooth conical surface at their optimum expanded conditions. This facilitates their application as a functional endo-skeleton for a surrounding sheath. As described in greater detail herein, a deformable elastomeric sheath may be provided over an expanding ring structure. When in its collapsed condition, the sheath is supported by the collapsed ring structures. The ring structures are deployed in the manner described with reference to FIGS. 10A through 11D, against the retaining force of the circumferential spring element and any additional retaining force provided by the sheath, and the sheath is deformed to expand with the ring structure into contact with the surrounding surface. The sheath is sandwiched between the smooth outer surface of the ring structure and the surrounding surface to create a seal. It will be appreciated that the apparatus described herein may be used as an endo-skeleton to provide structural support for components other than deformable sheaths, including tubulars, expanding sleeves, locking formations and other components in fluid conduits or wellbores.

The expansion apparatus described herein may be applied to a high expansion packer or plug and, in particular, to a high expansion retrievable bridge plug. The ring structure may be arranged to provide a high-expansion anti-extrusion ring for a seal element of a plug. Alternatively, or in addition to, elements of ring structures of the apparatus may be provided with engaging means to provide anchoring forces that resist movement in upward and/or downward directions. The elements of the rings structure may therefore function as slips, and may in some cases function as an integrated slip and anti-extrusion ring. Advantages over previously proposed plugs include the provision of a highly effective anti-extrusion ring; providing an integrated slip and anti-extrusion assembly, which reduces the axial length of the tool; providing slips with engaging surfaces that extend around the entire circumference of the tool to create an enlarged anchoring surface, which enables a reduction in the axial length of the slips for the same anchoring force; the ability of slips of a ring structure of one particular size to function effectively over a wider range of tubular inner diameters and tubing weights/wall thicknesses. Alternatively, or in addition to, the apparatus may be used to anchor any of a wide range of tools in a wellbore, by providing the surfaces of the element with engaging means to provide anchoring forces that resist movement in upward and/or downward directions.

Variations to embodiments described herein may include the provision of functional formations on the basic elements in various arrangements. These may include knurls and sockets for location and support, hooks, balls and sockets or knuckles and sockets for axial connection, and/or pegs and recesses to prevent relative rotation of the elements with respect to one another and/or with respect to the underlying structure of the apparatus.

The embodiments described herein also have benefits in creating a seal and/or filling an annular space, and an additional example application is to downhole locking tools. A typical locking tool uses one or more radially expanding components deployed on a running tool. The radially expanding components engage with a pre-formed locking profile at a known location in the wellbore completion. A typical locking profile and locking mechanism includes a recess for mechanical engagement by the radially expanding components of the locking tool. A seal bore is typically provided in the profile, and a seal on the locking tool is designed to seal against the seal bore.

One advantage of the application of the embodiments described herein to a locking mechanism is that the locking mechanism may be provided with an integrated seal element between two expanding ring structures, and does not require a seal assembly at an axially separated point. This enables a reduction in the length of the tool. The integrated seal is surrounded at its upper and lower edges by the surfaces of the ring structures, which avoid extrusion of the seal.

In addition, in certain embodiments, each of the ring structures provides a smooth, unbroken circumferential surface, which may engage a locking recess, providing upper and lower annular surfaces in a plane perpendicular to the longitudinal axis of the bore. This annular surface may be relatively smooth and unbroken around the circumference of the ring structures and, therefore, the lock is in full abutment with upper and lower shoulders defined in the locking profile. This is in contrast with conventional locking mechanisms that may only have contact with a locking profile at a number of discrete, circumferentially-separated locations around the device. The increased surface contact can support larger axial forces being directed through the lock. Alternatively, in other embodiments, an equivalent axial support may be provided in a lock, which has reduced size and/or mass.

Another advantage of the embodiments described herein is that a seal bore (i.e., the part of the completion with which the elastomer creates a seal) may be recessed in the locking profile. The benefit of such configuration is that the seal bore is protected from the passage of tools and equipment through the locking profile. This avoids impact with the seal bore that would tend to damage the seal bore, reducing the likelihood of reliably creating a successful seal.

Similar benefits may be delivered in latching arrangements used in connectors, such as so called "quick connect" mechanisms used for latched connection of tubular components. A significant advantage in connection system applications is that the expansion apparatus forms a solid and relatively smooth ring in an expanded latched position. An arrangement of radially split elements would, when expanded, form a ring with spaces between elements around their sides. In contrast, the provision of a continuous engagement surface on the expansion ring, which provides full annular contact with the recess, results in a latch capable of supporting larger axial forces. In addition, by minimizing or eliminating gaps between elements, the apparatus is less prone to ingress of foreign matter, which could impede the collapsing action of the mechanism. These principles may also be applied to subsea connectors such as tie-back connectors, with optional hydraulic actuation of their release mechanism.

Additional applications of the principles of the embodiments described herein include variable diameter tools, examples of which include variable diameter drift tools and variable diameter centralizing tools. The position of a wedge member and a cooperating surface may be adjusted continuously or to a number of discrete positions, to provide a continuously variable diameter, or a number of discrete diameters.

The embodiments described herein provide an expanding and collapsing apparatus and methods of use. In certain embodiments, the apparatus includes a plurality of elements assembled together to form a ring structure around a longitudinal axis. The ring structure is operable to be moved between an expanded condition and a collapsed condition by movement of the plurality of elements on actuation by an axial force. In certain embodiments, at least one set of structural elements each having a first end and a second end are operable to move between the expanded condition and the collapsed condition by movement of the first end in an axial direction, and by movement of the second end in at least a radial dimension. The plurality of elements includes at least one set of elements operable to be moved between the expanded and collapsed conditions by sliding with respect to one another in a direction tangential to a circle concentric with the ring structure.

In certain embodiments, the expanding and collapsing ring includes a plurality of elements assembled together to form a ring structure oriented in a plane around a longitudinal axis. In certain embodiments, the plurality of elements includes at least one set of structural elements extending longitudinally on the apparatus and operable to slide with respect to one another, wherein the sliding movement in a selected plane perpendicular to the longitudinal axis is tangential to a circle in the selected plane and concentric with the longitudinal axis.

As such, as described in detail herein, in certain embodiments, an apparatus includes a plurality of elements assembled together to form a ring structure around a longitudinal axis, wherein the ring structure is operable to be moved between an expanded condition and a collapsed condition by movement of the plurality of elements, wherein the plurality of elements includes at least one set of structural elements each having a first end and a second end, wherein the structural elements are operable to move between the expanded condition and the collapsed condition by movement of the first end in an axial direction, and by movement of the second end in at least a radial dimension, and wherein the plurality of elements includes at least one set of elements operable to be moved between the expanded and collapsed conditions by sliding with respect to one another in a direction tangential to a circle concentric with the ring structure. In certain embodiments, the second end may be operable to move in a radial direction and an axial direction of the apparatus. In addition, in certain embodiments, the structural elements may be operable to move in a circumferential direction of the apparatus.

In certain embodiments, the structural elements extend longitudinally on the apparatus. In certain embodiments, an outermost dimension of the second end of a structural element may be disposed at a radial distance from the longitudinal axis that is greater than a radial distance of an outermost dimension of the first end when the apparatus is in the expanded condition and/or a partially expanded condition. Alternatively, or in addition to, an outermost dimension of the second end of a structural element may be disposed at a radial distance from the longitudinal axis, which is greater than a radial distance of an outermost dimension of the first end when the apparatus is in the collapsed condition.

In certain embodiments, the apparatus may include a retaining ring that connects to the first ends of the structural elements. In certain embodiments, the retaining ring may be moveable axially on the apparatus, and may be operable to move the first end of the structural elements axially on the apparatus.

In certain embodiments, the set of structural elements may together form a substantially conical structure in an expanded condition (e.g., including a partially, fully, or substantially fully expanded condition). Alternatively, or in addition to, the set of structural elements may together form a substantially conical structure in the collapsed condition and/or a partially expanded condition. In certain embodiments, the substantially conical structure may be a truncated conical structure, and/or may define a partially convex outer profile in at least its collapsed condition.

In certain embodiments, the plurality of elements includes at least one set of ring elements, distinct from the set of structural elements, operable to be moved between the expanded and collapsed conditions by sliding with respect to one another in a direction tangential to a circle concentric with the ring structure. In certain embodiments, the set of structural elements may be directly or indirectly connected to the set of ring elements, and may together be operable to be moved between the expanded condition and the collapsed condition. In certain embodiments, the structural elements may include structural ring elements, operable to be moved between the expanded and collapsed conditions by sliding with respect to one another in a direction tangential to a circle concentric with the ring structure.

In certain embodiments, the ring elements and/or structural ring elements may describe an angle at an outer surface of the ring structure ($\theta_1$) of approximately 45 degrees or less. Such a configuration corresponds to eight or more ring elements assembled together to form the ring structure. In other embodiments, the described angle is approximately 30 degrees or less, corresponding to twelve or more ring elements assembled together to form the ring. In other embodiments, the described angle is in the range of approximately 10 degrees to approximately 20 degrees, corresponding to eighteen to thirty-six elements assembled together to form the ring. For example, in certain embodiments, the described angle is approximately 15 degrees, corresponding to twenty-four ring elements assembled together to form the ring structures.

In certain embodiments, the ring elements may include first and second contact surfaces, which may be oriented on first and second planes. In certain embodiments, the first and second orientation planes may intersect or meet (i.e., be a tangent to) an inner surface of the ring structure formed by the segments at first and second lines. In certain embodiments, the orientation planes may be tangential to the inner surface of the ring structure in its expanded condition. In other embodiments, the inner surface of the ring structure may have a truncated (increased) inner diameter, and the orientation planes may be tangential to a circle with a smaller diameter than the inner surface of the ring structure. The orientation planes may, therefore, intersect the inner surface of the ring structure in its expanded condition at an angle (which may be defined as $\theta_2$) between a radial plane from the center of the ring structure and the intersection or tangent point.

Where the structural elements extend longitudinally on the apparatus, the structural elements may be operable to slide with respect to one another, with the sliding movement in a selected plane perpendicular to the longitudinal axis being tangential to a circle in the selected plane and concentric with the longitudinal axis. In certain embodiments, the structural elements extend longitudinally on the apparatus and are operable to slide with respect to one another, with the sliding movement in any selected plane along the length of the structural element and perpendicular to the longitudinal axis being tangential to a circle in the selected plane and concentric with the longitudinal axis.

In certain embodiments, the apparatus may include one or more sets of structural ring elements, operable to be moved between the expanded and collapsed conditions by sliding with respect to one another in a direction tangential to a circle concentric with the ring structure, and one or more sets of ring elements, distinct from the one or more sets of structural ring elements. In certain embodiments, the structural element may be pivotally connected to a ring element at its second end. In certain embodiments, the structural element may be connected to a ring element by a connection configured to enable the transfer of a tensile force between the structural element and a ring element. This enables a tension to be pulled between the structural element and a ring element (or vice versa), which may assist with retraction of the apparatus from an expanded or partially expanded condition. The structural element may, for example, be connected to a ring element by a ball and socket or knuckle and socket connection. Where the apparatus includes a retaining ring, the structural element may be connected to the retaining ring at its first end, by a connection that enables the transfer of a tensile force between the structural element and the retaining ring, for example, by a ball and socket or knuckle and socket connection. Therefore, a tension may be pulled between the structural element and the retaining ring (or vice versa), which may assist with retraction of the apparatus from an expanded or partially expanded condition.

Where the set of structural elements together form a substantially conical structure, the substantially conical structure may include openings in the conical surface between the structural elements. In such an embodiment, a structural element may include a strut or spoke, and/or the apparatus may include a plurality of struts or spokes circumferentially distributed about the longitudinal axis.

In certain embodiments, the substantially conical structure may include a substantially continuous conical surface in the expanded condition, or a partially expanded or substantially expanded condition. In addition, in certain embodiments, the substantially conical structure may include a hollow cone. In addition, in certain embodiments, the substantially conical structure may include a substantially or fully uniform wall thickness. Alternatively, or in addition to, the substantially conical structure may include a tapering wall thickness. In certain embodiments, the substantially conical structure may include a cylindrical portion extending from its flared end.

In certain embodiments, the hollow cone may be formed from the set of structural ring elements in the expanded or a substantially expanded condition, wherein each of the structural ring elements may be a segment of a cone. In certain embodiments, the structural ring elements may extend longitudinally on the apparatus and may be operable to slide with respect to one another, with the sliding movement in any selected plane along the length of the structural element and perpendicular to the longitudinal axis being tangential to a circle in the selected plane and concentric with the longitudinal axis.

In certain embodiments, the structural ring element may be pivotally connected to a ring element at its second end. In certain embodiments, the structural ring element may be pivotally connected to a ring element by a ball and socket or knuckle and socket connection. Where the apparatus includes a retaining ring, the structural ring element may be pivotally connected to the retaining ring at its first end by a connection that enables the transfer of a tensile force between the structural element and the retaining ring, for example, by a ball and socket or knuckle and socket connection. Therefore, a tension may be pulled between the structural element and the retaining ring (or vice versa), which may assist with retraction of the apparatus from an expanded or partially expanded condition.

In certain embodiments, the apparatus may include a first set of structural elements, a second set of structural elements, and a set of ring elements distinct from the structural elements. In certain embodiments, the first set of structural elements may be connected to the set of ring elements at a first axial side of the set of ring elements, and the second set of structural elements may be connected to the set of ring elements at a second axial side of the set of ring elements. In certain embodiments, the first and/or second set of structural elements may include structural ring elements, which may be segments of a cone.

In certain embodiments, the ring elements may include first and second contact surfaces, which may be oriented on first and second planes. The first and second orientation planes may intersect or meet (i.e., be a tangent to) an inner surface of the ring structure formed by the segments at first and second lines. In certain embodiments, the orientation planes may be tangential to the inner surface of the ring structure in its expanded condition. The orientation planes of the first and second contact surfaces may intersect on a radial plane P, which bisects the radial planes at the tangent points (i.e., is at an angle of $\theta_1/2$ to both). This intersection plane P may define the expanding and collapsing path of the cone segment.

In certain embodiments, the collapsed condition may be a first condition of the apparatus, and the expanded condition may be a second condition of the apparatus. Thus, the apparatus may be normally collapsed, and may be actuated to be expanded. Alternatively, in other embodiments, the expanded condition may be a first condition of the apparatus, and the collapsed condition may be a second condition of the apparatus. Thus, the apparatus may be normally expanded, and may be actuated to be collapsed.

In certain embodiments, the ring structure may include one or more ring surfaces, which may be presented to an auxiliary surface, for example, the surface of a tubular, when actuated to an expanded condition or a collapsed condition. In certain embodiments, the one or more ring surfaces may include a ring surface, which is parallel to the longitudinal axis of the apparatus. In certain embodiments, the ring surface may be an outer ring surface, and may be a substantially cylindrical surface. In certain embodiments, the ring surface may be arranged to contact or otherwise interact with an inner surface of a tubular or bore. Alternatively, in other embodiments, the ring surface may be an inner surface of the ring structure, and may be a substantially cylindrical surface. In certain embodiments, the ring surface may be arranged to contact or otherwise interact with an outer surface of a tubular or cylinder. In certain embodiments, the ring surface may be substantially smooth. Alternatively, in other embodiments, the ring surface may be profiled, and/or may be provided with one or more functional formations thereon, for interacting with an auxiliary surface.

In the collapsed condition, in certain embodiments, the ring elements may be arranged generally at collapsed radial positions, and may define a collapsed outer diameter and inner diameter of the ring structure. In the expanded condition, in certain embodiments, the ring elements may be arranged generally at expanded radial positions, and may define an expanded outer diameter and inner diameter of the ring structure. In certain embodiments, the ring surface may be located at or on the expanded outer diameter of the ring structure, or may be located at or on the collapsed inner diameter of the ring structure.

In the collapsed condition, in certain embodiments, the elements may occupy a collapsed annular volume, and in the expanded condition the elements may occupy an expanded annular volume. In certain embodiments, the collapsed annular volume and the expanded annular volume may be discrete and separated volumes, or the volumes may partially overlap. In certain embodiments, the ring elements may be configured to move between their expanded and collapsed radial positions in a path, which is tangential to a circle described around and concentric with the longitudinal axis.

In certain embodiments, each ring element of the ring structure may include a first contact surface and second contact surface respectively in abutment with first and second adjacent elements. In certain embodiments, the ring elements may be configured to slide relative to one another along their respective contact surfaces. In certain embodiments, the first contact surface and/or the second contact surface may be oriented tangentially to a circle described around and concentric with the longitudinal axis. In addition, in certain embodiments, the first contact surface and the second contact surface are non-parallel. In addition, in certain embodiments, the first contact surface and the second contact surface may converge towards one another in a direction towards an inner surface of the ring structure (and may therefore diverge away from one another in a direction away from an inner surface of the ring structure).

In certain embodiments, at least some of the ring elements may be provided with interlocking profiles for interlocking with an adjacent element. In certain embodiments, the interlocking profiles are formed in the first and/or second contact surfaces. In certain embodiments, a ring element may be configured to interlock with a contact surface of an adjacent element. Such interlocking may prevent or restrict separation of assembled adjacent elements in a circumferential and/or radial direction of the ring structure, while enabling relative sliding movement of adjacent elements.

In certain embodiments, at least some of (or, even all of) the ring elements assembled to form a ring are identical to one another, and each includes an interlocking profile, which is configured to interlock with a corresponding interlocking profile on another ring element. In certain embodiments, the interlocking profiles may include at least one recess such as groove, and at least one protrusion, such as a tongue or a pin, configured to be received in the groove. In certain embodiments, the interlocking profiles may include at least one dovetail recess and dovetail protrusion.

In certain embodiments, the first and second contact surfaces of a ring element may be oriented on first and second planes, which may intersect an inner surface of the ring at first and second intersection lines, such that a sector of an imaginary cylinder is defined between the longitudinal axis and the intersection lines. In certain embodiments, the central angle of the sector may be approximately 45 degrees or less. Such a configuration corresponds to eight or more ring elements assembled together to form the ring structure.

In certain embodiments, the central angle of the sector is approximately 30 degrees or less, corresponding to twelve or more ring elements assembled together to form the ring. For example, in certain embodiments, the central angle of the sector is in the range of approximately 10 degrees to approximately 20 degrees, corresponding to eighteen to thirty-six ring elements assembled together to form the ring. In particular, in certain embodiments, the central angle of the sector is approximately 15 degrees, corresponding to twenty-four ring elements assembled together to form the ring structure.

In certain embodiments, the structural elements may include structural ring elements, and may be defined by the same central angles as the ring elements. In certain embodiments, an angle described between the first contact and second contact surfaces corresponds to the central angle of the sector. In certain embodiments, an angle described between the first contact and second contact surfaces may be in the range of approximately 10 degrees to approximately 20 degrees, or may be in the range of approximately 15 degrees, corresponding to twenty-four elements assembled together to form the ring structure.

In certain embodiments, the apparatus includes a support surface for the ring structure. In certain embodiments, the support surface may be the outer surface of a mandrel or tubular. The support surface may support the ring structure in a collapsed condition of the apparatus. In other embodiments, the support surface may be the inner surface of a mandrel or tubular. The support surface may support the ring structure in an expanded condition of the apparatus.

In certain embodiments, the apparatus may be operated in its expanded condition, and in other embodiments, the apparatus may be operated in its collapsed condition. In certain embodiments, at least some of the elements forming the ring structure may be mutually supportive in an operating condition of the apparatus. Where the operating condition of the apparatus is in its expanded condition (i.e., when the apparatus is operated in its expanded condition), the apparatus may include a substantially solid cylindrical ring structure in its expanded condition, and the ring elements may be fully mutually supported.

In certain embodiments, a substantially solid cylindrical ring structure of the apparatus may be supported by one or more substantially conical structures formed from the structural elements. In certain embodiments, the apparatus may include one or more substantially conical structures in its expanded condition, and the structural elements may be fully mutually supported. Where the operating condition of the apparatus is in its collapsed condition (i.e., when the apparatus is operated in its collapsed condition), the ring structure may be a substantially solid ring structure in its collapsed condition, and the ring elements may be fully mutually supported.

In certain embodiments, the apparatus may include a formation configured to impart a radial expanding or collapsing force component to the structural elements of a ring structure from an axial actuation force. In other embodiments, the apparatus may include a pair of formations configured to impart a radial expanding or collapsing force component to the structural elements of a ring structure from an axial actuation force. In certain embodiments, the formation (or formations) may include a wedge or wedge profile, and may include a cone wedge or wedge profile.

In certain embodiments, the apparatus may include a biasing means, which may be configured to bias the ring structure to one of its expanded or collapsed conditions. In certain embodiments, the biasing means may include a circumferential spring, a garter spring, or a spiral retaining ring. In certain embodiments, the biasing means may be arranged around an outer surface of a ring structure, to bias it towards a collapsed condition, or may be arranged around an inner surface of a ring structure, to bias it towards an expanded condition. One or more elements may include a formation such as a groove for receiving the biasing means. For example, in certain embodiments, grooves in the elements may combine to form a circumferential groove in the ring structure. Multiple biasing means may be provided on the ring structure.

In certain embodiments, the apparatus may include a plurality of elements assembled together to form a ring structure around a longitudinal axis, wherein the ring structure is operable to be moved between an expanded condition and a collapsed condition by movement of the plurality of elements, wherein the plurality of elements includes at least one set of structural elements extending longitudinally on the apparatus and operable to slide with respect to one another, and wherein the sliding movement in a selected plane perpendicular to the longitudinal axis is tangential to a circle in the selected plane and concentric with the longitudinal axis.

In certain embodiments, the structural elements extend longitudinally on the apparatus and are operable to slide with respect to one another, with the sliding movement in any selected plane along the length of the structural element and perpendicular to the longitudinal axis being tangential to a circle in the selected plane and concentric with the longitudinal axis.

In certain embodiments, the structural elements may each have a first end and a second end, wherein the structural elements are operable to move between the expanded condition and the collapsed condition by movement of the first end in an axial direction, and by movement of the second end in at least a radial dimension, and wherein the plurality of elements includes at least one set of elements operable to be moved between the expanded and collapsed conditions by sliding with respect to one another in a direction tangential to a circle concentric with the ring structure.

In certain embodiments, the apparatus may include a plurality of elements assembled together to form a ring structure around a longitudinal axis, wherein the ring structure is operable to be moved between an expanded condition and a collapsed condition, and wherein in the expanded condition, the plurality of elements combine to form a conical structure having a substantially smooth conical outer surface.

In certain embodiments, the substantially smooth conical outer surface may be substantially unbroken. For example, the ring structure may include a pair of conical structures having substantially smooth conical outer surfaces. Thus, in certain embodiments, one or more flanks or faces of the ring structure, which are the surfaces presented in the longitudinal direction, may have smooth surfaces.

In certain embodiments, the apparatus may also include a solid ring structure having a substantially smooth circular profile in a plane perpendicular to the longitudinal axis. In addition, in certain embodiments, the plurality of elements may include at least one set of structural elements. In addition, in certain embodiments, the plurality of elements may include at least one set of elements operable to be moved between the expanded and collapsed conditions by sliding with respect to one another in a direction tangential to a circle concentric with the ring structure.

Where the structural elements extend longitudinally on the apparatus, they may be operable to slide with respect to one another, with the sliding movement in a selected plane perpendicular to the longitudinal axis being tangential to a circle in the selected plane and concentric with the longitudinal axis. In an embodiment, the structural elements extend longitudinally on the apparatus and are operable to slide with respect to one another, with the sliding movement in any selected plane along the length of the structural element and perpendicular to the longitudinal axis being tangential to a circle in the selected plane and concentric with the longitudinal axis.

In certain embodiments, the structural elements may each have a first end and a second end, wherein the structural elements are operable to move between the expanded condition and the collapsed condition by movement of the first end in an axial direction, and by movement of the second end in at least a radial dimension, and wherein the plurality of elements includes at least one set of elements operable to be moved between the expanded and collapsed conditions by sliding with respect to one another in a direction tangential to a circle concentric with the ring structure.

In certain embodiments, the apparatus may include a plurality of elements assembled together to form a first ring structure around a longitudinal axis, and a plurality of elements assembled together to form a second ring structure around a longitudinal axis, wherein the first and second ring structures are operable to be moved between expanded conditions and collapsed conditions, wherein in their expanded conditions, the plurality of elements of the first and second ring structures combine to form first and second conical structures, and wherein at least one of the first and second ring structures provides mechanical support to the other of the first and second ring structures in their expanded conditions.

In certain embodiments, a fluid barrier apparatus may include the expanding and collapsing apparatus described herein. In certain embodiments, the fluid barrier apparatus may include a sealing apparatus for a borehole or conduit, and may be configured to hold a pressure differential across the sealing apparatus.

In certain embodiments, a sealing assembly for a borehole or conduit may include at least one expanding and collapsing apparatus as described herein, wherein the at least one expanding and collapsing apparatus is arranged to provide mechanical support to the sealing element in its expanded condition. In certain embodiments, the sealing assembly may be disposed between the first and second expanding and collapsing apparatus, and may be mechanically supported by the first and second expanding and collapsing apparatus in their expanded conditions.

In certain embodiments, an oilfield tool may include the apparatus described herein. In certain embodiments, the oilfield tool may be a downhole tool. In other embodiments, the oilfield tool may include a wellhead tool. In certain embodiments, downhole tool may include a downhole tool selected from the group consisting of a plug, a packer, an anchor, a tubing hanger, or a downhole locking tool. In certain embodiments, plug may be a bridge plug, and may be a retrievable bridge plug. In other embodiments, the plug may be a permanent plug.

In certain embodiments, a variable diameter downhole tool may include an apparatus as described herein. In certain embodiments, the downhole tool may be selected from the group consisting of a wellbore centralizer, a wellbore broach tool, and a wellbore drift tool. In other embodiments, a connector system may include a first connector and a second connector, wherein one of the first and second connectors includes the apparatus described herein. In other embodiments, a patch apparatus for a fluid conduit or tubular may include the apparatus described herein.

In certain embodiments, a method of expanding or collapsing an expanding and collapsing apparatus may include providing a plurality of elements assembled together to form a ring structure around a longitudinal axis, wherein the plurality of elements includes at least one set of structural elements each having a first end and a second end, moving the first ends of the structural segments in an axial direction, and moving the second ends of the structural segments in at least a radial dimension; and moving at least one set of elements between the expanded and collapsed conditions by sliding them with respect to one another in a direction tangential to a circle concentric with the ring structure.

In certain embodiments, a method of expanding or collapsing an expanding and collapsing apparatus may include providing a plurality of elements assembled together to form a first ring structure around a longitudinal axis, and a plurality of elements assembled together to form a second ring structure around a longitudinal axis; and moving the first and second ring structures between expanded conditions and collapsed conditions, wherein in their expanded conditions, the plurality of elements of the first and second ring structures combine to form first and second conical structures, and wherein at least one of the first and second ring structures provides mechanical support to the other of the first and second ring structures in their expanded conditions.

In an embodiment, an expanding and collapsing apparatus comprises a plurality of elements assembled together to form a ring structure around a longitudinal axis, wherein the ring structure is configured to be moved between an expanded condition and a collapsed condition by movement of the plurality of elements. The plurality of elements comprises a plurality of ring elements configured to be moved between the expanded and collapsed conditions by sliding with respect to one another in a direction tangential to a circle concentric with the ring structure, a plurality of support elements, each support element having a first end and a second end, wherein the plurality of support elements are configured to move between the expanded condition and the collapsed condition by movement of the first end in an axial direction, and by movement of the second end in at least a radial direction, and wherein each support element of the plurality of support elements comprises a first interlocking feature and a second interlocking feature, wherein the first interlocking feature is configured to interlock with the second interlocking feature of an adjacent support element.

The first interlocking feature comprises at least one protrusion extending from an outer surface of a respective support element.

The second interlocking feature comprises at least one recess in a lower surface of a respective support element.

The first interlocking feature is configured to interlock with the second interlocking feature of the adjacent support element in the expanded condition.

The first interlocking feature is configured to at least partially interlock with the second interlocking feature of the adjacent support element in the collapsed condition.

The first interlocking feature comprises at least one protrusion configured to extend from an outer surface of a respective support element along a respective protrusion guide path, wherein the respective protrusion guide path follows a portion of a respective upper guide circle configured to pass through the respective support element, and wherein the respective upper guide circle comprises an upper origin point disposed in a location offset from the respective support element.

The second interlocking feature comprises at least one recess configured to follow a respective recess guide path through at least a portion of the respective support element, wherein the respective recess guide path follows a portion of a respective lower guide circle configured to pass through the respective support element, and wherein the respective lower guide circle comprises a lower origin point disposed in a location offset from the respective support element.

The respective upper guide circle and the respective lower guide circle comprise a substantially similar diameter, and wherein the upper origin point of the respective upper guide circle is offset from the lower origin point of the respective lower guide circle.

In an embodiment, an expanding and collapsing apparatus comprises a plurality of support elements, each support element configured to couple to a respective ring element of a plurality of ring elements, wherein the plurality of ring elements and the plurality of support elements form a ring structure around a longitudinal axis configured to move between expanded and collapsed conditions, wherein each support element comprises a first interlocking feature and a second interlocking feature, and wherein the first interlocking feature is configured to interlock with the second interlocking feature of an adjacent support element.

The first interlocking feature is disposed on an outer surface of a respective support element.

The first interlocking feature comprises at least one protrusion extending out of the outer surface of the respective support element.

The second interlocking feature is disposed in an inner surface of a respective support element.

The second interlocking feature comprises a recess disposed in the inner surface of the respective support element.

The second interlocking feature is configured to receive the first interlocking feature of an adjacent support element.

In an embodiment, an expanding and collapsing apparatus comprises a plurality of elements assembled together to form a ring structure around a longitudinal axis, wherein the ring structure is configured to be moved between an expanded condition and a collapsed condition by movement of the plurality of elements. The plurality of elements comprises a plurality of ring elements configured to be moved between the expanded and collapsed conditions by sliding with respect to one another in a direction tangential to a circle concentric with the ring structure, and a plurality of support elements, each support element having an inner surface, an outer surface, a first end, and a second end, wherein the plurality of support elements are configured to move between the expanded condition and the collapsed condition by movement of the first end in an axial direction, and by movement of the second end in at least a radial direction. Each support element of the plurality of support elements comprises a partial wedge shape, wherein an angle between the inner surface and the outer surface forms a wedge angle, wherein each support element of the plurality of support elements comprises a first interlocking feature and a second interlocking feature, wherein the first interlocking feature is configured to interlock with the second interlocking feature of an adjacent support element, wherein the first interlocking feature comprises a plurality of protrusions extending from the outer surface of the respective support element, and wherein the second interlocking feature comprises a plurality of recesses in a lower surface of the respective support element.

Each protrusion of the plurality of protrusions is configured to extend from the outer surface of the respective support element along a respective protrusion guide path, wherein each protrusion guide path follows a portion of a respective upper concentric circle configured to pass through the respective support element, and wherein each respective upper concentric circle comprises a same upper origin point disposed in a location offset from the respective support element.

The upper origin point is disposed at an intersection of converging lines corresponding to an outer edge and an inner edge of the respective support element, wherein the outer edge corresponds to a first edge between the outer surface and the first end and the inner edge corresponds to a second edge between the inner surface and the first end.

Each recess of the plurality of recesses is configured to follow a respective recess guide path through at least a portion of the respective support element, wherein the respective recess guide path follows a portion of a respective lower guide circle configured to pass through the respective support element, and wherein the respective lower guide circle comprises a lower origin point disposed in a location offset from the respective support element.

Each support element is configured to rotate around a pivot axis of a retaining ring, and wherein the lower origin point is determined based at least in part by rotating the upper origin point about the pivot axis by an amount substantially equal to the wedge angle.

The first interlocking feature is configured to interlock with the second interlocking feature in the expanded condition, and wherein at least one protrusion of the plurality of protrusions and at least one recess of the plurality of recesses of adjacent support element are configured to disengage in the collapsed condition.

In an embodiment, an expanding and collapsing apparatus comprises a plurality of elements assembled together to form a ring structure around a longitudinal axis, wherein the ring structure is configured to be moved between an expanded condition and a collapsed condition by movement of the plurality of elements. The plurality of elements comprises a plurality of ring elements configured to be moved between the expanded and collapsed conditions by sliding with respect to one another in a direction tangential to a circle concentric with the ring structure, a plurality of support elements, each support element having a first end and a second end, wherein the plurality of support elements are configured to move between the expanded condition and the collapsed condition by movement of the first end in an axial direction, and by movement of the second end in at least a radial direction, and wherein each support element of the plurality of support elements comprises a respective support load feature, wherein the support load feature is configured to extend at least partially radially inward with respect to the ring structure.

The support load feature comprises a wedge shape extending inward from a portion of a respective support element with respect to the ring structure.

The support load feature comprises a first surface and a second surface disposed at an angle between 2 degrees and 45 degrees offset from the first surface.

The support load feature is configured to extend inward from an inner surface of a respective support element with respect to the ring structure, wherein the inner surface of the respective support element is configured to face radially inward with respect to the ring structure.

The support load feature is configured to extend inward from a lateral side of the inner surface in a direction substantially perpendicular to the inner surface.

The support load feature is configured to support a radial load exerted on the ring structure.

Each ring element of the plurality of ring elements comprises a respective ring load feature, wherein the ring load feature comprises a wedge shape configured to extend at least partially radially inward with respect to the ring structure.

In an embodiment, an expanding and collapsing apparatus comprises a plurality of elements assembled together to form a ring structure around a longitudinal axis, wherein the ring structure is configured to be moved between an expanded condition and a collapsed condition by movement of the plurality of elements. The plurality of elements comprises a plurality of ring elements configured to be moved between the expanded and collapsed conditions by sliding with respect to one another in a direction tangential to a circle concentric with the ring structure, a plurality of support elements, each support element having a first end and a second end, wherein the plurality of support elements are configured to move between the expanded condition and the collapsed condition by movement of the first end in an axial direction, and by movement of the second end in at least a radial direction, and wherein each ring element of the plurality of ring elements comprises a respective ring load feature, wherein the ring load feature is configured to extend at least partially radially inward with respect to the ring structure.

The ring load feature is configured to extend inward from a side portion of a respective ring element of the plurality of ring elements with respect to the ring structure.

The ring load feature is configured to extend inward from an inner portion of a respective ring element of the plurality of ring elements with respect to the ring structure.

Each ring element of the plurality of ring elements comprises a wedge shape having an inner surface and an outer surface configured to converge, wherein an angle between the inner surface and the outer surface forms a first wedge angle, and wherein the ring load feature is a wedge shaped feature having a first surface and a second surface disposed at a second wedge angle offset from the first surface.

The first wedge angle is within two degrees of the second wedge angle.

The first wedge angle is within one degree of the second wedge angle.

The first wedge angle may comprise the same angle as the second wedge angle.

The first surface and the second surface are configured to converge at a tip edge of the ring load feature, wherein the tip edge is disposed substantially perpendicular to an imaginary line that passes through a center axis of the ring structure.

The ring load feature is configured to contact an adjacent ring element of the plurality of ring elements to provide a positive stop that reduces over-deflection during operation.

The ring load feature is configured to increase a moment of inertia of a respective ring element in a load direction of the ring structure.

Each support element of the plurality of support elements comprises a respective support load feature, wherein the support load feature comprises a wedge shape configured to extend at least partially radially inward from a portion of a respective support element with respect to the ring structure.

The support load feature is configured to extend inward from a lateral side of an inner surface of a respective support element in a direction substantially perpendicular to the inner surface.

In an embodiment, an expanding and collapsing apparatus comprises a plurality of elements assembled together to form a ring structure around a longitudinal axis, wherein the ring structure is configured to be moved between an expanded condition and a collapsed condition by movement of the plurality of elements. The plurality of elements comprises a plurality of ring elements configured to be moved between the expanded and collapsed conditions by sliding with respect to one another in a direction tangential to a circle concentric with the ring structure, wherein each ring element of the plurality of ring elements comprises a respective ring load feature, wherein the ring load feature comprises a wedge shape configured to extend at least partially radially inward with respect to the ring structure, a plurality of support elements, each support element having a first end and a second end, wherein the plurality of support elements are configured to move between the expanded condition and the collapsed condition by movement of the first end in an axial direction, and by movement of the second end in at least a radial direction, wherein each support element of the plurality of support elements comprises a respective support load feature, wherein the support load feature comprises a wedge shape configured to extend at least partially radially inward with respect to the ring structure.

In an embodiment, an expanding and collapsing apparatus comprises a plurality of elements assembled together to form a ring structure around a longitudinal axis, wherein the ring structure is configured to be moved between an expanded condition and a collapsed condition by movement of the plurality of elements. The plurality of elements comprises a plurality of support elements, each support element having a first end and a second end, wherein the plurality of support elements are configured to move between the expanded condition and the collapsed condition by movement of the first end in an axial direction, and by movement of the second end in at least a radial direction, and a plurality of ring elements configured to be moved between the expanded and collapsed conditions by sliding with respect to one another in a direction tangential to a circle concentric with the ring structure. The expanding and collapsing apparatus further comprises a seal component disposed about the ring structure, wherein the seal component comprises a corrugated cross-sectional profile in the collapsed condition, and wherein the seal component comprises a circular cross-sectional profile in the expanded condition.

The seal component is configured to generate a seal between the ring structure and a tubular within which the expanding and collapsing apparatus is disposed.

The corrugated cross-sectional profile comprises a cross-sectional profile having contoured curves configured to correspond with features of the plurality of ring elements of the ring structure.

The corrugated cross-sectional profile comprises a plurality of outer curved bends and a plurality of inner curved bends, wherein each outer curved bend is positioned between a first inner curved bend and a second inner curved bend, and wherein each inner curved bend is positioned between a first outer curved bend and a second outer curved bend.

Each inner curved bend of the plurality of inner curved bends is disposed between an outer geometry of a first ring element of the plurality of ring elements and an inner geometry of a second ring element of the plurality of ring elements.

Each outer curved bend of the plurality of outer curved bends is disposed about an outer edge of a ring cap of a ring element of the plurality of ring elements.

Each inner curved bend comprises a first curvature and each outer curved bend comprises a second curvature in the collapsed condition, and wherein each inner curved bend and each outer curved bend comprise a third curvature in the expanded condition. The third curvature comprises a substantially similar radius of curvature as the circular cross-sectional profile.

A portion of each outer curved bend of the plurality of outer curved bends is configured to contact a tubular within which the expanding and collapsing apparatus is disposed in the collapsed condition.

The seal component comprises a compliant material such as an elastomer, a polymer, rubber, or some combination thereof.

The seal component comprises an outer surface configured to contact a tubular within which the expanding and collapsing apparatus is disposed to generate a seal between the ring structure and the tubular.

A length of the seal component in the collapsed condition is equal to or less than a circumference of the ring structure. A length of the seal component in the expanded condition is between 65-95 percent longer than the seal component in the collapsed condition.

In an embodiment, an expanding and collapsing apparatus comprises a plurality of elements assembled together to form a ring structure around a longitudinal axis, wherein the ring structure is configured to be moved between an expanded condition and a collapsed condition by movement of the plurality of elements. The plurality of elements comprises a plurality of support elements, each support element having a first end and a second end, wherein the plurality of support elements are configured to move between the expanded condition and the collapsed condition by movement of the first end in an axial direction, and by movement of the second end in at least a radial direction, and a plurality of ring elements configured to be moved between the expanded and collapsed conditions by sliding with respect to one another in a direction tangential to a circle concentric with the ring structure. The expanding and collapsing apparatus may further comprise a seal component disposed about the ring structure and configured to generate a seal between the ring structure and a tubular within which the expanding and collapsing apparatus is disposed, wherein the ring structure is configured to deform the seal component in the expanded condition to generate the seal.

The seal component comprises a corrugated cross-sectional profile in the collapsed condition, and wherein the seal component comprises a circular cross-sectional profile in the expanded condition.

Each ring element of the plurality of ring elements comprises a domed outer geometry configured to contact the seal component.

The ring structure comprises a smooth cylindrical surface in the expanded condition, and wherein the smooth cylindrical surface is configured to press the seal component against the tubular to generate the seal.

In an embodiment, an expanding and collapsing apparatus comprises a plurality of elements assembled together to form a ring structure around a longitudinal axis, wherein the ring structure is configured to be moved between an expanded condition and a collapsed condition by movement of the plurality of elements. The plurality of elements comprises a plurality of support elements, each support element having a first end and a second end, wherein the plurality of support elements are configured to move between the expanded condition and the collapsed condition by movement of the first end in an axial direction, and by movement of the second end in at least a radial direction, and a plurality of ring elements configured to be moved between the expanded and collapsed conditions by sliding with respect to one another in a direction tangential to a circle concentric with the ring structure. The expanding and collapsing apparatus may further comprise an elastomer disposed about the plurality of elements and configured to generate a seal between the plurality of elements and a tubular within which the expanding and collapsing apparatus is disposed, wherein the elastomer comprises a cross-sectional profile having contoured curves configured to correspond with features of the plurality of ring elements.

The elastomer comprises a corrugated cross-sectional profile in the collapsed condition, and wherein the elastomer comprises a circular cross-sectional profile in the expanded condition.

The ring structure is configured to contact the elastomer in the collapsed condition and the expanded condition, and wherein moving the ring structure from the collapsed condition to the expanded condition is configured to expand the elastomer from the corrugated cross-sectional profile to the circular cross-sectional profile.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The invention claimed is:

1. An expanding and collapsing apparatus, comprising:

a plurality of elements assembled together to form a ring structure around a longitudinal axis, wherein the ring structure is configured to be moved between an expanded condition and a collapsed condition by movement of the plurality of elements, wherein the plurality of elements comprises:

a plurality of support elements, each support element having a first end, a second end, and a first contact surface positioned between the first end and the second end, wherein the first contact surface comprises a first component of a lock, wherein the first end comprises a first hinge and the second end comprises a second hinge, and wherein the first hinge and the second hinge are configured to move the plurality of support elements between the expanded condition and the collapsed condition by movement of the first end in an axial direction, and by movement of the second end in at least a radial dimension; and a plurality of ring elements configured to be moved between the expanded and collapsed conditions by sliding with respect to one another in a direction tangential to a circle concentric with the ring structure, wherein each support element of the plurality of support elements is configured to interlock with an adjacent support element of the plurality of support elements via a second component of the lock disposed on a second contact surface of the adjacent support element.

2. The apparatus of claim 1, wherein a support hinge of each support element of the plurality of support elements is configured to couple to an element mating hinge of an adjacent ring element of the plurality of ring elements to form an upper hinge connection.

3. The apparatus of claim 2, wherein the support hinge and the element mating hinge are configured to rotate about an upper hinge axis of rotation.

4. The apparatus of claim 3, wherein each support element of the plurality of support elements comprises an inner surface, the first contact surface, an upper outer edge, and an upper inner edge, wherein the upper outer edge corresponds to an edge between the first contact surface and the second end and the upper inner edge corresponds to an edge between the inner surface and the second end, wherein the upper hinge axis of rotation extends along a line that is equidistant from the upper outer edge and the upper inner edge.

5. The apparatus of claim 1, wherein the plurality of ring elements are configured to interlock without any gaps in the expanded condition.

6. The apparatus of claim 1, wherein each support element of the plurality of support elements comprises a second contact surface comprising a second component of the lock, wherein the first component of the lock comprises a set of male interlock features and the second component of the lock comprises a set of female interlock features.

7. The apparatus of claim 2, wherein the upper hinge connection comprises a hinge and pin connection, a ball and socket connection, or a knuckle and socket connection.

8. The apparatus of claim 1, wherein each ring element of the plurality of ring elements is coupled to a first support element and a second support element via a first upper hinge connection and a second upper hinge connection.

9. An expanding and collapsing apparatus, comprising:

a plurality of elements assembled together to form a ring structure around a longitudinal axis, wherein the ring structure is configured to be moved between an expanded condition and a collapsed condition by movement of the plurality of elements, wherein the plurality of elements comprises:

a plurality of support elements, each support element having an upper end a lower end, and a contact surface extending from the upper end to the lower end, wherein the contact surface comprises a first interlock configured to interlock with a second interlock of an adjacent support element, and wherein the plurality of support elements are configured to move between the expanded condition and the collapsed condition by movement of the lower end in an axial direction, and by movement of the upper end in at least a radial dimension;

a plurality of ring elements configured to be moved between the expanded and collapsed conditions by sliding with respect to one another in a direction tangential to a circle concentric with the ring structure, wherein each ring element of the plurality of ring elements is supported by a respective upper end of the adjacent support element of the plurality of support elements in the expanded condition; and a retaining ring configured to couple to the plurality of support elements, wherein each support element of the plurality support elements is configured to couple to the retaining ring via a respective lower hinge connection.

10. The apparatus of claim 9, wherein a support hinge of a respective support element of the plurality of support elements is configured to couple to a ring mating hinge of the retaining ring to form the lower hinge connection.

11. The apparatus of claim 10, wherein the support hinge and the ring mating hinge are configured to rotate about a lower hinge axis of rotation.

12. The apparatus of claim 11, wherein each support element of the plurality of support elements comprises an inner surface, an outer surface, a lower outer edge, and a lower inner edge, wherein the lower outer edge corresponds to an edge between the outer surface and the upper end and the lower inner edge corresponds to an edge between the inner surface and the upper end, wherein the lower hinge axis of rotation extends along a line that is equidistant from the lower outer edge and the lower inner edge, and wherein the outer surface comprises the contact surface.

13. An expanding and collapsing apparatus, comprising:

a plurality of elements assembled together to form a ring structure around a longitudinal axis, wherein the ring structure is configured to be moved between an expanded condition and a collapsed condition by movement of the plurality of elements, wherein the plurality of elements comprises:

a plurality of support elements, each support element having a first end a second end, and a first contact surface disposed between the first end and the second end, wherein the first contact surface comprises a first component of a lock, wherein the first end is coupled to a first hinge and the second end is coupled to a second hinge, and wherein first hinge and the second hinge are configured to move the plurality of support elements between the expanded condition and the collapsed condition by movement of the first end in an axial direction, and by movement of the second end in at least a radial dimension;

a plurality of ring elements configured to be moved between the expanded and collapsed conditions by sliding with respect to one another in a direction tangential to a circle concentric with the ring structure; and a retaining ring configured to drive the second end of each support element of the plurality of support elements in the axial direction, wherein each support element of the plurality of support elements is configured to interlock with an adjacent support element of the plurality of support elements via a second component of the lock disposed on a second contact surface of the adjacent support element, and wherein each support element of the plurality of support elements is configured to couple to the retaining ring via a respective lower hinge connection, and wherein each support element of the plurality of support elements is configured to couple to an adjacent ring element of the plurality of ring elements via an upper hinge connection.

14. The apparatus of claim 13, wherein an upper support hinge of a respective support element of the plurality of support elements is configured to couple to a ring mating hinge of the respective adjacent ring element to form the upper hinge connection, and wherein a lower support hinge of the respective support element is configured to couple to a lower mating hinge of the retaining ring to form the lower hinge connection.

15. The apparatus of claim 14, wherein the upper support hinge and the upper mating hinge are configured to rotate about an upper hinge axis of rotation, and wherein the lower support hinge and the lower mating hinge are configured to rotate about a lower hinge axis of rotation.

16. The apparatus of claim 15, wherein each support element of the plurality of support elements comprises an inner surface, an outer surface, an upper outer edge, and an upper inner edge, wherein the upper outer edge corresponds to an edge between the outer surface and the second end and the upper inner edge corresponds to an edge between the inner surface and the second end, wherein the upper hinge axis of rotation extends along a line that is equidistant from the upper outer edge and the upper inner edge, wherein the outer surface comprises the first contact surface.

17. The apparatus of claim 15, wherein each support element of the plurality of support elements comprises an inner surface, an outer surface, a lower outer edge, and a lower inner edge, wherein the lower outer edge corresponds to an edge between the outer surface and the first end and the lower inner edge corresponds to an edge between the inner surface and the first end, wherein the lower hinge axis of rotation extends along a line that is equidistant from the lower outer edge and the lower inner edge, wherein the outer surface comprises the first contact surface.

18. The apparatus of claim 15, wherein the upper axis hinge of rotation is angularly offset from the lower hinge axis of rotation.

19. The apparatus of claim 13, wherein each ring element of the plurality of ring elements is coupled to a first support element and a second support element via a first upper hinge connection and a second upper hinge connection.

20. The apparatus of claim 19, wherein the at least one retaining ring comprises a first retaining ring configured to couple to the first support element via a first lower hinge connection and a second retaining ring configured to couple to the second support element via a second lower hinge connection.

* * * * *